US005748165A

United States Patent [19]

Kubota et al.

[11] Patent Number: 5,748,165

[45] Date of Patent: May 5, 1998

[54] IMAGE DISPLAY DEVICE WITH PLURAL DATA DRIVING CIRCUITS FOR DRIVING THE DISPLAY AT DIFFERENT VOLTAGE MAGNITUDES AND POLARITY

[75] Inventors: Yasushi Kubota, Sakurai; Hiroshi Yoneda, Ikoma; Kenichi Katoh, Tenri, all of Japan

[73] Assignee: Sharp Kabushiki Kaisha, Osaka, Japan

[21] Appl. No.: 363,017

[22] Filed: Dec. 23, 1994

[30] Foreign Application Priority Data

Dec. 24, 1993 [JP] Japan ..... 5-326430
Nov. 9, 1994 [JP] Japan ..... 6-275302

[51] Int. Cl.[6] ..... G09G 3/22

[52] U.S. Cl. ..... 345/96

[58] Field of Search ..... 358/103, 89, 90, 358/92; 345/95–96, 103, 206, 208, 211, 127, 100, 109

[56] References Cited

U.S. PATENT DOCUMENTS

| | | | |
|---|---|---|---|
| 4,842,371 | 6/1989 | Yasuda et al. | 345/103 |
| 5,093,655 | 3/1992 | Tanioka et al. | 345/96 |
| 5,274,366 | 12/1993 | Hayashi et al. | 345/103 |
| 5,392,058 | 2/1995 | Tagawa | 345/103 |
| 5,412,397 | 5/1995 | Kanatani et al. | 345/100 |
| 5,414,443 | 5/1995 | Kanatani et al. | 345/95 |
| 5,418,547 | 5/1995 | Mizukata et al. | 345/100 |
| 5,436,635 | 7/1995 | Takahara et al. | 345/96 |
| 5,438,342 | 8/1995 | Yamaguchi | 345/96 |
| 5,459,484 | 10/1995 | Nguyen | 345/127 |
| 5,465,102 | 11/1995 | Usui et al. | 345/89 |
| 5,510,805 | 4/1996 | Lee | 345/100 |
| 5,528,256 | 6/1996 | Erhart et al. | 345/96 |

FOREIGN PATENT DOCUMENTS

| | | |
|---|---|---|
| 3636230A | 4/1988 | Germany . |
| 3806050A | 12/1988 | Germany . |
| 3817967A | 12/1988 | Germany . |
| 58-45034 | 10/1983 | Japan . |
| 1303881 | 12/1989 | Japan . |
| 543118 | 6/1993 | Japan . |

OTHER PUBLICATIONS

"High–Quality TFT–LCD Using Low–Voltage Driver", SID 1993 Digest, pp. 15–18 (1993).

*Primary Examiner*—Mark R. Powell

[57] ABSTRACT

In order to sufficiently save the power consumption and to lower the withstand voltage of elements, by having one data signal line per one row of pixels and one scanning signal line per one line of pixels, the polarity of data written in the data signal line is varied each one field period. The power source magnitude of the scanning signal lines to be written is further varied each one field period. Specifically, on opposing sides of the pixel array, data signal line driving circuits are provided. The data signal line driving circuits supply voltages of different magnitude and polarity. Adjoining pairs of data signal lines are connected to each of the data signal line driving circuits with analog switches. In a certain display period, such as every field period, the analog switches each select one of a pair of adjacent data signal lines. In the next display period, the reverse selection is made. This suppresses the charge and discharge current of the data signal lines, and thus the operating voltages of the data signal line driving circuits may be lowered. As a result, the power consumption of the image display device may be saved, and the withstand voltage of the constituent elements can be lowered. Thus, manufacturing cost and operating cost can be reduced.

23 Claims, 37 Drawing Sheets

IMAGE DISPLAY DEVICE WITH PLURAL DATA DRIVING CIRCUITS FOR DRIVING THE DISPLAY AT DIFFERENT VOLTAGE MAGNITUDES AND POLARITY

BACKGROUND OF THE INVENTION

1. Field of the Invention

The present invention relates to an image display device such as a liquid crystal display device of an active matrix type in which a driving circuit can be driven with a low voltage.

2. Description of the Related Art

The driving method for an image display device is selected on the basis of the purposes for which the image display device is used. An image display device of an active matrix driving method is well known. This type of image display device, as shown in FIG. 1, comprises a pixel array 121, a scanning signal line driving circuit 122, a data signal line driving circuit 123, and a timing signal generating circuit 124. In an image display device of such a constitution, the scanning signal line driving circuit 122 outputs a scanning signal to the below-mentioned respective scanning lines GLj, GLj+1 . . . in the pixel array 121, using timing signals generated in the timing signal generating circuit 124 on the basis of synchronizing signals. Additionally, the data signal line driving circuit 123 samples video signals and transfers the sampled video signals to the below-mentioned data signal lines SLi, SLi+1 . . . (or transfers after amplifying), using the timing signal.

As shown in FIG. 2A, in the pixel array 121 are arranged numbers of scanning lines GLj, GLj+1 . . . and numbers of data lines SLi, SLi+1 . . . crossing each other. A pixel 125 is provided in the portion between two adjacent scanning signal lines and two adjacent data signal lines. In such manner, the pixels 125 are arranged in a matrix form in the pixel array 121, and one data signal line SL is arranged for one column of pixels and one scanning signal line GL is arranged for one row of pixels.

In a liquid crystal display device, each pixel 125 comprises, as shown in FIG. 2B, a transistor 126 as a switching element, and a pixel capacitance 127 composed of a liquid crystal capacitance CL and, if necessary, an auxiliary capacitance Cs. Generally, in a liquid crystal display device of an active matrix type, the auxiliary capacitance Cs is arranged to be in parallel with the liquid crystal capacitance CL in the pixel 125, in order to stabilize displayed images. The auxiliary capacitance is arranged in order to restrain the effect of the electric leakage of the liquid crystal capacitance CL or transistor 126, the pixel potential fluctuation due to a parasitic capacitance such as the capacitance between the gate and the source of the transistor 126, display data dependence of the liquid crystal capacitance CL and the like to the minimum.

The gate of the transistor 126 is connected to the scanning signal line GLj. One electrodes of the liquid crystal capacitance CL and auxiliary capacitance Cs connected to the data signal line SLi via the drain or source of the transistor 126, and the other electrode of the liquid crystal capacitance CL is connected to the common counter electrode and a liquid crystal cell is interposed therebetween. Additionally the other electrode of the auxiliary capacitance Cs is connected to a common electrode line (not shown) common to all pixels (in the case of Cs on Common structure), or the adjacent scanning signal line GL (in the case of Cs on Gate structure). In the latter case there exist problems such as increase of signal delay and deformed waveform. This is because the parasitic capacitance of the scanning signal line GLj increases. On the other hand, in the former case, the problem of increase of the parasitic capacitance of the scanning signal line is not found. However it is necessary to further arrange an auxiliary capacitance line (common electrode line) to be in parallel with the scanning signal line GLj and as a result there arises another problem that available area of the pixel for displaying is reduced.

The numbers of scanning signal lines GLj, GLj+1 . . . are connected to the scanning signal driving circuit 122, and the numbers of data signal lines SLi, SLi+1 . . . are connected to the data signal line driving circuit 123. The scanning signal line driving circuit 122 and data signal line driving circuit 123 are not shown in the figure, and they are respectively driven with different supply voltages, VDD–VSS and VCC-VEE.

In the image display device, the data signal line driving circuit 123 outputs a data signal for displaying every pixel or every horizontal scanning period (1H line) to the data signal lines SLi, SLi+1 . . . . Additionally, when the scanning signal lines GLj, GLj+1 . . . are in an active state, the transistor 126 is electrically conducted, whereby the data signal for displaying transferred on the data signal lines SLi, SLi+1 . . . are written in the pixel capacitance 127, and displaying is maintained by the electric charge written in the pixel capacitance 127.

At that time it is necessary to drive an alternating bias voltage in order to prevent deterioration of the liquid crystal capacitance CL. When the AC driving (inversion driving) is carried out in a frame period, flicker of, for example, 30 Hz or 25 Hz, is observed clearly, depending on the frame frequency of the signal. Accordingly, it is common to employ, besides frame inversion, a so-called "frame+gate line inversion" drive in which the polarity is inverted every horizontal scanning period, as shown in FIGS. 3A, 3B, or a so-called "frame+source line inversion" drive in which the polarity of the data signal is inverted every vertical scanning period as well as the polarity of the data signal is inverted every row in the field as shown in FIG. 4

However, in the case of an image display device which is required to be AC-driven such as a liquid crystal display device, it is necessary to feed video signals periodically from the data signal line driving circuit 123 to the data signal lines SLi, SLi+1 . . . and write the data in each pixel 125, even when the displayed contents (information) are not changed. As a result a large electric current is required for displaying.

Further, in the "frame+gate line inversion" drive, since the polarity of the data signals outputted to the data signal lines SLi, SLi+1 . . . is inverted every selection of the scanning signal lines GLj, GLj+1 . . . , as shown in FIG. 3, the power consumption due to the charge and discharge current of the data signal lines SLi, SLi+1 . . . . With polarity inversion being enhanced. Besides, as shown in FIG. 3B, the common counter electrode is AC-driven in order to suppress the output voltage range of the data signal line driving circuit 123, which also leads to increase of the power consumption. Thus, in the case of the "frame+gate line inversion" drive, there exists a problem that the power consumption of the image display device is large.

On the other hand, in the case of the "frame+source line inversion" drive, since signals with the same polarity are written in one vertical scanning period, as shown in FIG. 4, the charge and discharge current of the data signal lines SLi, SLi+1 . . . is small, as shown in the portion indicated by slanting lines of FIG. 4. Furthermore, since the video data in the adjacent pixels are generally relatively similar, the charge and discharge current of the data signal lines SLi, SLi+1 . . . is expected to be relatively small. As a result, the power consumption due to the charge and discharge current of the data signal lines SLi, SLi+1 . . . can be reduced.

However, in the case of the "frame+source line inversion" drive, the AC-drive of the common counter electrode, which is carried out in the "frame+gate line inversion" drive, cannot be carried out. As a result, the output voltage range of the data signal lines is extended. Accordingly the supply voltage of the driving circuit has to be increased as well as the power consumption is increased.

Additionally the thick continuous line of FIGS. 3, 4 represents the waveform of the voltage applied to the data signal lines SLi, SLi+1 . . . , the broken line of FIGS. 3, 4 represents the waveform of the voltage applied to the common counter electrode, and the portion indicated by a slanting line represents the power consumption with charge and discharge of the data signal lines SLi, SLi+1 . . . .

In an image display device, particularly in a liquid crystal display, it is desirable to make the range of the voltage applied to the data signal lines SLi, SLi+1 . . . narrow by utilizing the fact that a power consumption is proportional to the second power of a voltage, and to suppress the consumption power of the data signal lines SLi, SLi+1 . . . by driving the data signal line driving circuit 123 with a lower voltage. However, since it is necessary to drive inversely in a liquid crystal display device, it is required of the data signal line driving circuit 123 to apply a voltage in a range two times the range of the liquid crystal driving voltage (sum of the signals of the positive and negative polarities) to the data signal lines SLi, SLi+1 . . . , which leads to an increase of the power consumption.

Recently image display devices of such a type are frequently used as a display device for a portable information terminal. In such application they are on an assumption of being used out of doors, so that it is necessary to drive them with a small sized power supply such as a battery or the like. As a result, the problem of a lower power consumption has to be solved. Thus, the increase of power consumption is very disadvantageous in a portable image display device.

In order to solve these problems, besides the "frame+source line inversion" drive, it is proposed in a liquid crystal display device of an active matrix type in which an amorphous silicon (a-Si) TFT is utilized to lower the power consumption by driving the data signal line driving circuit with a low voltage by changing the supply voltage like alternating bias voltage while maintaining the output range of the data signal line driving circuit. (Society for Information Display, Digest of Technical Papers, Apr. 3, 1993)

However, although the liquid crystal display apparatus proposed therein has a somewhat advantageous effect on decrease of the supply voltage of the data signal line driving circuit as well as on lowering the power consumption, it may lead to not only a larger load of the external power supply circuit due to changing the supply voltage like AC, but also to a malfunction and disturbed display due to noises in changing over the power supply.

SUMMARY OF THE INVENTION

The invention is presented in order to solve the problems and an object of the invention is to provide an image display device in which power consumption is further decreased and the breakdown voltage required of elements composing a driving system including a scanning line driving circuit is lowered.

The invention is presented in view of the aforementioned circumstances and another object of the invention is to provide an image display device in which power consumption is further decreased while ensuring an operation margin, and the breakdown voltage required of elements composing a driving system is lowered.

In order to attain the above-mentioned objects, an image display device of the invention is an active matrix image display device disposing pixels for displaying in a matrix form, and is characterized by comprising:

data signal lines forming one line per one column of the pixels, scanning signal line pairs composed of scanning signal lines forming a set of two lines per one row of the pixels, data line driving means for providing the data signal line with a data signal; and scanning line driving means for providing the scanning signal line pair with a scanning signal that selects a pixel on which the data signal can be written, wherein every two scanning signal lines for composing each scanning signal line pair are divided into first and second scanning signal line groups, pixels connected to the scanning signal lines belonging to the first group are connected to the data signal lines of odd-number columns, and pixels connected to the scanning signal lines belonging to the second group are connected to the data signal lines of even-number columns, and data signals of reverse polarity are written in the odd-number columns and even-number columns of the data signal lines, respectively, in a certain vertical display period, and data signals of reverse polarity of the previous vertical scanning period are written in a next vertical scanning period, in the data signal lines.

In the image display device, the scanning signal line pair composed of two scanning signal lines may be driven in amplitude at first and second voltage levels differing from each other in a certain period, and is driven in amplitude at second and first voltage levels in a next period. Additionally, the scanning signal line pair composed of two scanning signal lines may be selected simultaneously in a horizontal display period.

The pixel for displaying may be composed of at least a switching element for selecting the pixel, a display element, and a auxiliary capacity element, one electrode of the auxiliary capacity element may be connected to one electrode of the switching element, and the other electrode may be connected to a scanning signal line belonging to a different scanning signal line pair from the scanning signal line connected to the switching element. Further, the other electrode of the auxiliary capacity element possessed by the pixel connected to the same scanning signal line may be connected to the same scanning signal line. The scanning line driving means possesses two scanning line driving circuits, and the scanning line driving circuits may be individually driven by different power supply systems. The scanning signal line pair composed of two scanning signal lines are individually connected to different scanning line driving circuits through switching elements, and every time the scanning line pair are selected, one of the scanning signal line pair may be changed over and connected to the other one of the two scanning line driving circuits by the switching elements. The data line driving means possesses two data line driving circuits, and the data line driving circuits may be individually driven by different power supply systems. The even-number column and odd-number column of the data signal lines are individually connected to different data line driving circuits, and the data line driving circuits may be driven by changing over the power supply system in every vertical display period. The even-number column and odd-number column of the data signal lines are individually connected to different data line driving circuits through switching elements, and may be changed over and connected to the other one of the two data line driving circuits by the switching elements in every vertical display period.

In order to attain the above-mentioned objects, an image display device of the invention is an active matrix image display device disposing pixels for displaying in a matrix form, and is characterized by comprising:

data signal line pairs composed of data signal lines forming a pair of two lines per one column of pixels, scanning signal lines forming one line per one row of pixels, data line driving means for providing the data signal line pair with a data signal; and scanning line driving means for providing the scanning signal line with a scanning signal that selects a pixel on which the data signal can be written, wherein every two data signal lines for composing each data signal line pair are divided into first and second data signal line groups, pixels connected to the data signal lines belonging to the first group are connected to the scanning signal lines of odd-number rows, and pixels connected to the data signal lines belonging to the second group are connected to the scanning signal lines of even-number rows, and data signals of reverse polarity are written in a certain vertical display period, and data signals of reverse polarity of the previous vertical scanning period are written in a next vertical scanning period, in the data signal lines.

In the image display device, the pixels for displaying possess a common counter electrode, and the common counter electrode may be driven, in a vertical display period, by alternately applying a voltage of reverse polarity to the polarity of the data signal line connected to the pixel which is connected to the scanning signal line.

Additionally, only one scanning signal line of the scanning signal lines may be selected in a horizontal display period. Furthermore, both of a scanning signal line of an odd-number row and a scanning signal line of an even-number row may be selected, one each out of the scanning signal lines in a horizontal display period. The data line driving means possesses two data line driving circuits, and the data line driving circuits may be individually driven by different power supply systems. The data signal line pairs composed of two data signal lines are individually connected to different data line driving circuits through switching elements, and the data line driving circuits may be driven by changing over the power supply system in every vertical display period. The data signal line pairs composed of two data signals are individually connected to different data line driving circuits through switching elements, and may be changed over and connected to the other one of the two data line driving circuits by the switching elements in every vertical display period.

In order to attain the above-mentioned objects, an image display device of the invention is an active matrix image display device disposing pixels for displaying in a matrix form and characterized by comprising:

one scanning line driving means, data line driving means including two data line driving circuits, data signal lines forming one line per one column of the pixels, and scanning signal lines forming one line per one row of the pixels, wherein the two data line driving circuits are individually driven by different power supply systems, and are changed over in the power supply systems in every vertical display period and driven, and an even-number column and an odd-number column of the data signal lines are individually connected to different data line driving circuits, and data of opposite polarities are written in a certain vertical display period, and data of reverse polarities of the previous vertical display period are written in the next vertical display period.

In order to attain the above-mentioned objects, an image display device of the invention is an active matrix image display device disposing pixels for displaying in a matrix form and characterized by comprising:

one scanning line driving means, data line driving means including two data line driving circuits, data signal lines forming one line per one column of the pixels, and scanning signal lines forming one line per one row of the pixels, wherein the two data line driving circuits are individually driven by different power supply systems, and an even-number column and an odd-number column of the data signal lines are individually connected to different data line driving circuits through a switching element, and are changed over and connected to the other one of the two data line driving circuits by the switching element in every vertical display period, and data of opposite polarities are written in a certain vertical display period, and data of reverse polarities of a certain vertical display period are written in the next vertical display period.

In the image display device, a common counter electrode of the pixels is composed of two counter electrodes, being divided in a column direction, with a counter electrode in an even-number column and a common counter electrode in an odd-number column connected with each other, different potentials are applied to individual common counter electrodes in a certain vertical display period, and voltage of reverse polarity of the previous vertical display period is applied to the two common counter electrodes respectively in the next vertical display period.

An image display device of the invention may be applied when either or both of the scanning line driving means and data line driving means are formed on the same substrate as the pixels.

In an image display device of the invention, part or all of active elements constituting the scanning line driving means and data line driving means, and switching elements which are constituent elements of the pixels may be formed on a single crystalline silicon thin film or a polycrystalline silicon thin film formed on a transparent substrate. Additionally, means for supplying electric power for driving one or both of the scanning line driving means and data line driving means may be formed on the same substrate.

An image display device of the invention may be applied when the image display device is a liquid crystal display device.

According to the invention, image displaying in which the charge and discharge current in the data signal line is suppressed can be carried out because the potential of the data signal line is maintained to be in the same polarity during one field period.

Additionally, since the data driving circuit or scanning line driving circuit is divided and driven by a separated power supply, the respective driving voltage may be decreased and as a result the breakdown voltage of the constituent element may be decreased.

According to an image display device of the invention, by the above-mentioned constitution of the scanning signal line or data signal line, the polarity of the data written in the data signal line is maintained to be the same during a field period and the output range of the data line driving circuit is made narrow. As a result a lowered breakdown voltage, effective in producing monolithic display, can be attained in the driving circuit.

An image display device of the invention is characterized in that the device is provided with the following means in order to solve the above-mentioned problems.

An image display device of the invention comprises:

a plurality of pixels disposed in a matrix form;

a plurality of scanning signal lines, each connected to one row of the pixels;

a plurality of data signal lines, each connected to one column of the pixels;

a scanning signal line driving circuit for driving each scanning signal line with a scanning signal;

at least two data signal line driving circuits, each individually powered by a power supply of different voltage level, for applying video signals of different polarities to an even-number columns and odd-number columns of the data signal lines, and inverting the polarity of the video signals applied to the even-number column and odd-number column of the data signal lines in every predetermined data display period, and means for exchanging the data signal line driving circuits corresponding to the even-number column and odd-number column of the data signal line in every predetermined data display period, so that the video signal from one data signal line driving circuit is applied to the data signal line of an even-number column, and applying so that the video signal from the other data signal line driving circuit is applied to the data signal line of odd-number column.

In an image display device of the invention, the exchanging means possesses two systems of switching elements commonly connected to one output stage of the data signal line driving circuits, and is connected to the two data signal lines of odd-number column and even-number column which form a pair. The two switching elements are conducted alternately in every specific data display period to thereby connect the data signal line driving circuits and data signal lines.

In an image display device of the invention, the exchanging means possesses a first switching element connected to one output stage of the data signal line driving circuits for taking in a video signal, and a second switching element in two systems for applying the video signal of the first switching element to the two data signal lines, and the second switching element is alternately conducted in every predetermined data display period thereby to connect the data signal line driving circuits and data signal lines.

In an image display device of the invention, part or all of the data signal line driving circuits, exchanging means, and active elements contained in the pixels are formed on a single crystalline silicon thin film or a polycrystalline silicon thin film formed on an insulating substrate.

In an image display device of the invention, the switching elements or the first switching element and second switching element are gates of CMOS structure comprising parallel connected n-channel transistor and p-channel transistor.

An image display device of the invention comprises:

plural pixels disposed in a matrix form for displaying by means of active matrix drive, a scanning signal line connected to one row of the pixels, data signal line connected to one column of the pixels, a scanning signal line driving circuit for providing the scanning signal line with a scanning signal, two systems of data signal line driving circuits for applying video signals of different polarities to an even-number column and an odd-number column of the data signal lines, and inverting the polarity of the video signals applied to the even-number column and odd-number column of the data signal lines in every specific data display period, and means for connecting two systems of power supplies of different voltage levels to the individual data signal line driving circuits by changing over in every specific data display period, wherein part or all of the data signal line driving circuits and active elements contained in the pixels are formed on a single crystalline silicon thin film or a polycrystalline silicon thin film formed on an insulating substrate.

In an image display device of the invention, the connecting means is formed on the insulating substrate.

In an image display device of the invention, two systems of the data signal line driving circuits are driven at such a supply voltage as to apply only the video signal of one polarity each to the data signal line.

In an image display device of the invention, the data signal line driving circuits comprise:

sampling means for sampling the video signals and transferring to the data signal lines.

In an image display device of the invention, the data signal line driving circuits comprise:

sampling means for sampling the video signals, holding means for temporarily holding the video signals sampled by the sampling means, and amplifying means for amplifying the video signals held by the holding means and transferring to the data signal lines.

In an image display device of the invention, the data signal line driving circuits comprise:

sampling means for sampling digital signals for representing video information, and selecting means for selecting one of plural discrete voltages on the basis of the digital signals sampled by the sampling means and transferring to the data signal lines.

In an image display device of the invention, two systems of the data signal line driving circuits are disposed at one same side of the pixel matrix.

In an image display device of the invention, each pixel possesses a liquid crystal element.

In the image display device of the invention, the even-number column and odd-number column of the data signal lines are given video signals from data signal line driving circuits different from each other during a data display period and during the next data display period, video signals are given from respective data signal line driving circuits different from those in the previous data display period. Furthermore, by two systems of data signal line driving circuits, for example, video signals of the positive polarity are given to the even-number columns of the data signal lines, and video signals of the negative polarity are given to the odd-number columns of the data signal lines during a certain data display period. In the following data display period, video signals of the negative polarity are given to the even-number columns of the data signal lines, and video signals of the positive polarity are given to the odd-number columns of the data signal lines.

In other words, what has to be handled in the respective data signal line driving circuits may be only video signals of one of the polarities by combining the operation with the exchanging means and the "frame+source line inversion" drive of the data signal line driving circuits as described above. As a result, the driving voltage of the data signal line driving circuit can be lowered.

In the image display device of the invention, since one of the first and second switching elements is conducted at the time when the data signal line driving circuit and the data signal line are connected, there exists only one switching element between the video signal line or power line in the digital driving method and the data signal line. Thereby the impedance of the switching element when conducting is lowered and the video signal can be easily given to the data signal line.

Further in the image display device of the invention, the video signal is once taken into the first switching element and then given through the second switching element in two systems to any one of the data signal lines. In this constitution, what has to be added after the first switching element may be only the second switching element. Thereby the increase of the area of the driving circuit including the exchanging means can be controlled to be relatively small with the result that the increase of the area of the image display device can be controlled to be as small as possible.

Further in the image display device of the invention, since part or all of the data signal line driving circuits, exchanging means, and active elements forming the pixels are formed on a single crystalline or polycrystalline silicon thin film formed on an insulating substrate, the breakdown voltage thereof has a tendency to be lowered in comparison with that of the conventional active element formed on a single crystalline semiconductor substrate. A sufficient operational margin, however, can be ensured because the driving voltage of the data signal line driving circuit can be lowered.

Further in the image display device of the invention, the n-channel transistor and a p-channel transistor in the gate of CMOS structure are simultaneously conducted by individually applying a voltage of a polarity different from each other. At that time, the video signal on a lower potential side passes through the n-channel transistor, and the video signal on the higher potential side passes through the p-channel transistor. Consequently the video signals can be reproduced in a wider range from the lower potential side to the higher potential side.

Further in the image display device of the invention, power supplies of different voltage levels are connected to the even-number column of the data signal lines and the odd-number column of the data signal lines through the two systems of the data signal line driving circuits by the connecting means, and the connection is changed over every predetermined data display period. The respective data line driving circuits are driven by different power supply systems and the driving power supply systems are changed over every data display period. Additionally, by means of the two systems of the data signal line driving circuits driven by different power supply systems, for example, in a certain data display period, the video signal of the positive polarity is given to the even-number column of the data signal lines and the video signal of the negative polarity is given the odd-number column of the data signal lines. In the next data display period, the video signal of the negative polarity is given to the even-number column of the data signal lines and the video signal of the positive polarity is given to the odd-number column of the data signal lines.

In other words, what has to be handled in the respective data signal line driving circuits may be only video signals of one of the polarities by combining the operation of changing over the power supply with the connecting means and the "frame+source line inversion" drive of the data signal line driving circuits as described above. As a result the driving voltage of the data signal line driving circuit can be lowered.

Part or all of the data signal line driving circuits and active elements contained in the pixels are formed on a single crystalline or polycrystalline silicon thin film formed on an insulating substrate, whereby the load of the power supply circuit is decreased and changing over the power supply can be conducted immediately and easily.

Further, in the image display device of the invention, the connecting means is formed on the insulating substrate, whereby connecting wires for connecting the connecting means to the data signal line driving circuit and the like are incorporated in the insulating substrate with the result that an external wiring for connecting the connecting means to the external circuit (controller, power supply etc.) can be eliminated. Accordingly, a dedicated line for connecting the connecting means to the external circuit is not required and an external circuit which has been used for other purposes can be diverted for this purpose as it is.

Further, in the image display device of the invention, two systems of the data signal line driving circuits are driven at such a supply voltage as to apply only the video signal of one polarity each to the data signal line, whereby the driving voltage becomes the minimum requirement with a result that the driving voltage of the data signal line driving circuit can be lowered like the above-mentioned image display device.

Further, in the image display device of the invention, the video signal is sampled by the sampling means and transferred direct to the data signal line. This is a so-called panel sample-and-hold method, where the necessary number of sampling means for one data signal line may be only one. Consequently the number of the circuits which control the transfer gates and sampling means in the later stage is reduced.

Further in the image display device of the invention, the video signal is sampled by the sampling means and once held in the holding means to transfer to the data signal line by the amplifying means. This is a so-called driver sample-and-hold method, where the writing time of the video signal into the data signal line is fully long (about one horizontal scanning period). Consequently the switching element which forms the sampling means may be driven with a lower power with a result that the switching element can be decreased in size.

Further in the image display device of the invention, the digital signals are sampled by the sampling means. Thereafter one discrete voltage level is selected from the plural discrete voltage levels by the selecting means on the basis of the sampled digital signals and transferred to the data signal line. This is a so-called digital driving method, wherein displaying in a multigradation mode displaying, which requires a great number of power supplies the video signals to be handled, are only of one of the polarities, resulting in reducing the number of necessary power supplies in half.

The two systems of the data signal line driving circuits are disposed at one same side of the pixel matrix. Consequently, by a concentrated manner such that signals are inputted into the image display device at one position, the length of the circuited signal line and the like can be reduced and as well as the constitution may be applied when an identical video signal has to be inputted from the both sides of the data signal line with widening a display panel.

Further the image display device of the invention is of a matrix type in which a pixel has a liquid crystal element, and besides power consumption reduction due to lowered driving voltage of the data signal line driving circuit, low power consumption feature owned by a liquid crystal display can be obtained.

As described above, the image display device of the invention comprises:

plural pixels disposed in a matrix form for displaying by means of active matrix drive, a scanning signal line connected to one row of the pixels, a data signal line connected to one column of the pixels, a scanning signal line driving circuit for providing the scanning signal line with a scanning signal, two systems of data signal line driving circuits driven individually by power supplies of different voltage levels, for applying video signals of different polarities to an even-number column and an odd-number column of the data signal lines, and inverting the polarity of the video signals applied to the even-number column and odd-number column of the data signal lines in every specific data display period, and means for exchanging the data signal line driving circuits corresponding to the even-number column and odd-number column of the data signal line in every specific data display period, while applying the video signal from one data signal line driving circuit to the data signal line of even-number column, and applying the video signal from the other data signal line driving circuit to the data signal line of odd-number column.

Thereby the polarity of the data signal line potential can be maintained to be the same during one field period (one vertical scanning period), and therefore image displaying can be conducted under the condition that the charge and discharge current in the data signal line is suppressed. Additionally, since the data signal line driving circuit is divided into some parts, which are independently driven by means of individual power supplies, the respective supply voltages can be decreased and besides the requirements regarding the breakdown voltage of the composing elements can be mitigated. As a result an effect that the power consumption of the driving circuit is reduced can be attained.

Further, in the image display device of the invention, the exchanging means possesses two systems of switching elements commonly connected to one output stage of the data signal line driving circuits, and connected to the two data signal lines of odd-number column and even-number column which form a pair, and the two switching elements are conducted alternately in every specific data display period thereby to connect the data signal line driving signals and data signal lines.

Thereby, since there exists only one switching element between the video signal line or power line and the data signal line, the impedance of the switching element when conducting is lowered and the video signal can be easily written into the data signal line.

Further, in the image display device of the invention, the exchanging means possesses a first switching element connected to one output stage of the data signal line driving circuits for taking in a video signal, and a second switching element in two systems for applying the video signal taken into the first switching element to the two data signal lines, and the second switching element is alternately conducted in every specific data display period thereby to connect the data signal line driving circuits and data signal lines.

Thereby a function of changing over can be realized only by adding the second switching element after the first switching element which has been used for taking video signals also in the conventional constitution. Therefore the increase of area of the data signal line driving circuit can be controlled to be relatively small. Consequently an effect that the increase of the image display device area is controlled to be as small as possible can be attained.

Further, in the image display device of the invention, part or all of the data signal line driving circuits, exchanging means, and active elements contained in the pixels are formed on a single crystalline silicon thin film or a polycrystalline silicon thin film formed on an insulating substrate.

Thereby, the breakdown voltage of the above-mentioned active element has a tendency to be lowered in comparison with that of the conventional active element formed on a single crystalline semiconductor substrate. However, since the driving voltage of the data signal line driving circuit can be lowered, as described above, an effect that a sufficient operational margin is ensured can be attained.

Further, in the image display device of the invention, since the switching elements or the first and second switching elements are gates of CMOS structure composed of the n-channel transistor and p-channel transistor which are connected in parallel with each other, the video signal on a lower potential side passes through the n-channel transistor, and the video signal on the higher potential side passes through the p-channel transistor. Consequently the video signals can be reproduced in a wider range from the lower potential side to the higher potential side and therefore high quality of images can be reproduced.

Further, the image display device of the invention comprises:

plural pixels disposed in a matrix form for displaying by means of active matrix drive, a scanning signal line connected to one row of the pixels, a data signal line connected to one column of the pixels, a scanning signal line driving circuit for providing the scanning signal line with a scanning signal, two systems of data signal line driving circuits for applying video signals of different polarities to an even-number column and an odd-number column of the data signal lines, and inverting the polarity of the video signals applied to the even-number column and odd-number column of the data signal lines in every specific data display period, and means for connecting two systems of power supplies of different voltage levels to the individual data signal line driving circuits by changing over in every specific data display period, wherein part or all of the data signal line driving circuits and active elements contained in the pixels are formed on a single crystalline silicon thin film or a polycrystalline silicon thin film formed on an insulating substrate.

Thereby the respective data signal line driving circuits are driven by different power supply systems and the "frame+source line inversion" drive is carried out in combination with changing over the power supply systems every data display period, what has to be handled in the respective data signal line driving circuits may be only video signals of one of the polarities and as a result the driving voltage of the data signal line driving circuit can be lowered. Additionally, part or all of the data signal line driving circuits and active elements contained in the pixels are formed on a single crystalline or polycrystalline silicon thin film formed on an insulating substrate, whereby the load of the power supply circuit is decreased and changing over the power supply can be conducted immediately and easily. Consequently an effect that the power consumption of the driving circuit is lowered can be attained.

Still further, in the image display device of the invention, since the connecting means is formed on the insulating substrate, connecting wires for connecting the connecting means to the data signal line driving circuit and the like are incorporated in the insulating substrate with the result that an external wiring for connecting the connecting means to the external circuit (controller, power supply etc.) can be eliminated. Accordingly, a dedicated line for connecting the connecting means to the external circuit is not required and an external circuit which has been used for other purposes can be diverted for this purpose as it is. Therefore, an effect that complicated manufacturing steps are avoided can be attained.

Further the image display device of the invention is driven at such a supply voltage that only the video signal of one polarity is applied to the data signal line, whereby the driving voltage becomes the minimum requirement with a result that the driving voltage of the data signal line driving circuit can be lowered like the above-mentioned image display device. Accordingly an effect that the power consumption and breakdown voltage of the driving circuit of the image display device are lowered can be attained in its simple constitution.

Further, since the image display device of the invention comprises the sampling means which samples video signals and transfer to the data signal line, the video signals are sampled by the sampling means and transferred direct to the data signal line. Thereby the necessary number of sampling means for one data signal line may be only one. Consequently the number of the circuits which control the transfer gate and the sampling means in the later stage is reduced. Consequently an effect that the number of parts is reduced can be attained.

Further, in the image display device of the invention, since the data signal line driving circuits comprise sampling means for sampling the video signals, holding means for temporarily holding the video signals sampled by the sampling means, and amplifying means for amplifying the video signals held by the holding means and transferring to the data signal lines, a fully long writing time of the video signal into the data signal line is ensured (about one horizontal scanning period). Consequently the switching element which forms the transferring means may be decreased in size, and as a result the data signal line driving circuit can be decreased in size.

Further, in the image display device of the invention, the data signal line driving circuits comprise sampling means for sampling digital signals for representing video information, and selecting means for selecting one of plural discrete voltage levels on the basis of the digital signals sampled by the sampling means and transferring to the data signal lines, whereby, in displaying in a multigradation mode displaying which requires a great number of power supplies the video signals to be handled are only of one of the polarities, resulting in reducing the number of necessary power supplies in half. As a result the size of the power supply can be reduced.

Further, in the image display device of the invention, the two systems of the data signal line driving circuits are disposed at one same side of the pixel matrix, whereby a concentrated manner such that signals are inputted into the image display device at one position may be employed. Consequently the length of the circuited signal line and the like can be reduced. The driving with two systems of data signal line driving circuits may also be conducted by providing two systems of data signal line driving circuits on the other side of the pixel matrix, when an identical video signal has to be inputted from the both sides of the data signal line with widening a display panel. Accordingly the image display device is easily adaptable to a widened display panel.

Further, in the image display device of the invention, each pixel comprises a liquid crystal element. In other words, the image display device of the invention is of a matrix type and an advantage of low power consumption feature owned by a liquid crystal display device can be utilized more profitably. Accordingly lowering the power consumption of the liquid crystal display device can be further promoted.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
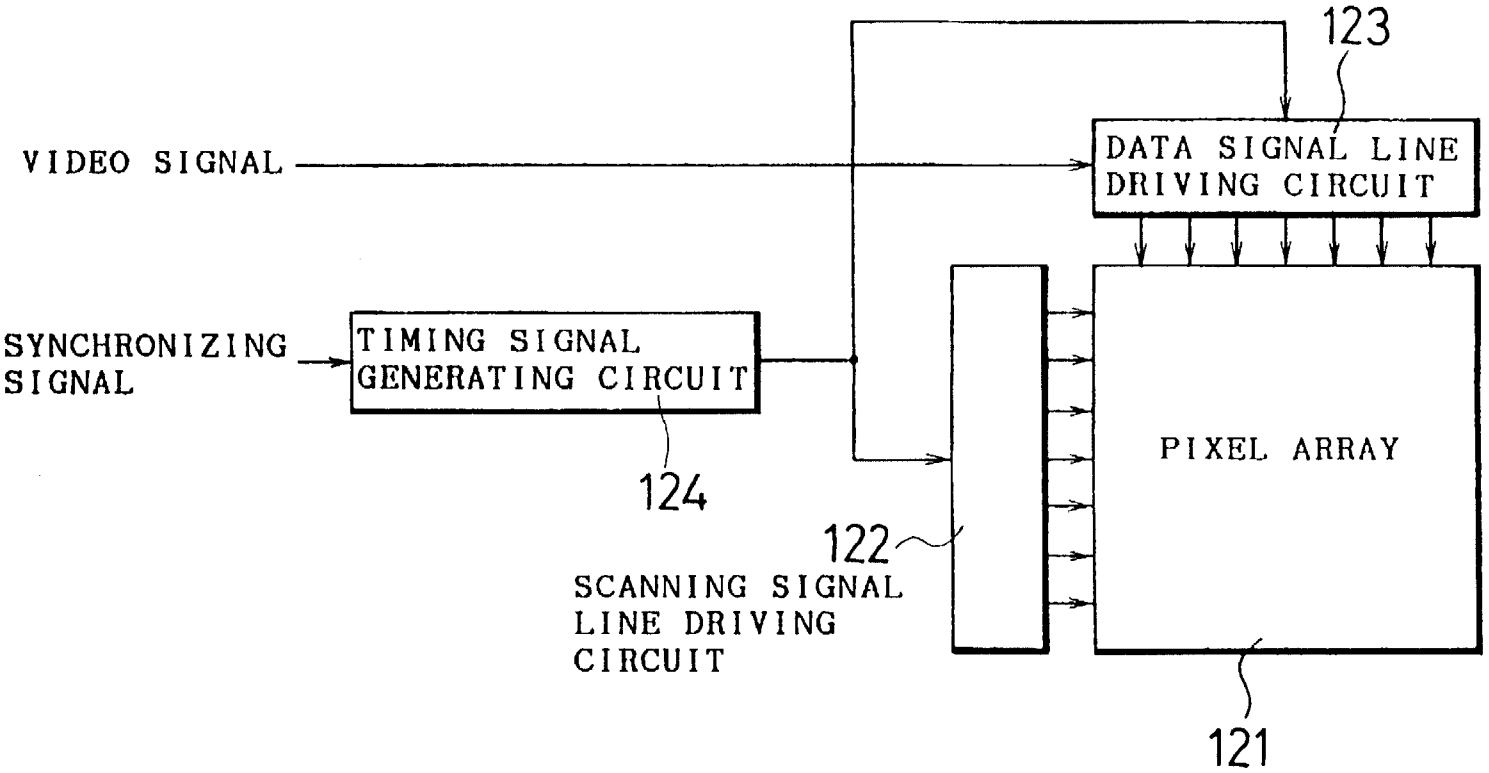
FIG. 1 PRIOR ART
FIG. 1 is a block diagram showing a schematic constitution of a conventional liquid crystal display device.
Figure 2A:
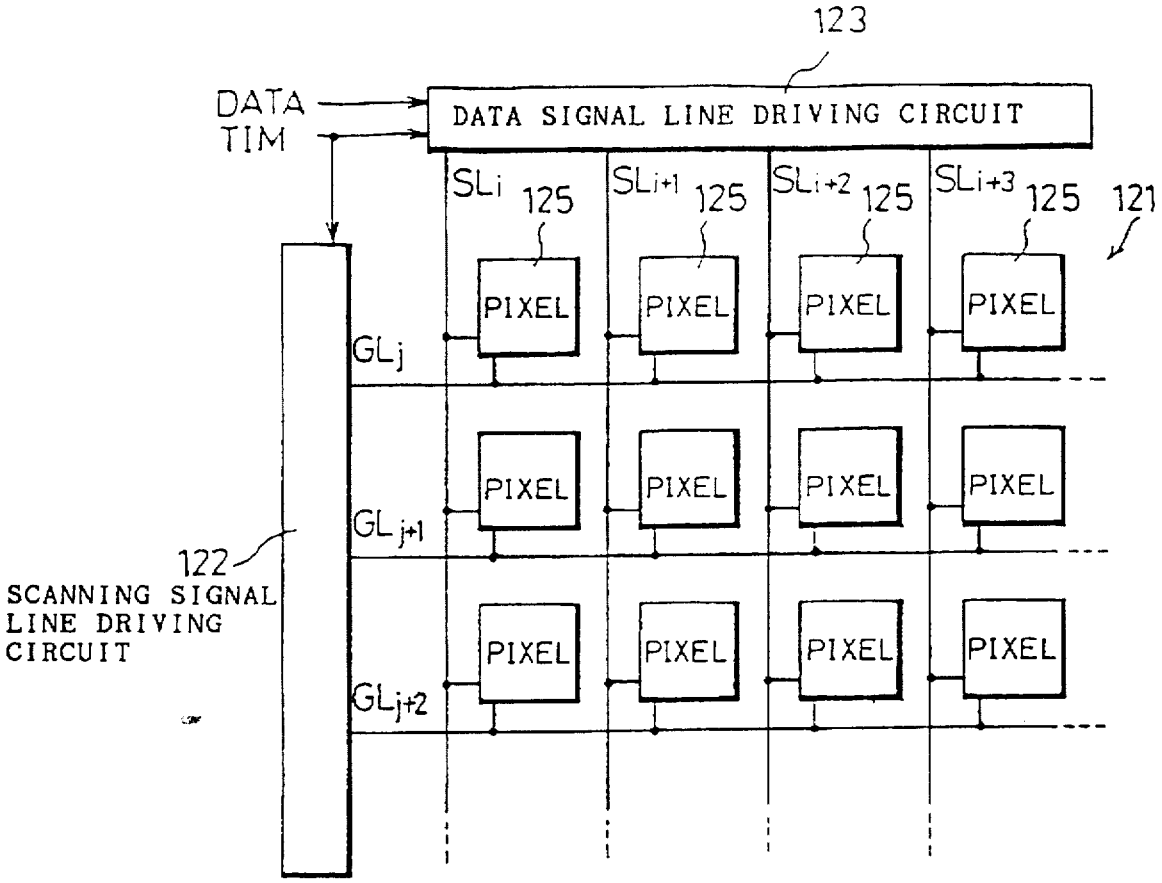
FIG. 2A PRIOR ART
FIG. 2A is a block diagram showing the constitution of pixel array in the liquid crystal display device in FIG. 1
Figure 2B:
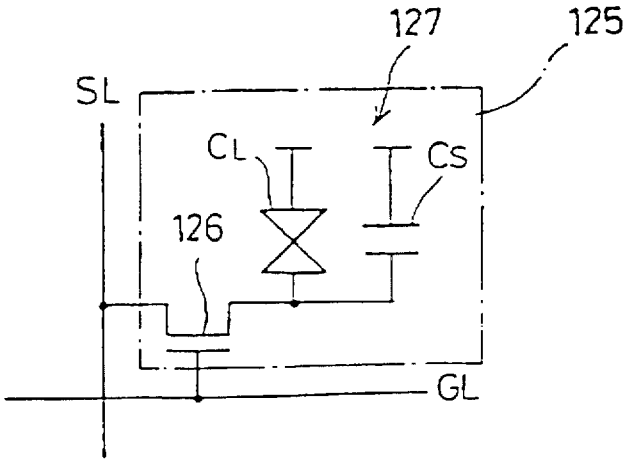
FIG. 2B PRIOR ART
FIG. 2B is a circuit diagram showing the constitution of pixels.
Figure 3A:
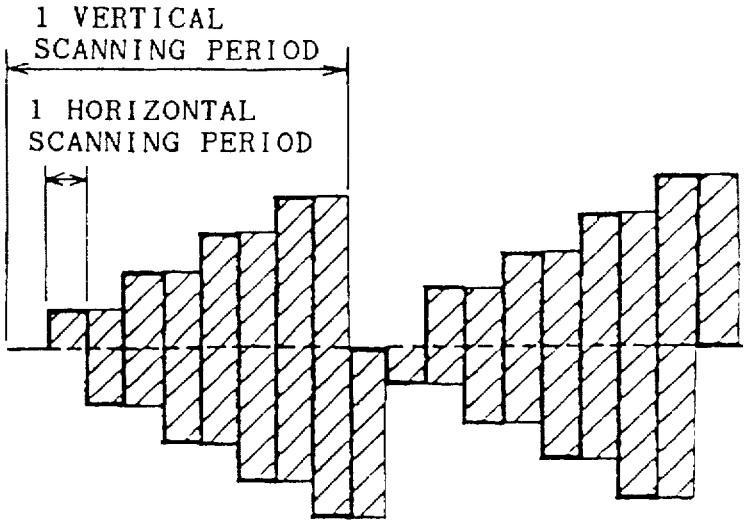
FIG. 3A PRIOR ART
FIG. 3A is a waveform diagram showing applied voltage and others of data signal lines of "frame+gate line inversion" drive in a conventional liquid crystal display device.
Figure 3B:
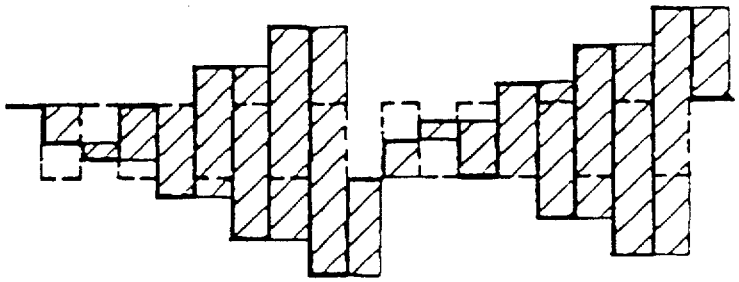
FIG. 3B PRIOR ART
FIG. 3B is a waveform diagram showing applied voltage and others of data signal line signals by AC driving of common counter electrode in "frame+gate line inversion" drive.

Now referring to the drawings, preferred embodiments of the invention are described below.

EXAMPLE 1

Figure 5:
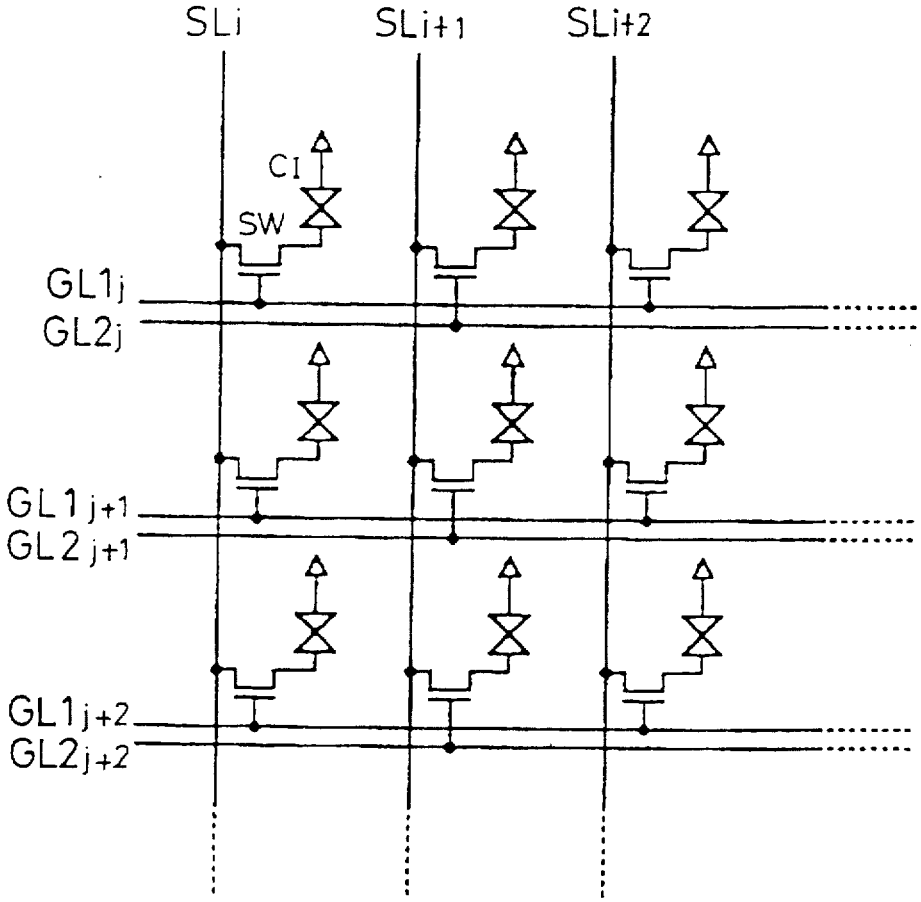
FIG. 5 is a diagram showing a first example of a pixel array unit in an image display device according to Example 1 of the invention.

FIG. 5 is a diagram showing an example of an image display device in a first embodiment of the invention. In FIG. 5, each pixel composed of a switching element SW and a pixel capacitance C1 (formed of liquid crystal capacitance and auxiliary capacitance added as required) is disposed in a matrix form, and one data signal line SLm (m=i, i+1, i+2, . . . ) is laid down in every pixel column, and a set of two scanning signal lines GL1n and GL2n (n=j, j+1, j+2, . . . ) in every pixel row, and each pixel is alternately connected to either scanning signal line GL1n or GL2n of the set. In each data signal line SLm, the positive polarity data and negative polarity data are alternately written, and presented for display.

Figure 4:
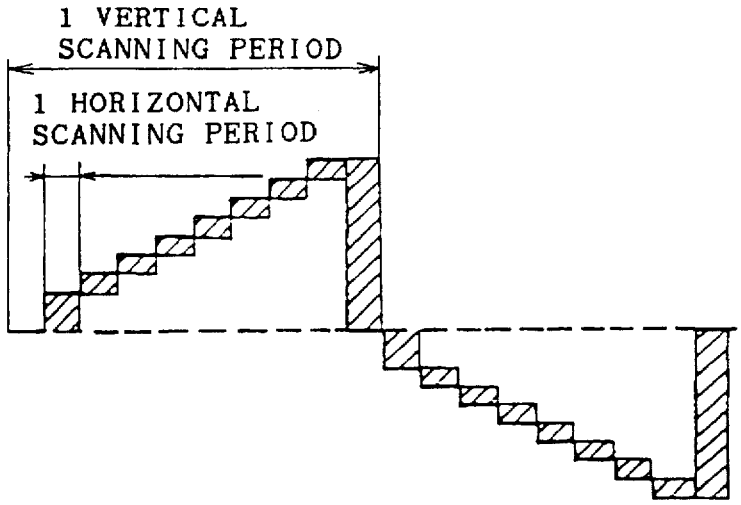
FIG. 4 PRIOR ART
FIG. 4 is a waveform diagram showing applied voltage and others of data signal lines of "frame+source line inversion" drive in a conventional liquid crystal display device.

In this constitution, within each field period, data of same polarity are written in one data signal line SLm, and therefore the charge and discharge current in the data signal line SLm is suppressed as shown in FIG. 4. It is enough to charge (or discharge) only the portion corresponding to the difference from the data signal line voltage in the previous horizontal line scanning. Therefore, as is often seen in general image, the suppressing effect of current consumption becomes more apparent if there is a close correlation in the display data of the adjoining pixels. In this constitution, since it is basically "frame+source line inversion" drive, the common counter electrode is not driven by AC.

In the conventional "frame+source line inversion" drive, in the scanning signal lines GL1n and GL2n, in order to write data of both positive polarity and negative polarity from the data signal line SLm into pixels, it was necessary to feed waveforms of large amplitude. However, in this embodiment, since the scanning signal lines GL1n and GL2n play the role of writing the data of either positive polarity or negative polarity from the data signal line SLm into the pixels, large amplitude as in the conventional "frame+source line inversion" drive is not required.

Therefore, a higher potential may be given only when writing data of positive polarity.

Figure 6A:
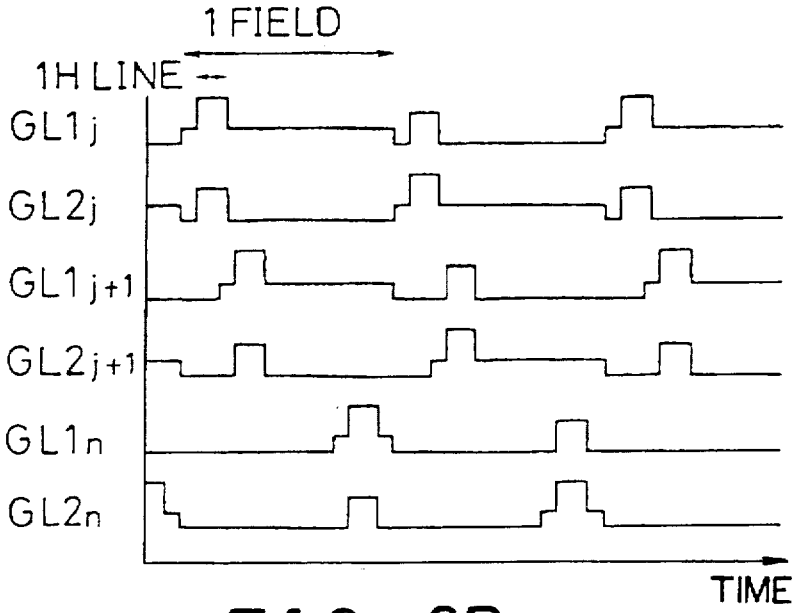
FIGS. 6A, 6B are diagrams showing waveform examples of scanning signal lines in the example of FIG. 5.
Figure 6B:
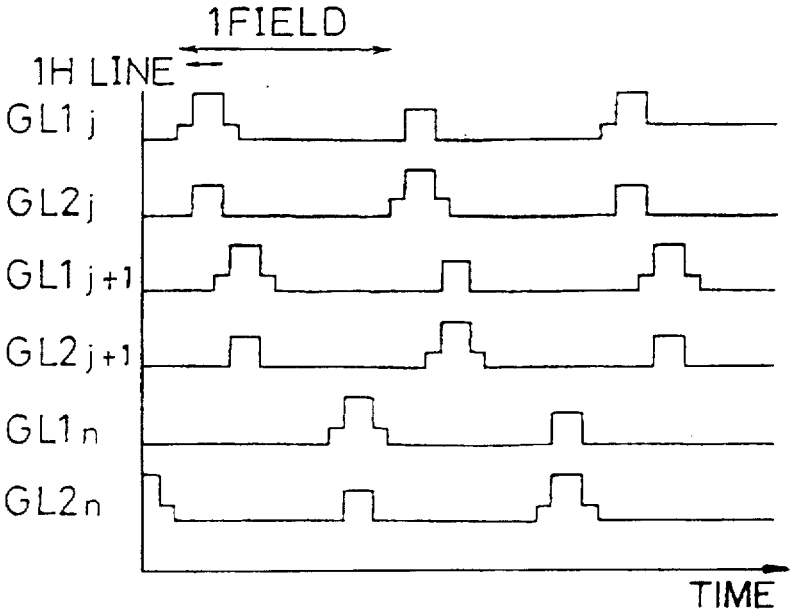

As shown in FIGS. 6A or 6B, by driving at different voltage level depending on the polarity of the data given to the data signal line SLm and the polarity of the data written in the pixel, data can be sufficiently written into the pixel in the waveform of smaller amplitude. At the time of the next writing or next field, the polarity of the data is inverted. Therefore, the voltage level of the scanning signal lines GL1n and GL2n can be changed over.

Figure 7A:
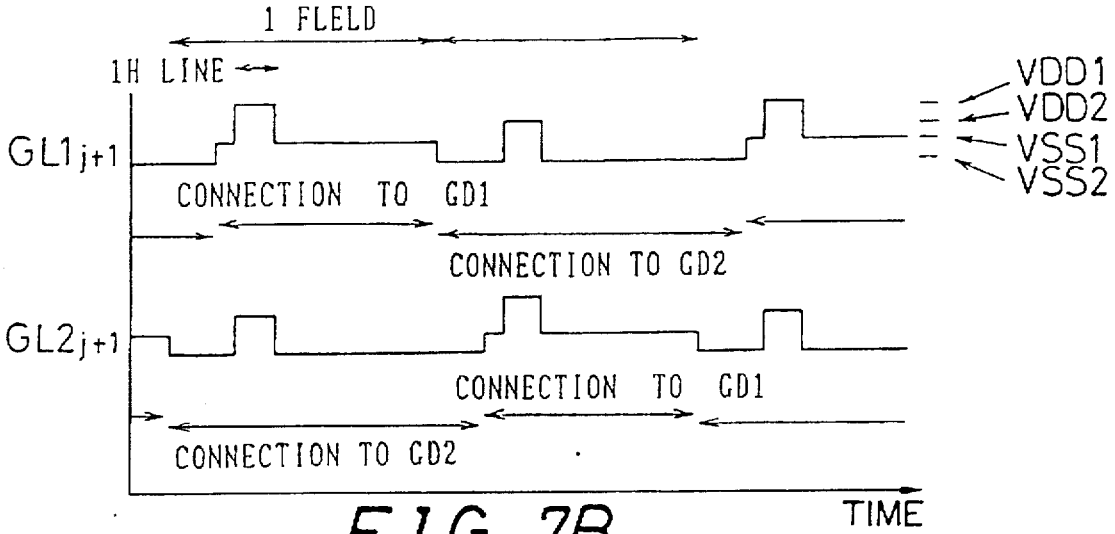
FIGS. 7A, 7B are diagrams showing the waveform examples of the scanning signal lines in FIGS. 6A, 6B in detail.
Figure 7B:
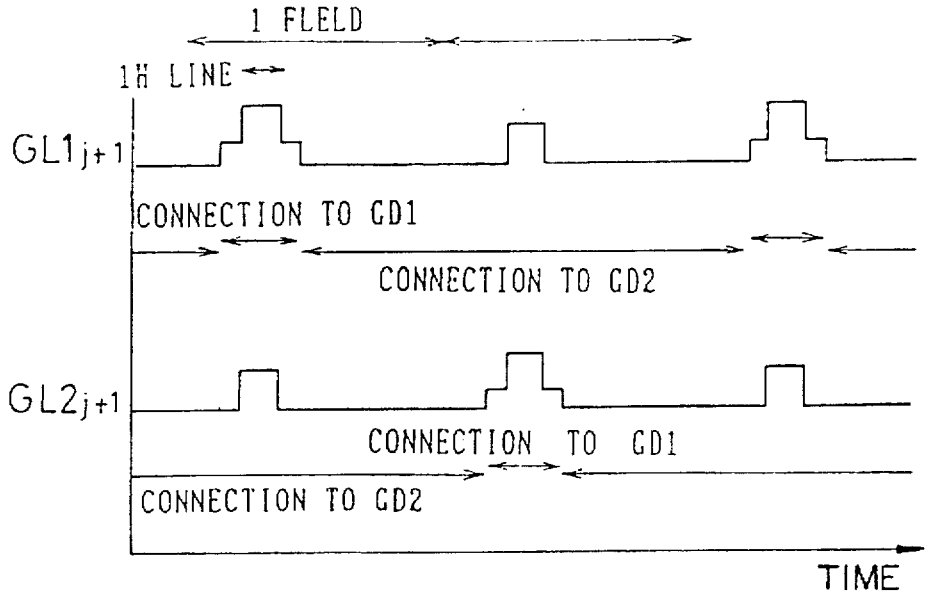

FIGS. 7A, 7B are timing charts for specifically explaining the driving methods shown in FIGS. 6A, 6B, respectively. In FIG. 7A, in a display period (field) when a video signal is on the positive side, each scanning signal line GL is connected to a scanning line driving circuit (power supply: VDD1, VSS1) which outputs a scanning line pulse on the higher potential side during the period from just before selecting the scanning line (e.g., before one scanning period) to the end of the display period, and in the other periods (the period from the beginning of the display period when a video signal on the negative side to just before selecting a scanning line (e.g., before one scanning period) when a video signal is on the positive side), connected to a scanning line driving circuit (power supply: VDD2, VSS2) which outputs a scanning line pulse on the lower potential side.

On the other hand, in FIG. 7B, in a display period (field) when a video signal is on the positive side, each scanning signal line GL is connected to a scanning line driving circuit (power supply: VDD1, VSS1) which outputs a scanning line pulse on the higher potential side during the period from just before selecting the scanning line (e.g., before one scanning period) to just after selecting the scanning line, and in the other periods (the period from the beginning of the display period when a video signal is on the positive side to just after selecting a scanning line (e.g., after one scanning period) when a video signal is on the positive side), connected to a scanning line driving circuit (power supply: VDD2, VSS2) which outputs a scanning line pulse on the lower potential side.

In the figures, the supply voltage of GD1 is VDD1, VSS1, and that of GD2 is VDD2, VSS2 (VSS2<VSS1<VDD2<VDD1). For each scanning signal line GL, the below-mentioned changing over circuit SEL is operated in order to change over the connection of GD2 to GD1 and vice versa.

In this embodiment, one each may be selected as scanning signal lines GL1n and GL2n, but writing from different data signal lines SLm can be done simultaneously. Therefore, it is effective to select a pair of scanning signal lines GL1n and GL2n simultaneously.

In the pixels of an active matrix liquid crystal display device, an auxiliary capacitance Cs is added parallel to a liquid crystal capacitance C1 in order to stabilize the display. This is intended to minimize the effects of leak current of liquid crystal capacitance C1 or pixel transistor SW, fluctuations of pixel potential due to parasitic capacitance such as gate-source capacitance of pixel transistor SW, dependence of liquid crystal capacitance C1 on the display data, etc.

One electrode of the auxiliary capacitance Cs is connected to the pixel electrode, and the other is connected usually to the adjoining scanning signal line, or a common auxiliary capacitance line. In the former case, since the parasitic capacitance of the scanning signal line increases, increase of delay or bluntness of signal waveform occurs. Furthermore, in the case of inverting and driving the common counter electrode, it is necessary to superpose the corresponding signal also on the scanning signal line, and the scanning line driving circuit may be complicated. In the latter case, on the other hand, although the parasitic capacitance of scanning signal line is not increased, it is necessary to newly lay down the auxiliary capacitance line parallel to the scanning signal line, and hence the aperture ratio is lowered.

Figure 8:
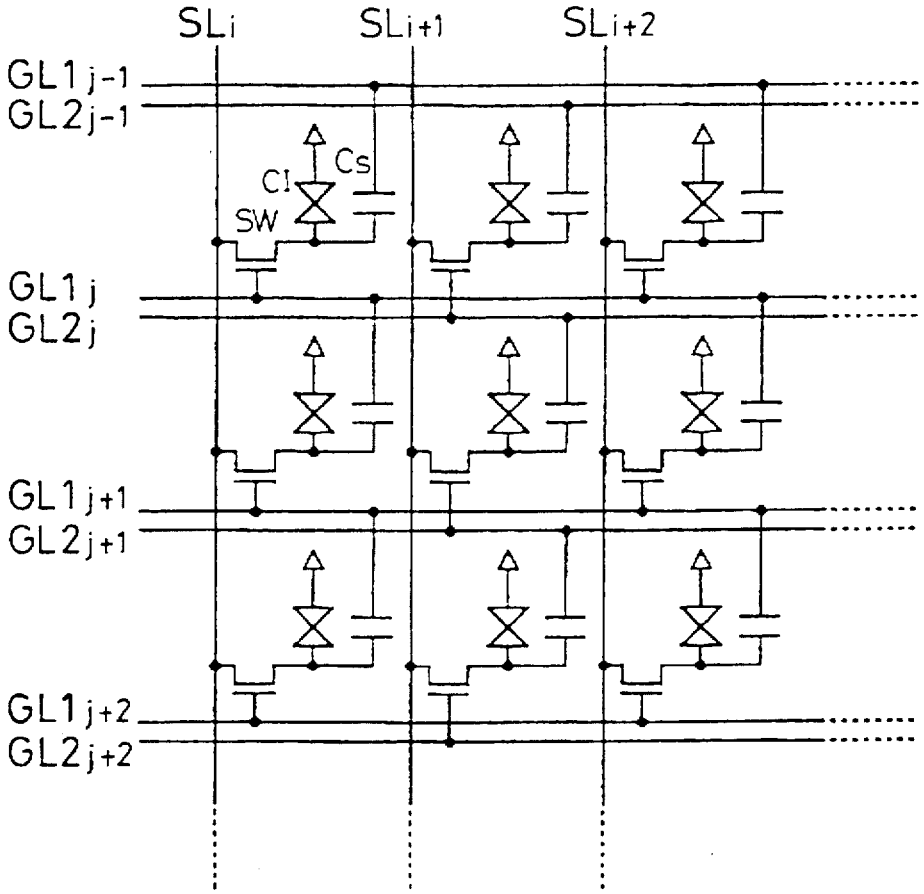
FIG. 8 is a diagram showing a connection example of an auxiliary capacitance in the example of FIG. 5.

In this embodiment, as shown in FIG. 8, the other electrode of the auxiliary capacitance Cs can be connected to either one of the adjoining scanning signal line pair GL1n and GL2n. The number of pixel transistors connected to each scanning signal line GL1n and GL2n is ½ of those in the case of one scanning signal line, and the number of connected auxiliary capacities Cs is also ½ of those that are usual. Thus the parasitic capacitance of the scanning signal lines GL1n and GL2n can be suppressed to ½ of the former. On the other hand, the number of scanning lines is doubled, and hence the aperture ratio is nearly equal to that in the latter case.

Thus, in this embodiment, although the number of scanning signal lines is doubled, the parasitic capacity of the scanning signal lines and aperture ratio of the pixels is the same as in the case of using the auxiliary capacitance lines.

Figure 9:
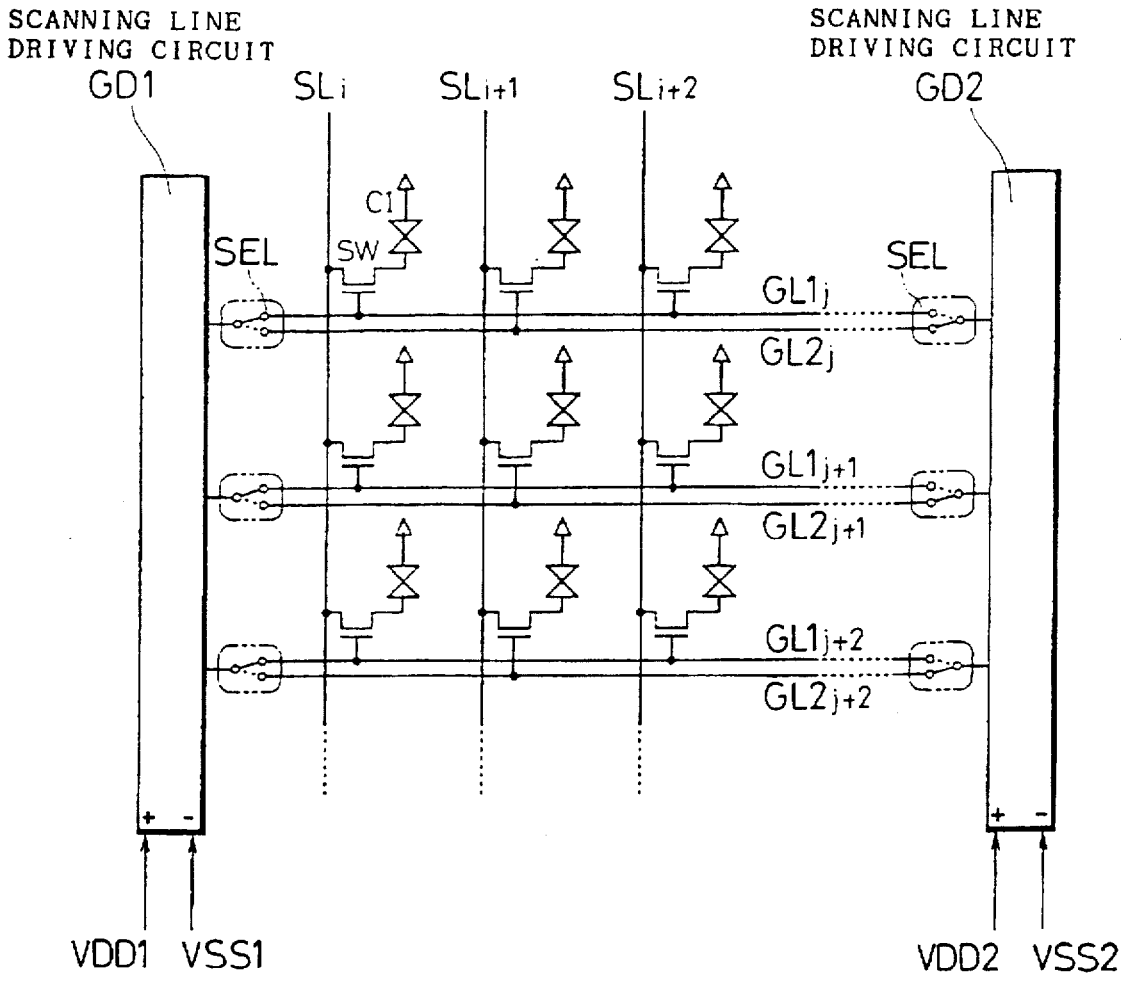
FIG. 9 is a diagram showing an example of a connection form between scanning signal lines and a scanning line driving circuit in the example of FIG. 5.

In this embodiment, the power supply level of the scanning signal lines GL1n and GL2n are changed over in driving. Therefore, as shown in FIG. 9, it is possible to drive the scanning signal lines GL1n and GL2n in two scanning line driving circuits GD1 and GD2 different in the operating power supply level. Therefore, the output voltage range of the scanning line driving circuits GD1 and GD2 becomes small, and the scanning line driving circuits can be lowered in breakdown voltage, so that it is effective for saving cost.

The constitution of the scanning line driving circuit is the same as the constitution of a scanning signal line driving circuit in Example 4 as will be described later.

In this case, the power supply levels VDD1/VSS1 and VDD2/VSS2 of the scanning signal lines GL1n and GL2n can be changed over by synchronous signals of image data or the like, by means of a switching circuit SEL provided between the scanning signal lines GL1n and GL2n and two scanning line driving circuits GD1 and GD2. In this constitution, the area occupied by the scanning line driving circuits GD1 and GD2 may be increased, but the breakdown voltage of the scanning line driving circuit may not be particularly increased as compared with other elements (data line driving circuit, pixel transistor, etc.). Therefore, when forming the pixel transistor and driving circuit on the same substrate (in a monolithic structure), it is possible to manufacture in the same process (film thickness of gate insulator film, etc.), and hence the performance of the other elements is not lowered unnecessarily (e.g., there is no need to increase the gate insulator film thickness to lower the transistor driving force in order to heighten the element breakdown voltage in accordance with the scanning line driving circuit), so that it is also advantageous from the viewpoint of cost.

This embodiment is basically driven by "frame+source line inversion" and positive polarity data and negative polarity data are alternately written in the data signal lines SLm, and data of the same polarity are written in one data signal line SLm in each field period. Therefore, data can be supplied to the data signal lines SLm by two data line driving circuits SD1 and SD2 differing in the operating power supply level. As a result, the output voltage range of the data line driving circuits SD1 and SD2 becomes narrow, so that the breakdown voltage can be lowered, which is effective for saving cost. The constitution of the data line driving circuit is the same as the constitution of a data signal line driving circuit in Example 4 as will be described later.

Figure 10:
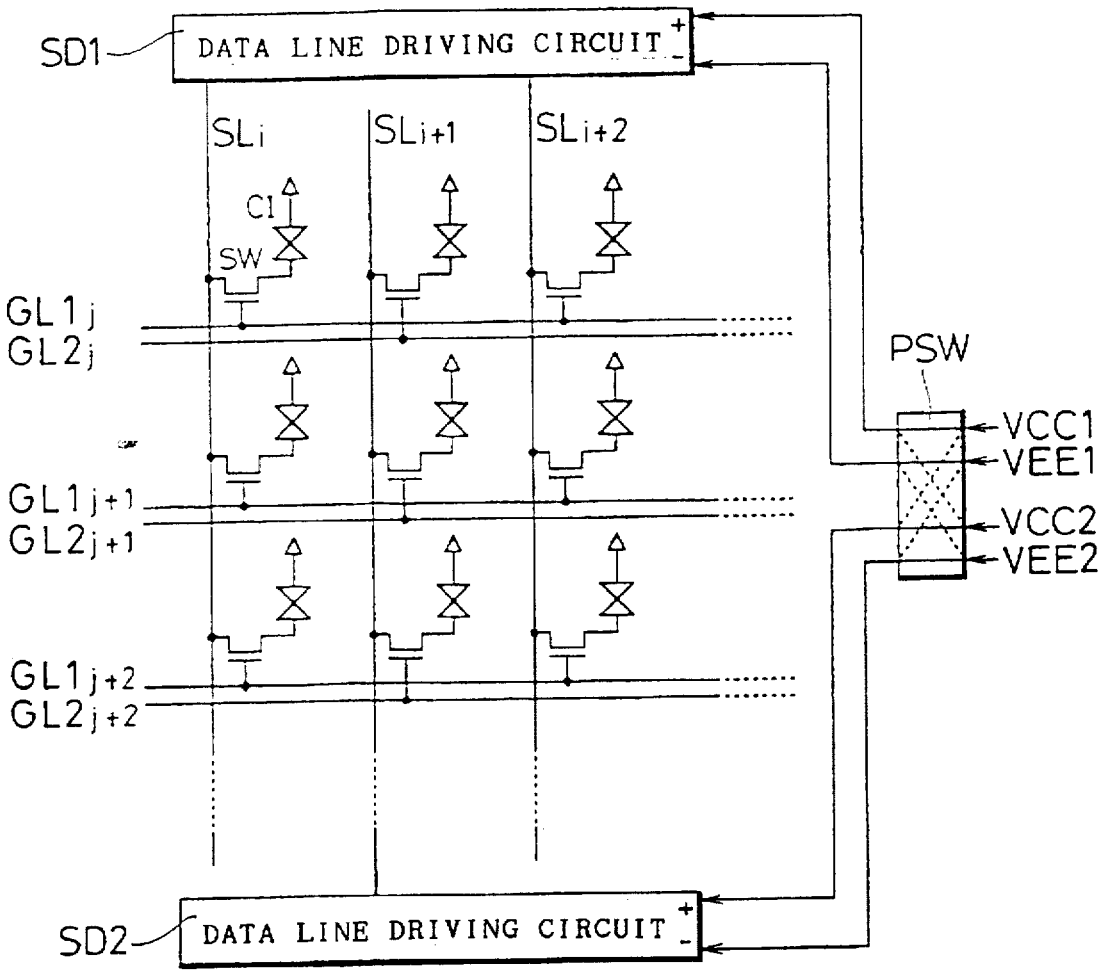
FIG. 10 is a diagram showing an example of a connection form between data signal lines and a data line driving circuit in the example of FIG. 5.

In this case, the changeover of power supply levels VCC1/VEE1 and VCC2/VEE2 of data signal lines in every field period is possible, as shown in FIG. 10, by changing over the operating power supply level of the two data line driving circuits SD1 and SD2 by the power supply changeover circuit PSW. In this constitution, the sampling frequency of the data line driving circuits SD1 and SD2 can be reduced to ½ of those that are usual.

Figure 11:
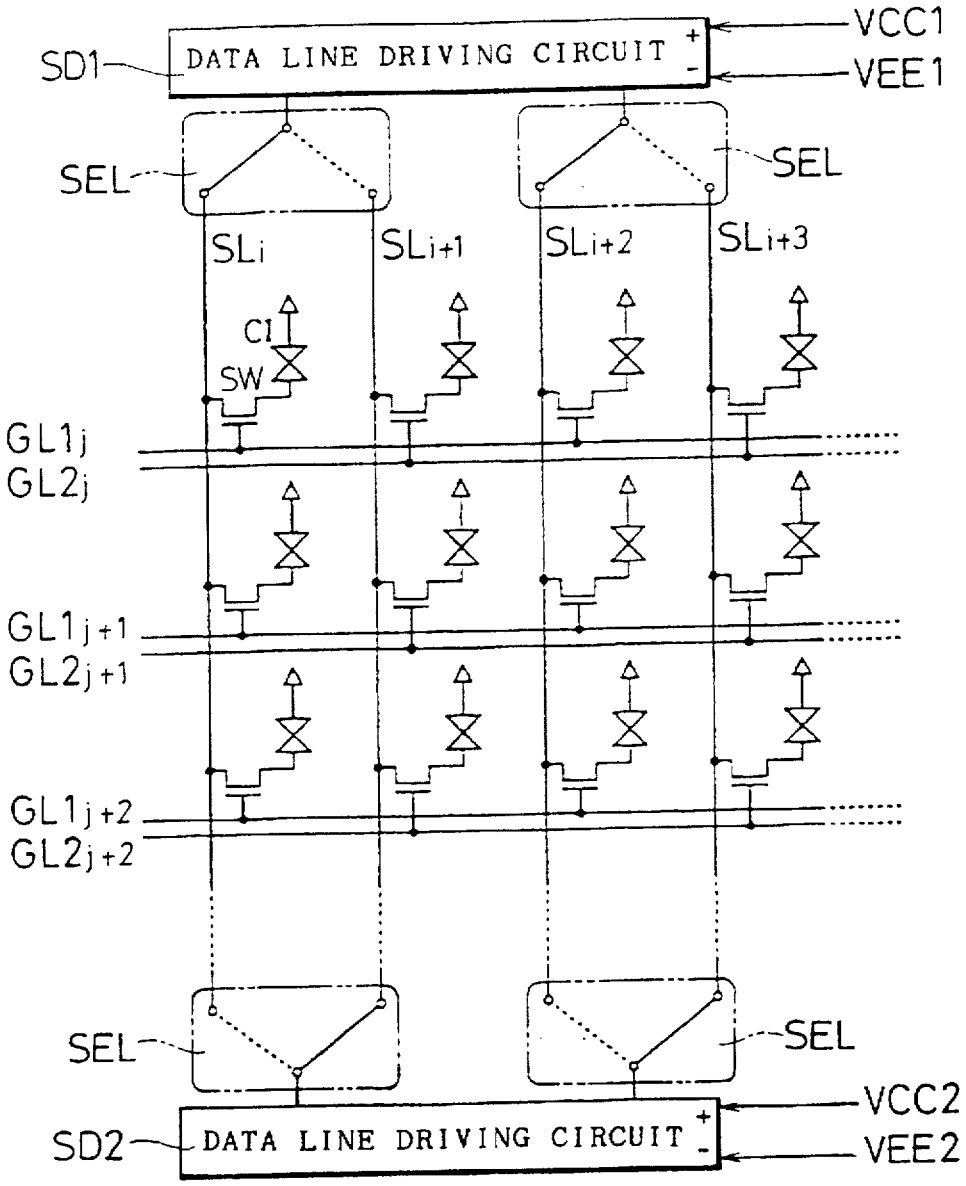
FIG. 11 is a diagram showing another example of a connection form between data signal lines and a data line driving circuit in the constitutional example in FIG. 5.

In this case, the changeover of power supply levels VCC1/VEE1 and VCC2/VEE2 of the data signal line SLm effected in every field period may be done, as shown in FIG. 11, by a switching circuit SEL installed between the data signal line SLm and two data line driving circuits SD1 and SD2, by vertical synchronous signal of image data or the like. In this constitution, too, the sampling frequency of the data line driving circuits SD1 and SD2 can be also reduced to ½ of those that are usual. In order to match the display position, however, a certain display position adjusting circuit (not shown) is needed. For example, a delay circuit for one pixel in the data line driving circuits SD1 and SD2, or a circuit for delaying the image signal itself being inputted in the data line driving circuits SD1 and SD2.

EXAMPLE 2

Figure 12:
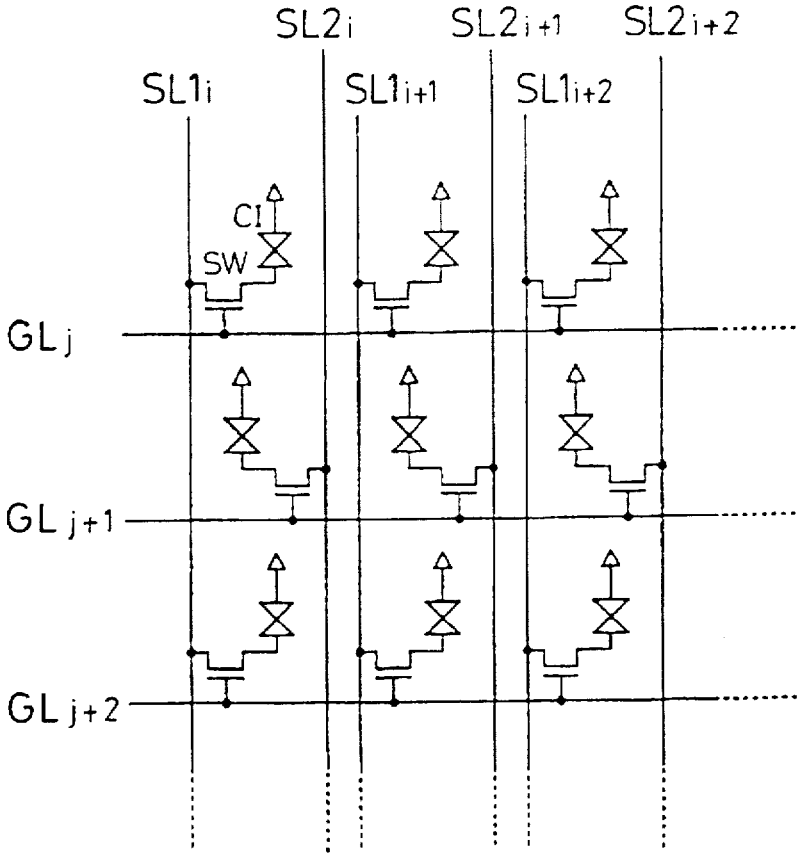
FIG. 12 is a diagram showing a second example of the pixel array unit in the image display device according to Example 2 of the invention.

FIG. 12 shows another example of the image display device. In FIG. 12, pixels are disposed in a matrix form, a set of two data signal lines SL1m and SL2m are laid down in every pixel column, and one scanning signal line GLn in every pixel row, and each pixel is alternately connected to either one of data signal lines SL1m and SL2m of the set. The positive polarity data and negative polarity data are written into the set of two data signal lines SL1m and SL2m, respectively, and presented for display. In FIG. 12, auxiliary capacitance Cs is not shown, but it may be added as required. In this constitution, as in the constitution in FIG. 5, data of the same polarity is written into one data signal line SL1m or SL2m in each field period, and therefore the charge and discharge current in the data signal line is suppressed.

Figure 13:
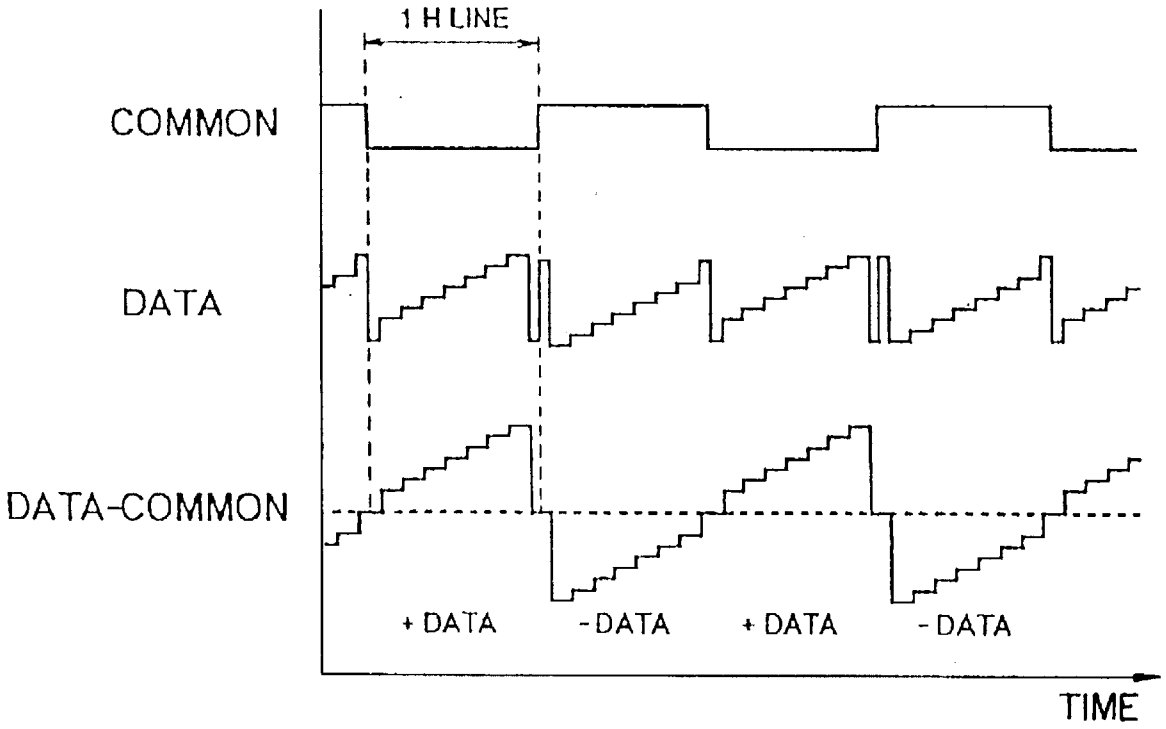
FIG. 13 is a diagram showing a waveform example of common counter electrode lines and data signal lines in the example of FIG. 12.

Since this embodiment is basically driven in "frame+gate line inversion" and AC driving of the common counter electrode is also possible as shown in FIG. 13. This is intended to display in a small data signal line amplitude by applying a voltage of reverse polarity from the polarity of data signal line DATA to the common counter electrode COMMON. At this time, the power consumption due to driving of the common counter electrode is generated, but the amplitude of the data signal line can be reduced, so that the power consumption is saved on the whole.

In the conventional "frame+gate line inversion" drive, it was necessary to write data of reverse polarity in every horizontal line in the data signal lines. Therefore, depending on the image, for example, in the liquid crystal display device of TN (twisted nematic) mode, when continuing to display black data in normally white display mode, an excessive charge and discharge current flows in every horizontal scanning period, which caused increase in the current consumption.

By contrast, in this constitution, having two sets of data signal lines SL1m and SL2m, in each data signal line, only one of the positive polarity data and negative polarity data is written in a certain field period. In the next field, by inverting the polarity of the data written in the data signal lines SL1m and SL2m, frame inversion is realized. Therefore, also in the "frame+gate line inversion" drive for inverting and driving the common counter electrode for suppressing the amplitude of the data signal line, it is possible to suppress the charge and discharge current of the data signal line, which is effective for decreasing the power consumption.

Herein, the scanning signal lines GLn may be selected one by one. However the data signal lines SL1m and SL2m are connected to every other pixel in the column direction in this constitution, there is no effect on display even if two scanning signal lines GLn corresponding to different data signal lines are driven simultaneously.

As mentioned above, this embodiment is basically driven in "frame+gate line inversion" and data of the same polarity is written in one data signal line SL1m or SL2m in each field period, and hence it is possible to supply data into the data signal line SL1m or SL2m by two data line driving circuits SDl and SD2 differing in the operating power source level. Accordingly, the output voltage range of the data line driving circuits SD1 and SD2 becomes narrow, and the breakdown voltage can be lowered, so that it is effective for saving the cost.

Figure 14:
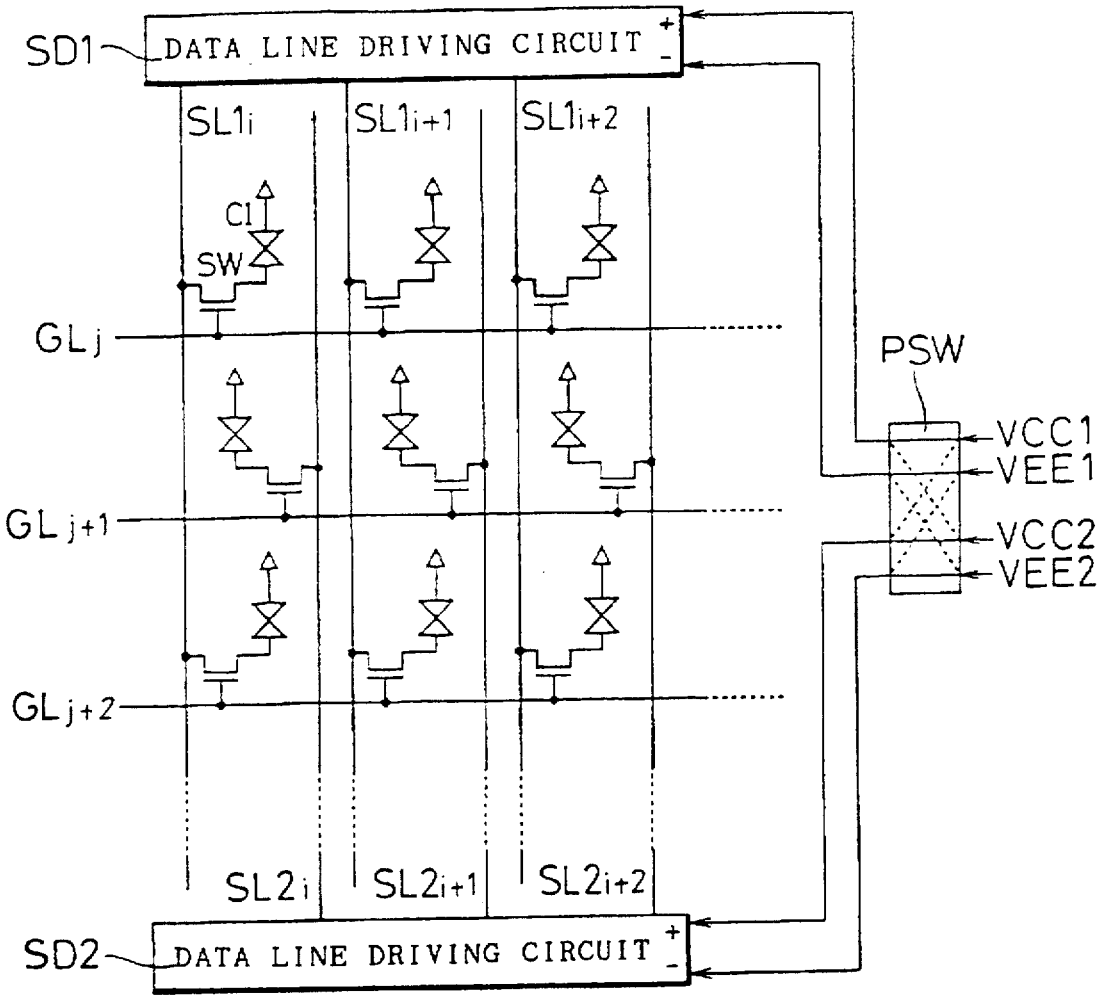
FIG. 14 is a diagram showing an example of a connection form between data signal lines and a data line driving circuit in the example of FIG. 12.

In this case, the changeover of power supply levels VCC1/VEE1 and VCC2/VEE2 of data signal line in every field period is effected by, as shown in FIG. 14, changing over the operating power supply level of two data line driving circuits SD1 and SD2 by the power supply changeover circuit PSW .

Figure 15:
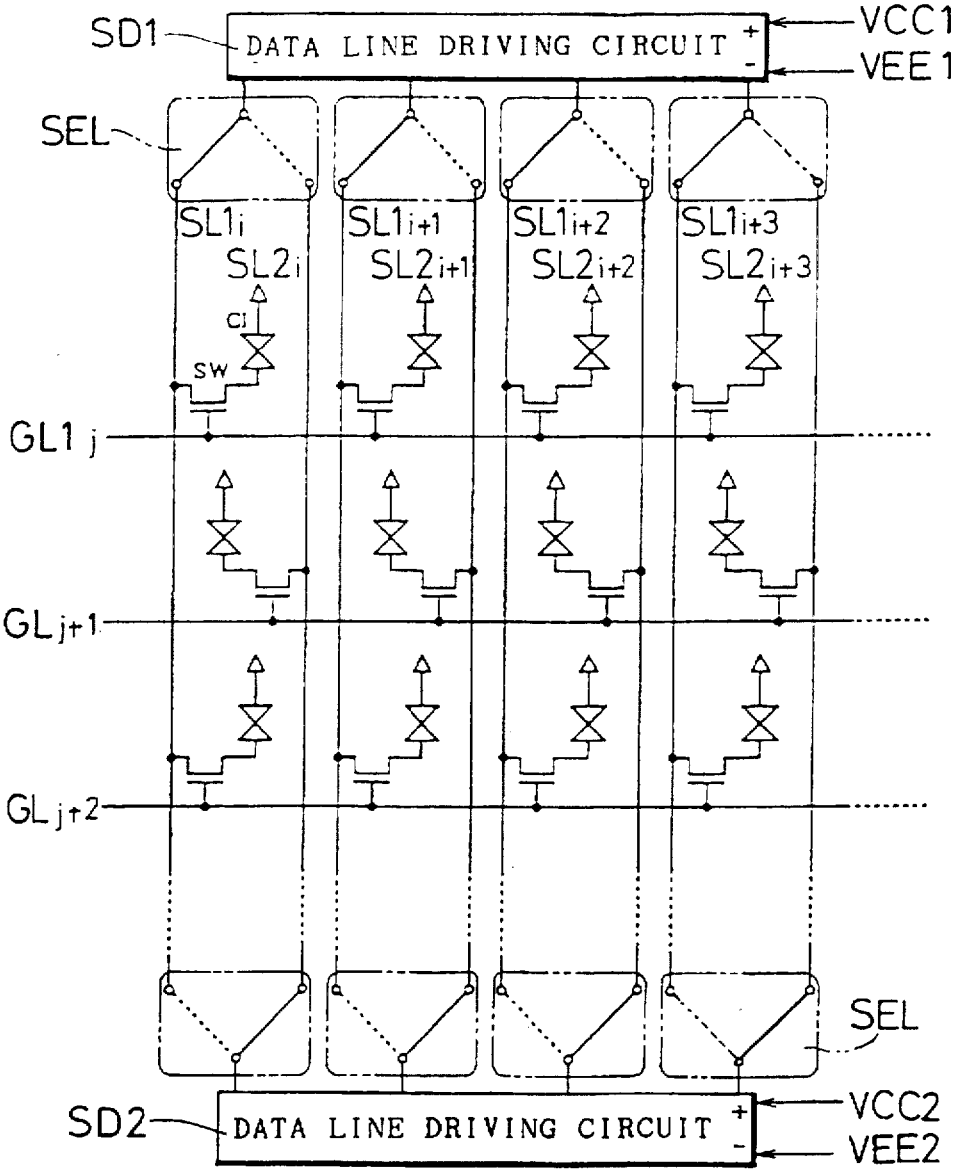
FIG. 15 is a diagram showing another example of a connection form between data signal lines and a data line driving circuit in the example of FIG. 12.

Besides, the changeover of power supply levels VCC1/VEE1 and VCC2/VEE2 of data signal line in every field period is effected by, as shown in FIG. 15, using the switching circuit SEL installed between the data signal line SL1m or SL2m and two data line driving circuits SD1 and SD2, by the vertical synchronous signal of image data, etc.

EXAMPLE 3

Figure 16:
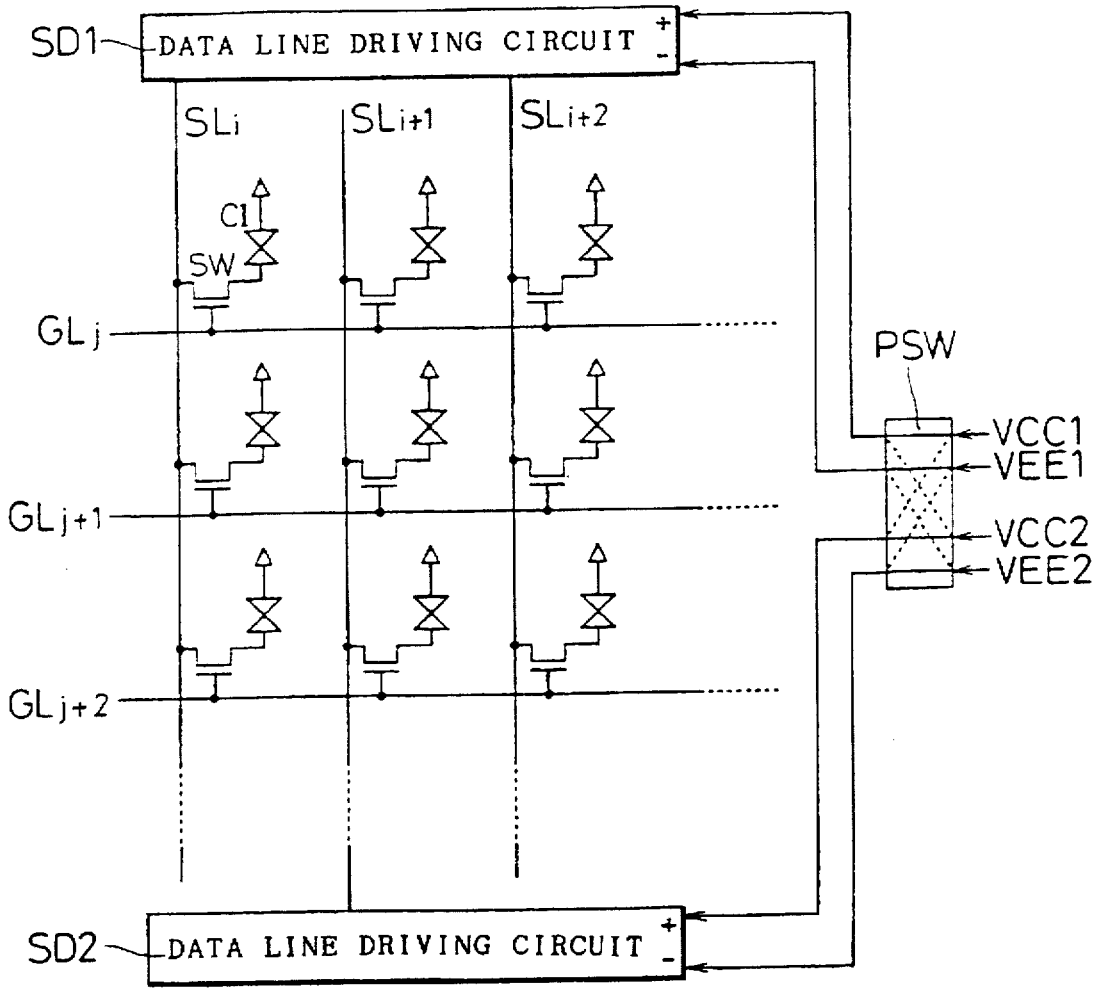
FIG. 16 is a diagram showing a third example of the pixel array unit in the image display device according to Example 3 of the invention.

FIG. 16 is a diagram showing a different example of the image display device in this embodiment. In FIG. 16, the pixels are arranged in a matrix form, and one data signal line is laid down in every pixel column, and one scanning signal line GLn in every pixel row. In the data signal line SLm, alternately, positive polarity data and negative polarity data are written, and data are supplied into the data signal lines SLm from two data line driving circuits SD1 and SD2 differing in the operating power supply level, and changeover of power supply levels VCC1/VEE1 and VCC2/VEE2 of data signal line SLm in every field period is done by changing over the operating power supply level of the two data line driving circuits SD1 and SD2.

Figure 17:
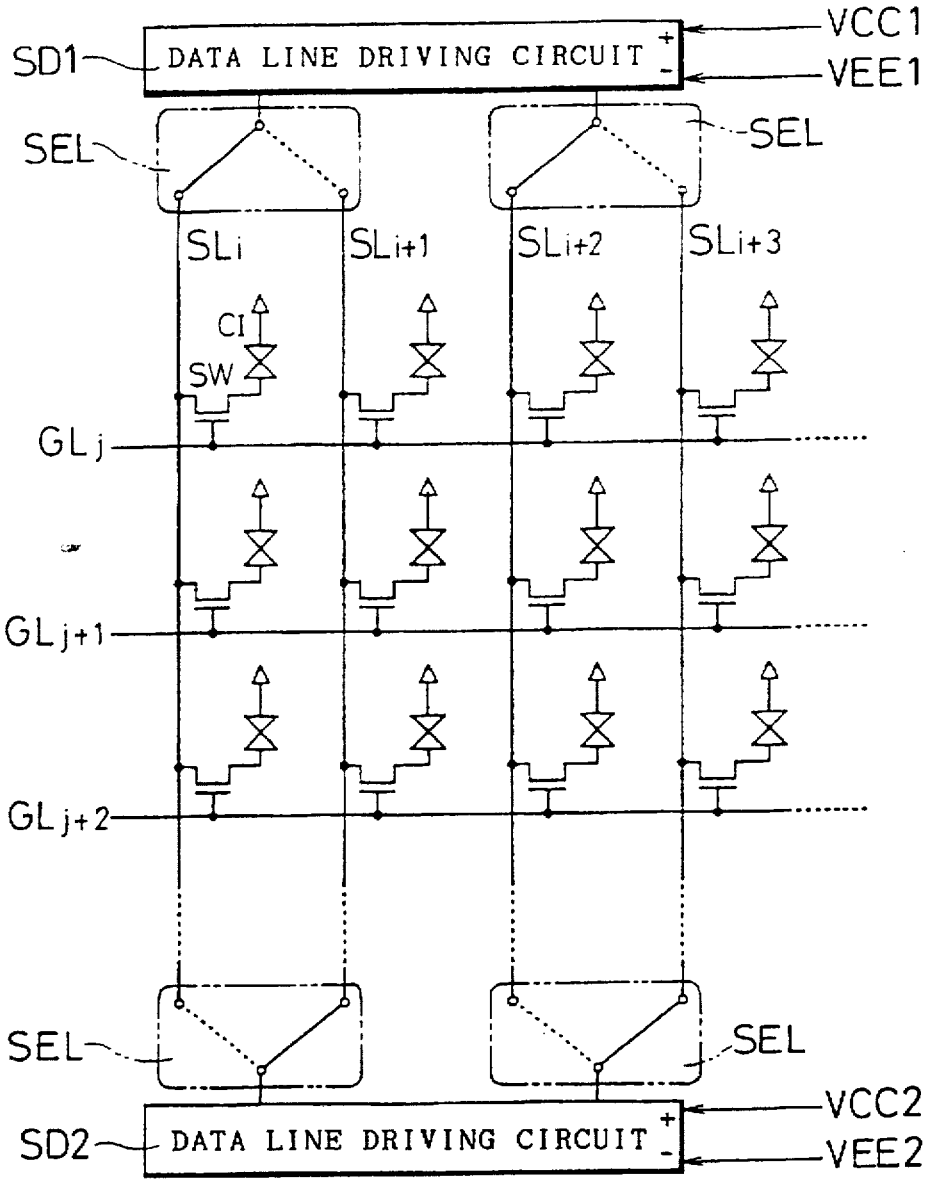
FIG. 17 is a diagram showing a fourth example of a pixel array unit in the image display device according to Example 3 of the invention.

FIG. 17 is a diagram showing a further example of the image display device in this embodiment. In FIG. 17, pixels are disposed in a matrix form, and one data signal line SLm is laid down in every pixel column, and one scanning signal line GLn in every pixel row. In the data signal line SLm, positive polarity data and negative polarity data are alternately written, and data are supplied to the data signal lines SLm from two data line driving circuits SD1 and SD2 differing in the operating power supply level. Further the changeover of power supply level VCC1/VEE1 and VCC2/VEE2 of the data signal line in every field period is effected by the switching circuit SEL which utilizes vertical synchronous signal of image data or the like and which is installed between the data signal line SLm and two data line driving circuits SD1 and SD2, which is presented for display.

In the constitutions shown in FIG. 16 and FIG. 17, auxiliary capacitance Cs is not shown, but it may be added as required.

These two embodiments are driven in "frame+source line drive" and, are the same as in the constitution in FIG. 5, where data of the same polarity is written in one data signal line SLm in each field period, and therefore the charge and discharge current in data signal line is suppressed.

Figure 18:
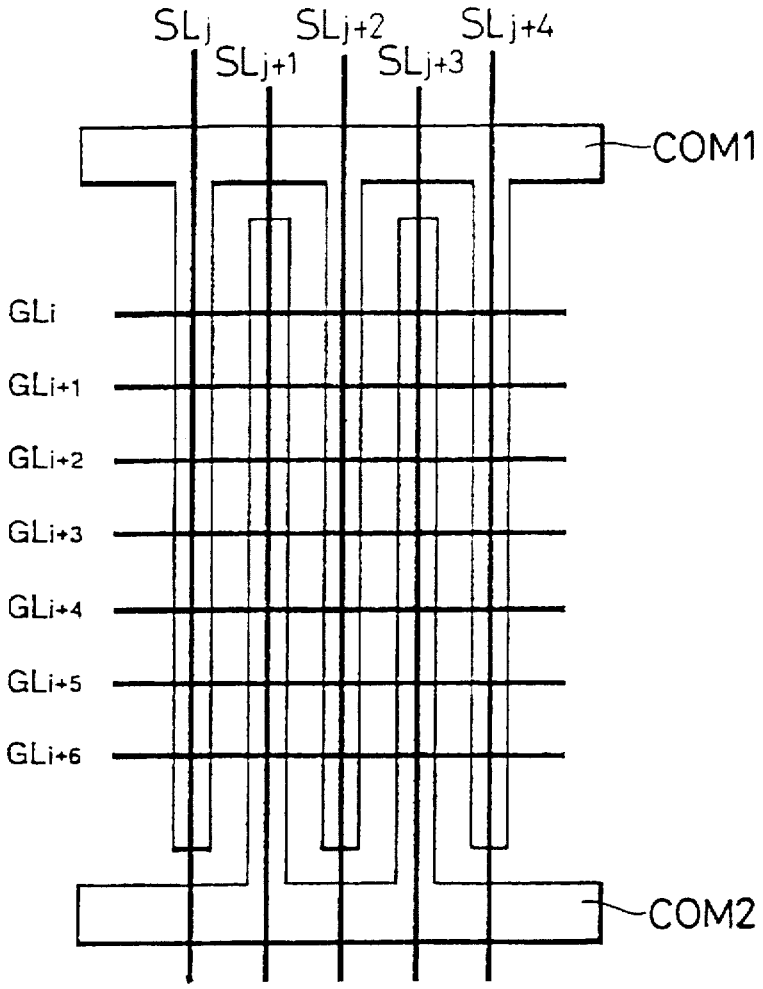
FIG. 18 is a diagram showing divisions of the common counter electrode in the examples shown in FIG. 17 and FIG. 18.

Besides, since the above constitution is in "frame+source line inversion" drive, unlike "frame+gate line inversion" drive, AC driving of common counter electrode cannot basically be effected. However, as shown in FIG. 18, the same effects can be obtained by dividing the common counter electrode in every pixel column, connecting mutually, and inverting and driving these two common counter electrodes COM1 and COM2 in every field. At this time, the power consumption due to driving of common counter electrodes COM1 and COM2 occurs. However since the amplitude of the data signal line SLm can be reduced, the power consumption may be saved on the whole.

Figure 19:
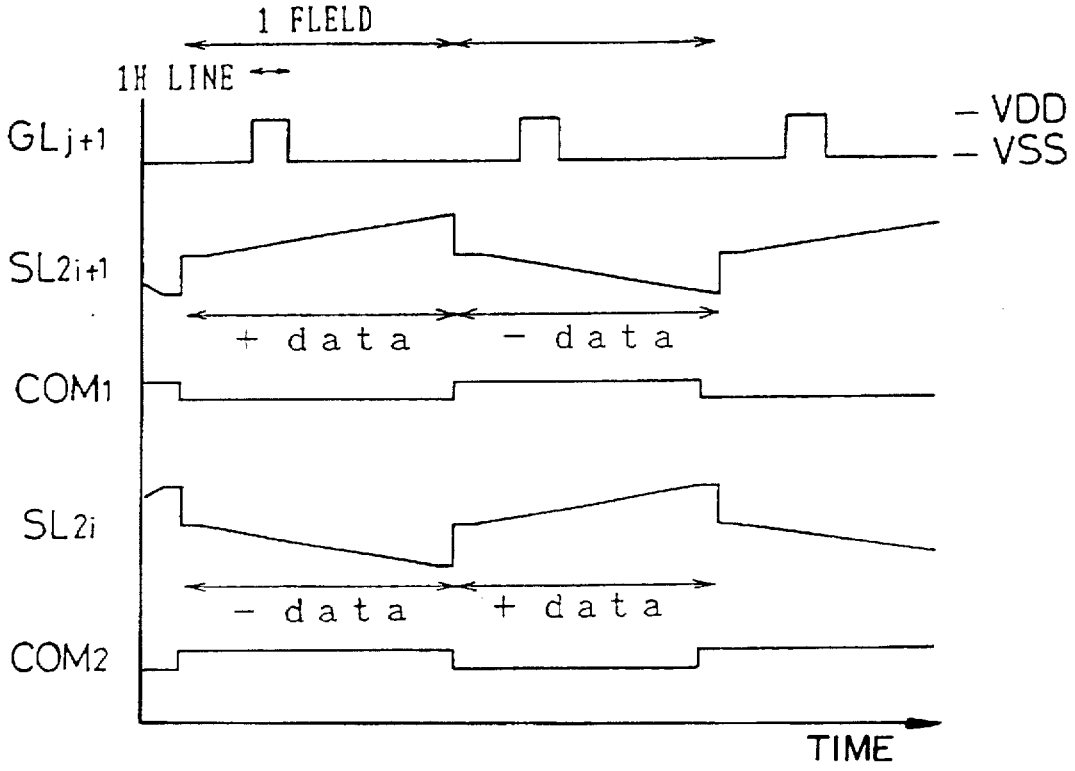
FIG. 19 is a diagram showing a drive method as shown in FIG. 18.

More specifically, as shown in FIG. 19, the device is driven so that a signal with the negative polarity is applied to the corresponding common counter electrode and common electrode line (in parallel with the data signal line) during the period when a video signal with the positive polarity is written in the data signal line SL, and on the other hand a signal with the positive polarity is applied to the corresponding common counter electrode and common electrode line during the period when a video signal with the negative polarity is written in the data signal line SL.

The counter electrode driving circuit comprises a logic whose output is inverted by a synchronizing signal and a buffer circuit which amplifies the amplitude of the outputted signal.

Each embodiment may also be applied in the liquid crystal display device forming the pixel array, scanning line driving circuit and data line driving circuit separately on substrates. Further it may also be applied in the liquid crystal display device of driving circuit integrated type forming one or both of the driving circuits on the same substrate as does the pixel array.

As a substrate, a single crystalline or polycrystalline silicon thin film formed on a transparent substrate may be used, and, in this case, the high mobility of the single crystalline or polycrystalline silicon thin film transistor is effective for realizing the driving circuits in the examples of the invention. Moreover since it does not possess substrate potential, the feature of the thin film transistor capable of freely changing the level of the power supply (DC) can be utilized to the full extent.

In each embodiment plural supply voltages, fed in the driving circuits may be constituted on the same substrate as are the driving circuits.

Although the foregoing description relates to the method of saving the power consumption, and the embodiments explained herein are only basic ones, the above embodiments described in the Examples may be modified or combined as required.

EXAMPLE 4

A still further embodiment of the invention is described below by reference to FIG. 20 through FIG. 31.

Figure 20:
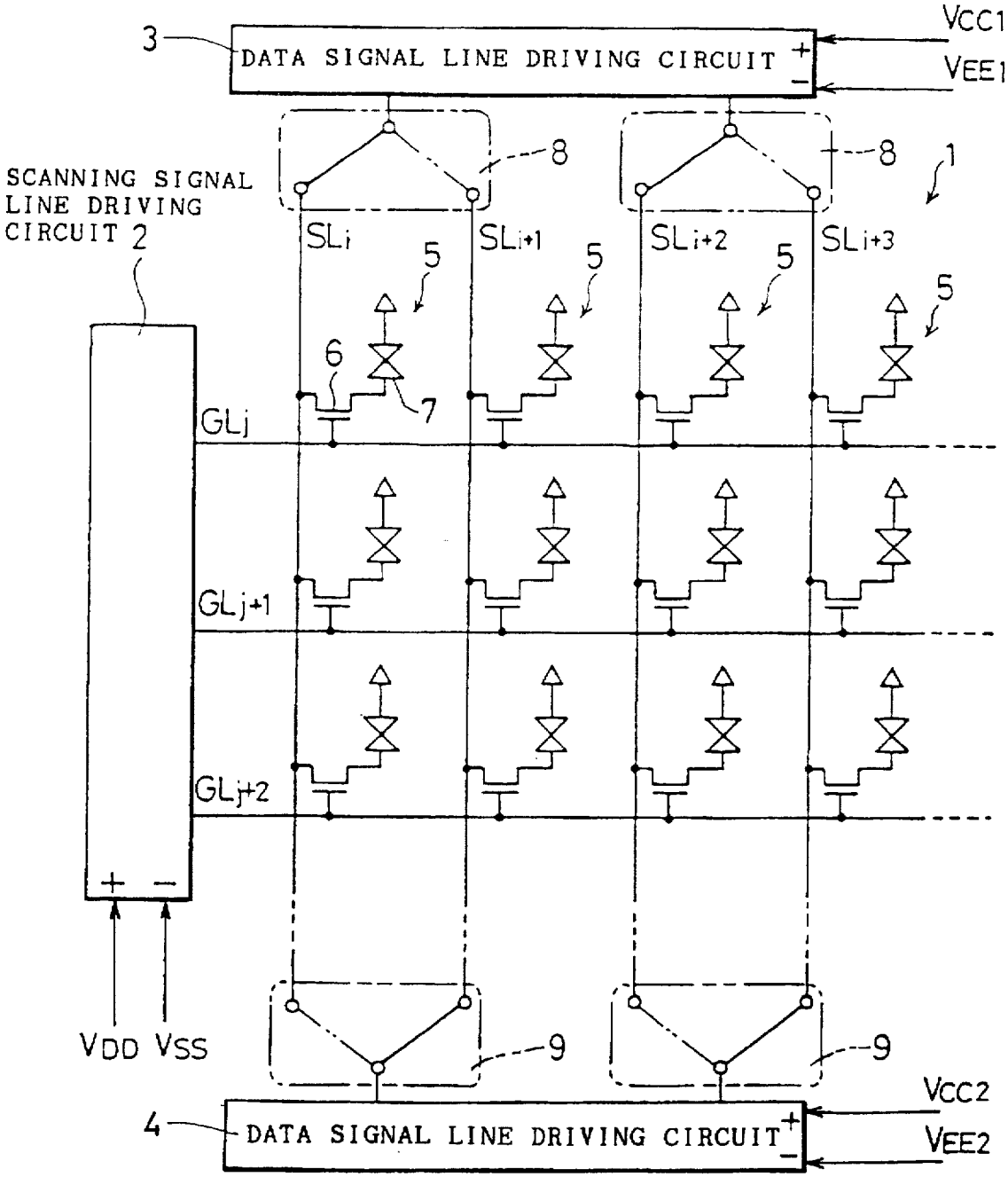
FIG. 20 is a block diagram showing the constitution of essential parts of an image display device according to Example 4 or Example 5 of the invention.

Image display device of an the embodiment is a liquid crystal display device of an active matrix driving system, and it comprises, as shown in FIG. 20, a pixel array 1, a scanning signal line driving circuit 2, and data signal line driving circuits 3, 4. In the pixel array 1, multiple scanning signal lines GLj, GLj+1, . . . , and multiple data signal lines SLi, SLi+1, . . . are disposed, intersecting vertically. In a region enclosed by adjoining scanning signal lines GL, data signal lines SL adjacent to GL, and SL, one pixel 5 is disposed each, and pixels 5 are disposed in a matrix form on the whole.

The pixel 5 comprises a switching element 6 and a pixel capacitance 7. The switching element 6 is composed of, for example, as MOS type FET, of which the gate is connected to the scanning signal line GL (GLj, GLj+1, . . . ). The pixel capacitance 7 is composed of liquid crystal capacitance as liquid crystal element and auxiliary capacity (not shown), as in the liquid crystal capacitance explained in the prior art (see FIG. 4 (*b*)). That is, the pixel 5 is composed in a manner similar to the pixel in the conventional image display device, and it operates similarly.

The data signal line driving circuits 3, 4 are disposed at both sides across the pixel array 1, and one end and the other end of data signal lines SLi, SLi+1, . . . , are connected with each other through analog switches 8 . . . , 9 . . . . In the data signal line driving circuit 3, VCC1 is provided as positive voltage and VEE1 as negative voltage, and in the data signal line driving circuit 4, VCC2 is provided as positive voltage and VEE2 as negative voltage.

The supply voltages VCC1, VEE1, VCC2, VEE2 are set in the magnitude order of VEE2<VCC2<VEE1<VCC1. Meanwhile, supposing the threshold voltage of liquid crystal to be VT, saturation voltage of liquid crystal to be VS, and threshold voltage of analog switches 8, 9 to be Vth, the supply voltages VCC1, VEE1, VCC2, VEE2 are expressed as follows.

$$VCC1=VS+Vth+VON$$

$$VEE1=VT+Vth+VOFF$$

$$VCC2=-VT+Vth+VON$$

$$VEE2=-VS+Vth+VOFF$$

where VON, VOFF are ON margin and OFF margin of analog switches 8, 9, respectively.

The data signal line driving circuits 3, 4 operate on a "frame+source line inversion" driving system. More specifically, the data signal line driving circuit 3 outputs a positive video signal when the applied voltage (supply voltage) to the gate circuit used in sampling circuits 13 to 15, 17, etc. mentioned below is supply voltage VCC1, VEE1. On the other hand, similarly, the data signal line drive circuit 4 outputs a negative video signal when the applied voltage (supply voltage) to the gate circuit is supply voltage VCC2, VEE2. That is, the data signal line driving circuits 3, 4 differ in the operating voltage range of the gate circuit, and hence take in video signals in different ranges to apply them to the data signal lines SLi, SLi+1, . . . .

The data signal line driving circuits 3, 4 are not limited to the panel sample-and-hold system, but may be of driver sample-and-hold system, or digital driving system. In the panel sample-and-hold system, the sampled video signal is directly transferred to the data signal lines SLi, SLi+1, . . . , and in the driver sample-and-hold system, the sampled video signal is once transferred to a data memory, and is amplified in an amplifier and written into the data signal line. In the digital driving system, one of the power supplies for outputting plural discrete voltages is selectively connected to the data signal line by the digital video signal, and the video signal is written.

Figure 21:
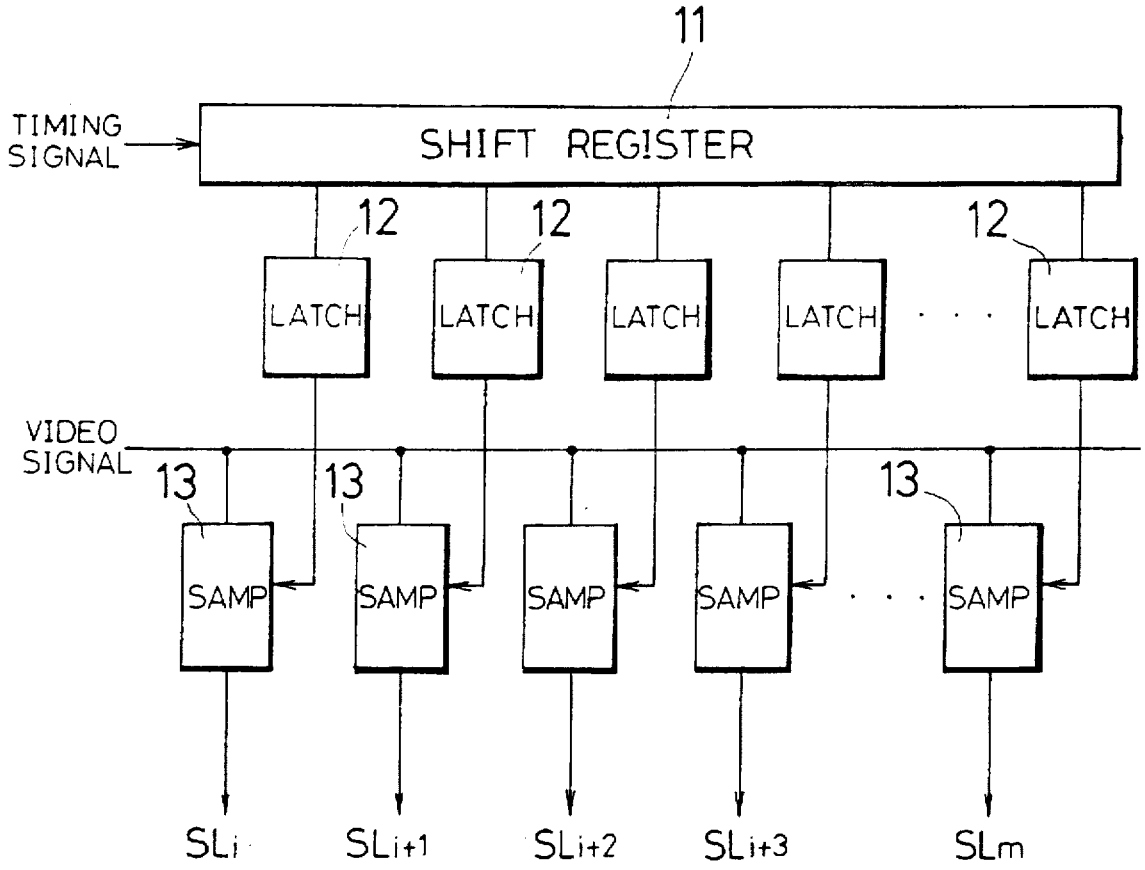
FIG. 21 is a block diagram showing the constitution of a data signal line driving circuit of a panel sample-and-hold system in the image display device of FIG. 20.

The data signal line driving circuit of panel sample-and-hold system comprises, as shown in FIG. 21, a shift register 11, latch circuits 12, . . . , and sampling circuits 13, . . . . The shift register 11 outputs a shift pulse by shifting a start pulse, (not shown in the figures), in synchronism with rise or fall of a timing signal. The sampling circuit 13 as sampling means is a switch circuit for opening and closing in synchronism with the shift pulse through the latch circuit 12, and is designed to apply a video signal to the data signal lines SLi, SLi+1, . . . when closed by the shift pulse.

Figure 22:
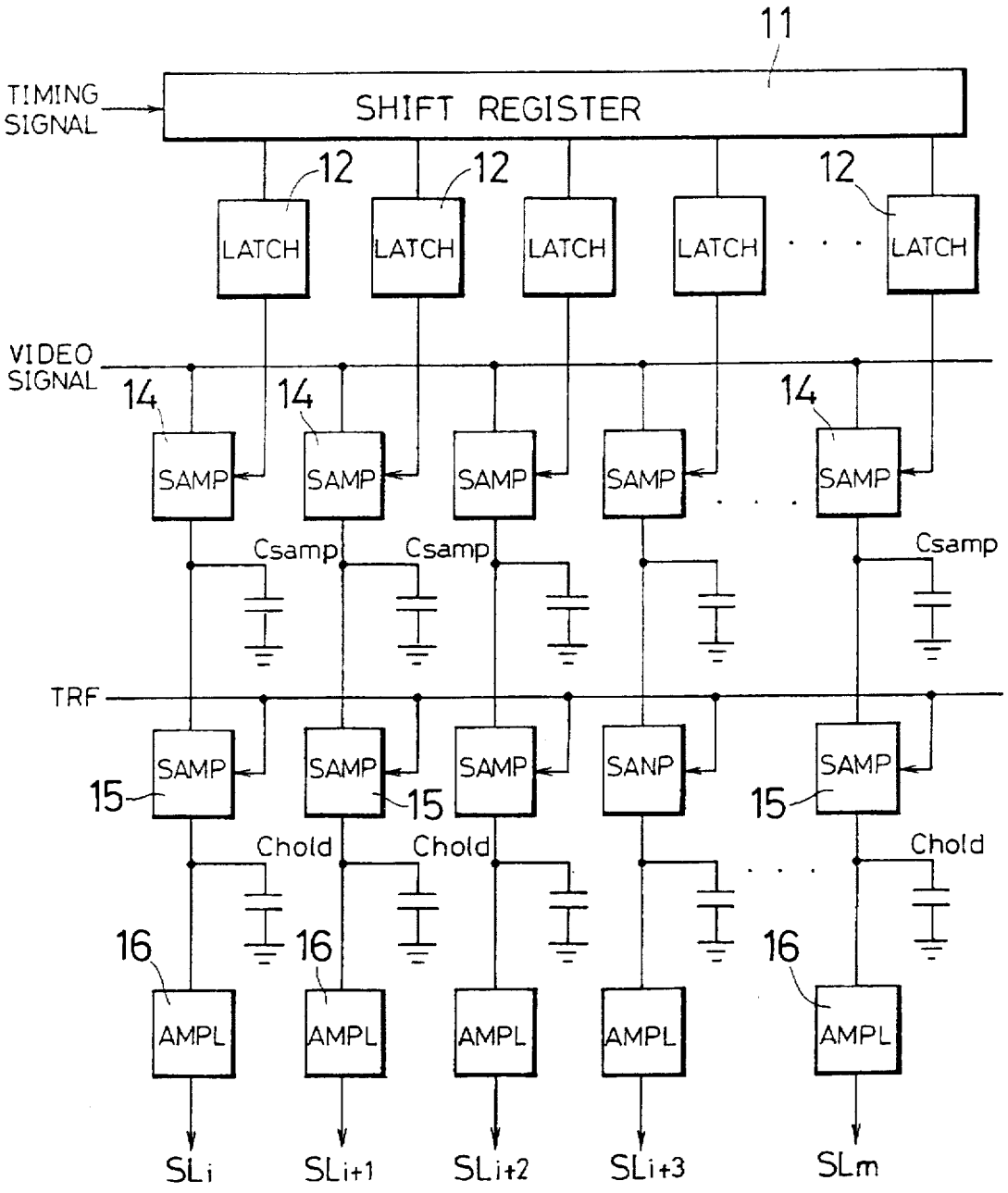
FIG. 22 is a block diagram showing the constitution of a data signal line driving circuit of a driver sample-and-hold system in the image display device of FIG. 20.

The data signal line driving circuit of a driver sample-and-hold system comprises, as shown in FIG. 22, a shift register 11, latch circuits 12, . . . , sampling circuits 14, . . . 15 . . . , sampling capacities Csamp, . . . , hold capacities Chold, . . . , and amplifiers 16, . . . .

Sampling circuits 14, 15 as sampling means composed of analog switches are connected in series, and the sampling circuit 14 opens and closes in synchronism with the shift pulse passing through the latch circuit 12, and the sampling circuit 15 opens and closes in synchronism with the data transfer signal TRF.

The sampling capacitance Csamp as holding means is in the output stage of the sampling circuit 14, and is designed to preserve the data (video signals) sampled by the sampling circuit 14. The hold capacitance Chold as holding means is provided in the output stage of the sampling circuit 15, and is designed to preserve the data (video signals) transferred from the sampling capacitance Csamp by means of the sampling circuit 15. The amplifier 16 as the amplifying means is provided in the further later stage of the hold capacitance Chold.

Figure 23:
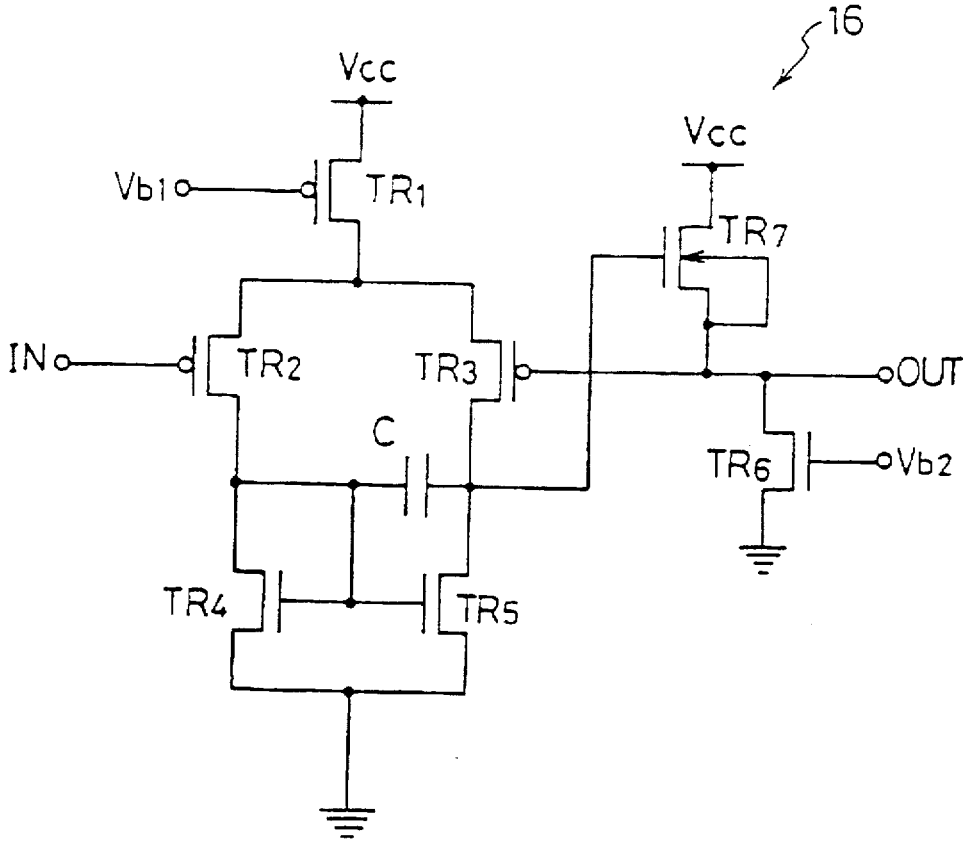
FIG. 23 is a circuit diagram showing the constitution of an amplifier in the data signal line driving circuit of FIG. 22.

The amplifier 16 comprises, as shown in FIG. 23, transistors TR1 to TR7, and a capacitor C, and constant voltages Vb1, Vb2 for bias are applied to the gates of the transistor TR1, TR6. This amplifier 16 is a buffer amplifier having a symmetrical circuit composed of p-channel MOS transistors, transistors TR2, TR3, and n-channel MOS transistors, transistors TR4, TR5, in the front stage, and a source follower composed of an n-type MOS transistor, transistor TR7, in the later stage.

Figure 24:
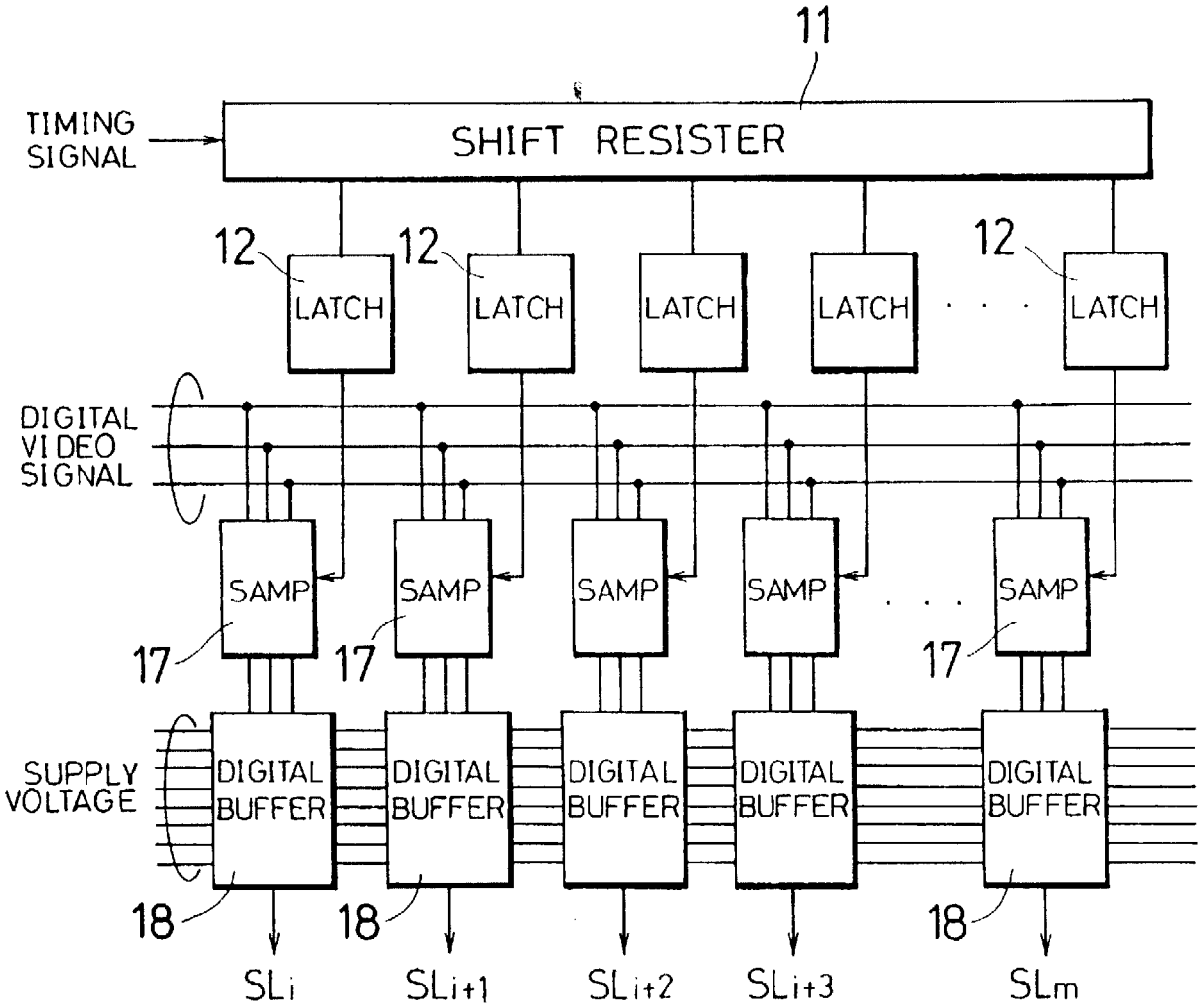
FIG. 24 is a block diagram showing the constitution of a data signal line driving circuit of the digital driving system in the image display device in FIG. 20.

The data signal line driving circuit of the digital driving system comprises, as shown in FIG. 24, shift registers 11, . . . , latch circuits 12, . . . , sampling circuits 17, . . . , and digital buffers 18, . . . . The sampling circuit 17 as sampling means is designed to open and close the digital video signal in synchronism with the shift pulse through the latch circuit 12.

Figure 25:
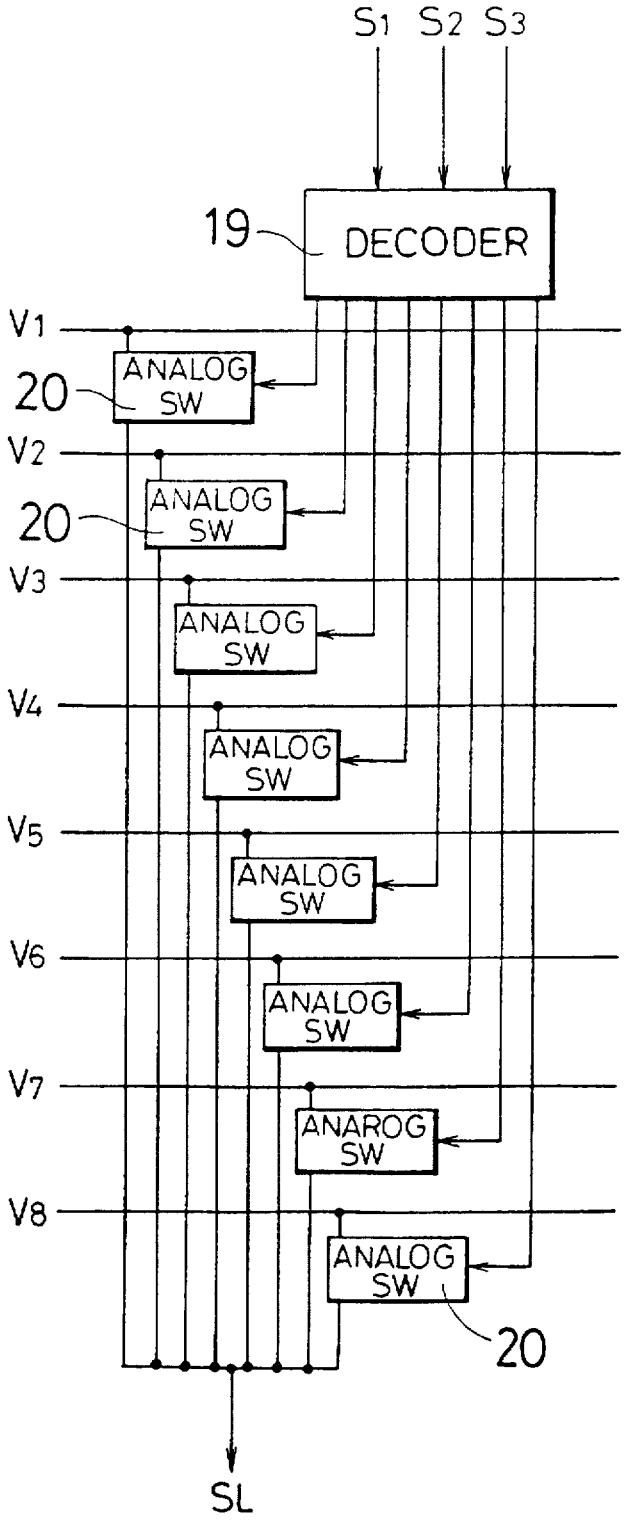
FIG. 25 is a block diagram showing the constitution of a digital buffer in the data signal line driving circuit of FIG. 24.

The digital buffer 18 comprises, as shown in FIG. 25, a decoder 19 and analog switches 20, . . . . The decoder 19 is designed to generate eight selection signals by combination of bits S1 to S3 of digital video signal sampled by the sampling circuit 17. The analog switches 20, . . . as selecting means are intended to select one of discrete voltages V1 to V8 outputted from voltage sources (not shown herein), and apply it to the data signal line SL. The voltages V1 to V8 are set at values corresponding to the levels so that the liquid crystal transmittance (see FIG. 31) may have eight levels at equal intervals.

The analog switches 8, 9 are selectively connected by changing over one of the two neighboring data signal lines, SL (odd-number column), SL (even-number column) between conduction and non-conduction in every field on the basis of the external signal, in response to the output of the data signal line driving circuits 3, 4. These analog switches 8, 9 are designed to select always mutually different data signal lines SL.

Figure 26:
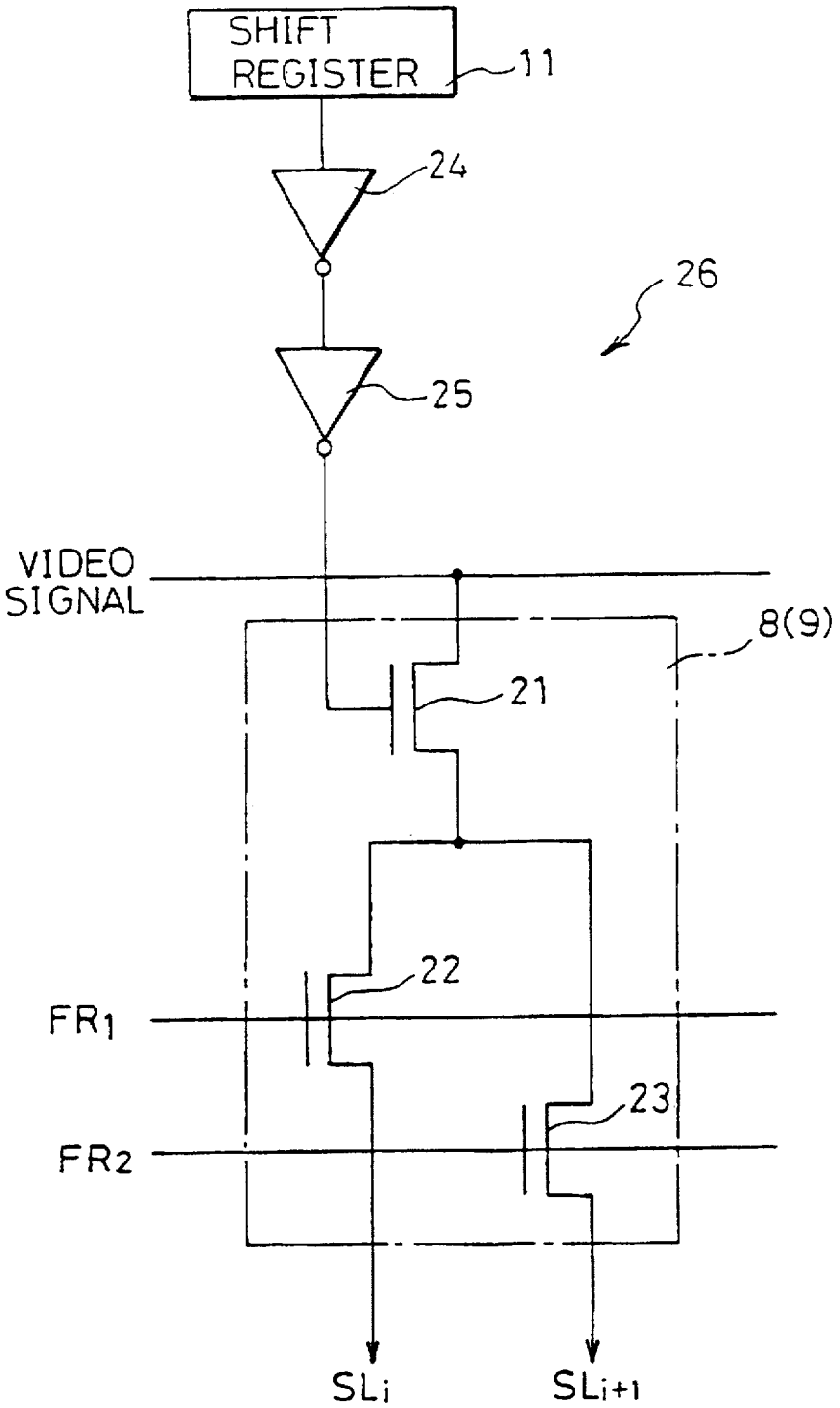
FIG. 26 is a circuit diagram showing the constitution of a selection circuit applied in the panel sample-and-hold system in the image display device according to Example 4 of the invention.
Figure 29:
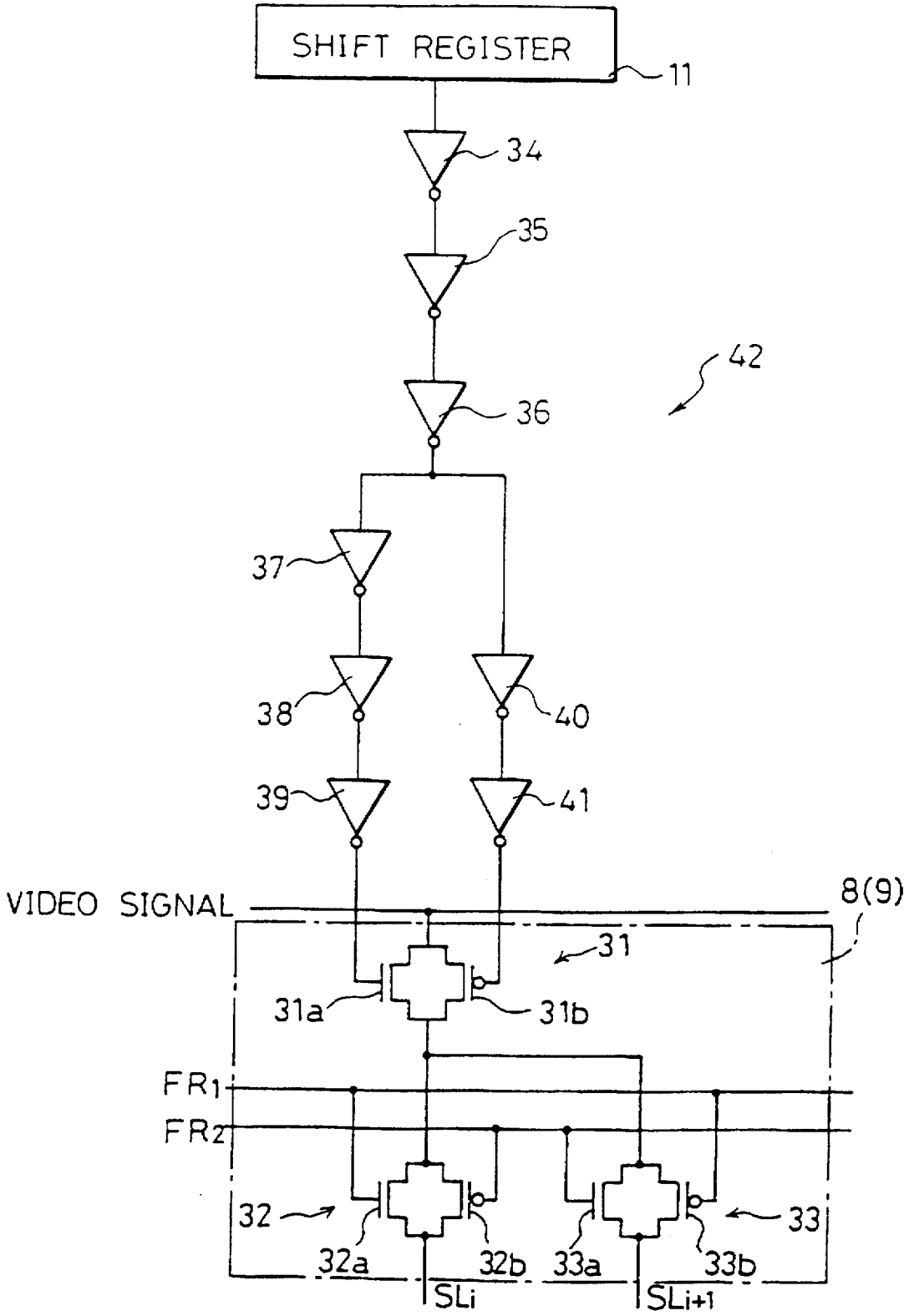
FIG. 29 is a diagram showing the constitution of another selection circuit in the image display device according to Example 4 of the invention.

More specifically, the analog switches 8, 9 are part of selection circuits 26, 42 as shown in FIG. 26 or FIG. 29. These analog switches 8, 9 can be applied to data signal line driving circuits 3, 4 of the panel sample-and-hold system, driver sample-and-hold system, and digital driving system.

As shown in FIG. 26, the selection circuit 26 as exchange means is composed of analog switch 8 (9), shift register 11, and inverters 24, 25.

The analog switch 8 (9) is composed of n-channel transistors 21 to 23. The n-channel transistor 21 as the first switching element tares in the video signal when conducting. The n-channel transistors 22, 23 as the second switching elements repeat conduction and non-conduction alternately as the state is inverted in every field and mutually different field changeover signals FR1, FR2 are applied to the gate. Accordingly, the n-channel transistors 22, 23 apply the video signals from the n-channel transistor 21, on the basis of the field changeover signals FR1, FR2, alternately either to the data signal lines SLi, SLi+2, . . . (odd-number column), or to data signal lines SLi+1, SLi+3, . . . (even-number column).

Inverters 24, 25 are connected in series, and are provided in the data signal line driving circuits 3, 4 together with the shift register 11. These inverters 24, 25 increase the fan-out capacity of the output of the shift register 11, and apply the shift pulse from the shift register 11 to the gate of the n-channel transistor 21 as control signal.

Figure 27A:
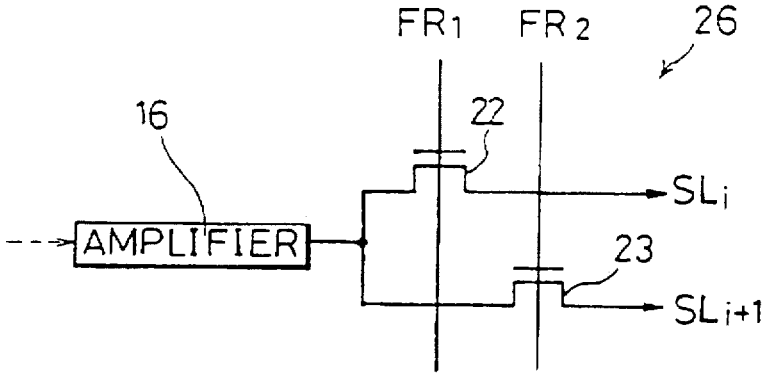
FIGS. 27A, 27B are circuit diagrams showing two examples applied in the driver sample-and-hold system, being a selection circuit of the same type as the selection circuit in FIG. 26.
Figure 27B:
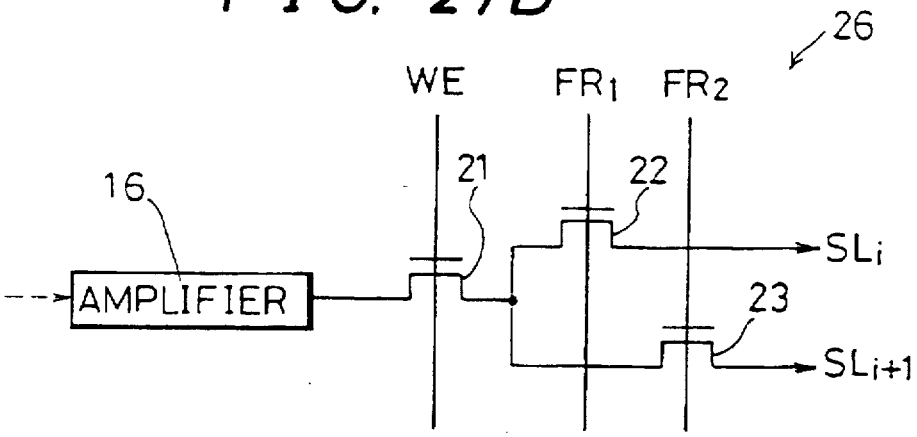
Figure 28:
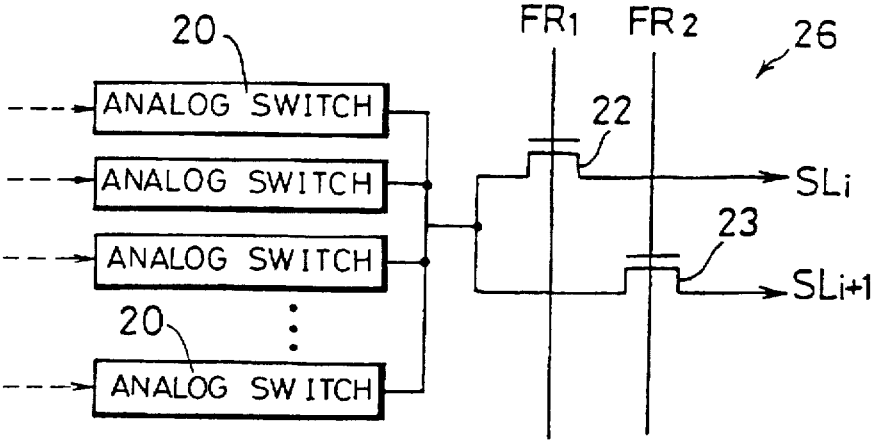
FIG. 28 is a circuit diagram showing the constitution applied in the digital driving system, being a selection circuit of the same type as the selection circuit in FIG. 26.

When the selection circuit 26 is applied in the driver sample-and-hold system, instead of having been in the panel sample-and-hold system circuit as in the constitution described above, n-channel transistors 21, 22, 23 are provided in the later stage of the amplifier 16 as shown in FIG. 27A or B. In FIG. 27B, meanwhile, WE (Write Enable) is a write period specified signal. If the selection circuit 26 is applied in the digital driving system, as shown in FIG. 28, n-channel transistors 22, 23 are provided in the later stage of the analog switches 20, . . . .

On the other hand, as shown in FIG. 29, a selection circuit 42 as exchange means forms a circuit of panel sample-and-hold system, and comprises analog switch 8 (9), shift register 11, and inverters 34 to 41.

The analog switch 8 (9) is composed of CMOS transistors 31 to 33 known as transmission gate. The CMOS transistor 31 as the first switching element is composed of parallel connection of n-channel transistor 31*a* and p-channel transistor 31*b*, is designed to take in the video signal, and send it into the CMOS transistors 32, 33 as the second switching elements.

In the CMOS transistor 32, a field changeover signal FR1 is inputted in the gate of n-channel transistor 32*a*, and a field changeover signal FR2 is inputted in the gate of the p-channel transistor 32*b*. In the CMOS transistor 33, the field changeover signals FR1, FR2 inputted in the gates of the n-channel transistor 33*a* and p-channel transistor 33*b* are reverse to those of the CMOS transistor 32. As a result, the CMOS transistors 32, 33 repeat conduction and non-conduction at different timing.

Inverters 34 to 36 are connected in series, and provided in the data signal line driving circuits 3, 4 together with the shift transistor 11. Inverters 37 to 39 and inverters 40, 41 are provided in paths branched off from the output terminal of the Inverter 36. The output terminal of the inverter 39 is connected to the gate of the n-channel transistor 31*a*, and the output terminal of the inverter 41 is connected to the gate of the p-channel transistor 31*b*. That is, in the signal path to the n-channel transistor 31*a*, even-numbered inverters 34 to 39 are provided, while in the signal path to the p-channel transistor 31*b*, odd-numbered inverters 34 to 36, 40, 41 are provided.

The circuit composed of the inverters 34 to 41 possesses the same function as the inverters 24, 25, and is further designed to give control signals of reverse polarity (gate voltages) to the gate of the n-channel transistor 31*a* and gate of p-channel transistor 31*b*. As a result, the CMOS transistor 31 is simultaneously set in conduction and non-conduction state, and the video signal is taken in by the conduction. The video signal is alternately provided to data signal lines SLi, SLi+1 by the CMOS transistor 32, 33 conducting at different timing on the basis of the field changeover signals FR1, FR2.

In a selection circuit 42, by using the CMOS transistors 31 to 33, video signals of low potential side pass through the n-channel transistors 31*a* to 33*a*, and video signals of high potential side pass through the p-channel transistors 31*b* to 33*b*, so that video signals can be taken in over a wide range from low potential side to high potential side. As a result, video display of high definition is realized.

In the selection circuit 26, after once taking in the signals in the n-channel transistor 21, they are distributed into two systems in the n-channel transistors 22, 23. Therefore, the control of the analog switches 8, 9 at the data signal line driving circuits 3, 4 side is basically effected by controlling only the n-channel transistor 21. To take in the video signals, in the conventional constitution, a switching element such as n-channel transistor 21 was used, and only by newly adding the n-channel transistors 22, 23 to such constitution, the selection circuit 26 can be composed. So is the selection circuit 42.

Changeover of signal polarity in every field by the selection circuits 26, 42 and data signal driving circuits 3, 4 is effected as follows. For example, in a certain display field (data display period), the data signal line SLi is connected to the data signal line driving circuit 3, and data of positive polarity is written, and the adjoining data signal line SLi+1 is connected to the data signal line driving circuit 4, and data of negative polarity is written. In the next display field, the data signal line SLi is connected to the data signal line driving circuit 4, and data of negative polarity is written, and the data signal line SLi+1 is connected to the data signal line driving circuit 3, and data of positive polarity is written.

In this constitution, however, in order to match the display position in every field, a certain display position adjusting circuit (not shown in the figures) is needed. For example, the first output of the data signal line driving circuit 3 is sent out to the data signal line SL1 or data signal line SL2 by the display frame. Therefore, the timing of the first output of the data signal line driving circuit 3 and the first output of the data signal line driving circuit 4 varies in every frame, and the display position must be adjusted accordingly.

Examples of the display position adjusting circuit may include, among others, one-pixel delay circuit provided in the data signal line driving circuits 3, 4, and external delay circuits for delaying the video signals inputted in the data signal line driving circuits 3, 4. It Is also possible to realize this by varying the clock signal or start pulse given to the shift register 11.

Figure 30:
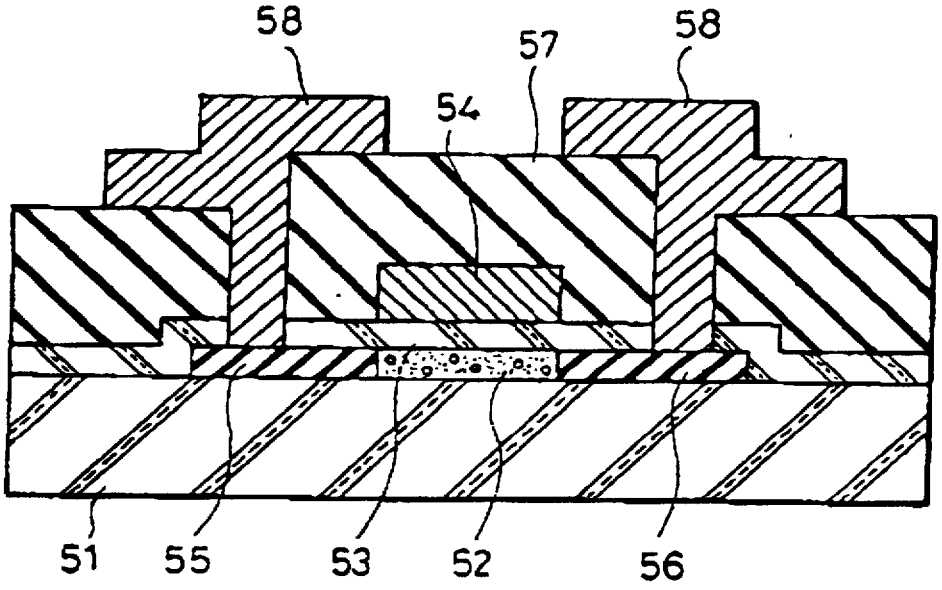
FIG. 30 is a cross sectional diagram showing the structure of a thin film transistor composing the switching element and driving circuit in the image display device of FIG. 20.

As various switching elements in this image display device, silicon thin film transistors as shown in FIG. 30 are used. The silicon thin film transistors are polycrystalline silicon thin film transistors (hereinafter referred to as p-Si thin film transistors), and a metal insulator semiconductor (MIS) field effect transistor is formed on a polycrystalline silicon thin film (p-Si thin film) 52 formed on a glass substrate 51 as insulating substrate.

On the p-Si thin film 52, a gate electrode 54 is formed through a silicon oxide film 53 as gate insulation film, and impurity ions are injected in a region other than the area covered with the gate electrode 52 in the p-Si thin film 52, and a source region 55 and a drain region 56 are formed. Furthermore, to cover the silicon oxide film 53 and gate electrode 54, a silicon nitride film 57 is formed as an interlayer insulation film, and metal wirings 58, 58 are formed to reach from the gaps in the silicon nitride film 57 to the source region 55 and drain region 56, respectively.

As the silicon thin film, the polycrystalline silicon thin film 52 is suited because the driving circuit can be formed integrally, and an inexpensive glass substrate 51 can be used as an insulating substrate owing to low process temperature without being limited to this, the same effects can be expected in the single crystalline silicon thin film or amorphous silicon thin film. As the material for thin film, being not limited to silicon; germanium, alloy of silicon and germanium, and other compound semiconductors (ZnS, etc.) may be used.

The present embodiment is basically driven in "frame+source line inversion" method. Hence, data is written alternately, that is, positive data is written in the data signal lines SLi, SLi+2, . . . , and negative data is written in the data signal lines SLi+1, SLi+3, . . . . Therefore, data of the same polarity is written in one data signal line SLi in each field period, and data of respective polarities are supplied in the data signal lines SLi, SLi+1, . . . by two data signal driving circuits 3, 4 differing in the supply voltage level.

In this embodiment, thus, since display is made by writing of signal of one polarity only, it is enough to supply voltage only in a range not more than the liquid crystal driving voltage (precisely, liquid crystal saturation voltage-liquid crystal threshold voltage), and the output voltage range of the data signal line driving circuits 3, 4 may be narrowed. In this regard, the prior art and the embodiment are compared below.

In the driving system of the prior art, the supply voltages of the data signal line driving circuits 3, 4 required in ON time and OFF time of the analog switches 8, 9 are expressed as follows.

At OFF–VS+Vth–VOFF

At ON+VS+Vth+VON

From these two formulas, the maximum amplitude of the supply voltages is $$2VS+(VOFF+VON) \quad (1)$$

where VT: threshold voltage of liquid crystal

VS: saturation voltage of liquid crystal

Vth: threshold voltage of analog switches 8, 9

VOFF: OFF margin of analog switches 8, 9

VON: ON margin of analog switches 8, 9

On the other hand, the supply voltages in the driving system of the embodiment are expressed as follows.

At OFF+VT+Vth–VOFF (=VEE1)

At ON+VS+Vth+VON (=VCC1)

From these two formulas, the maximum amplitude of the supply voltages is $$VS-VT+(VOFF+VON) \quad (2)$$

For example, in formulas (1) and (2), supposing the threshold voltage of the liquid crystal to be 2 V and the saturation voltage to be 7 V, in the conventional drive method, a range of 14 V was required (or 16 V if both VOFF and VON are 1 V), but in the constitution of the embodiment the range is 5 V (or 7 V if both VOFF and VON are 1 V).

Figure 31:
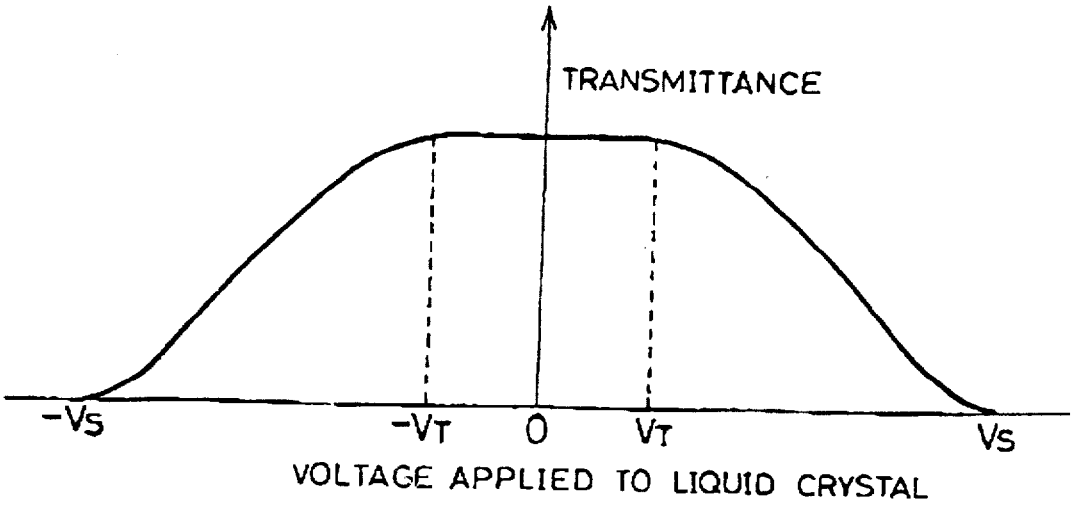
FIG. 31 is a graph showing the relation between the liquid crystal applied voltage and liquid crystal transmittance.

That is, as shown in FIG. 31, in the prior art, it is necessary to apply a voltage to the liquid crystal in a range of −VS to +VS, and the amplitude of the voltage is forced to be wide. In this embodiment, by contrast, it is enough to apply a voltage to the liquid crystal in a range of +VT to +VS at the positive side, and in a range of −VT to −VS at the negative side, and hence the amplitude of voltage is smaller than in the prior art.

In the liquid crystal display device of 5.6 type VGA (480×640×RGB), assuming the threshold voltage of liquid crystal to be 2 V, and saturation voltage to be 7 V, results of obtaining the calculated values (charge and discharge amounts in two field periods) for the worst data (the image data with the largest power consumption) and stepwise data in gate line inversion and source line inversion are shown in the table below. Comparing the respective worst values, in the source line inversion, it was found to be about 36% of the gate line inversion (about 56% in comparison with gate line inversion+common inversion).

TABLE 1

| | High constant | High-low alternate | Stepwise |
|---|---|---|---|
| Gate line inversion | 243 μC | 156 μC | 113 μC |
| Gate line inversion + common inversion | 174 μC | 87.1 μC | 41.4 μC |
| Source line inversion | 0.51 μC | 87.1 μC | 0.51 μC |

Hence, the driving voltage of the data signal line driving circuits 3, 4 can be lowered. As a result, the power consumption of the image display device can be decreased, and the constituent elements can be lowered in the breakdown voltage. In particular, in the image display device (especially the transmission type display device) of driver monolithic constitution (composing the pixel switch and driving circuit on the same substrate) that is being developed recently, since the elements for composing the driving circuit are also thin film transistors, the circuit is lower in breakdown voltage than the elements on the single crystalline semiconductor substrate and thus it can utilize a circuit that can be driven at such low voltage as indicated above.

In the embodiment, one data signal line SL corresponds to one output of the shift register 11, but when sampling RGB signals simultaneously such as when handling color computer images, a plurality of (three in the case of RGB) data signal lines may correspond to one output from the shift register 11.

EXAMPLE 5

A further embodiment of the invention is described below by reference to FIG. 20 and FIGS. 32 to 37. The constituent elements in the embodiment having the same functions as the constituent elements in the second embodiment are identified with the same reference numerals, and their explanations are omitted.

Figure 32:
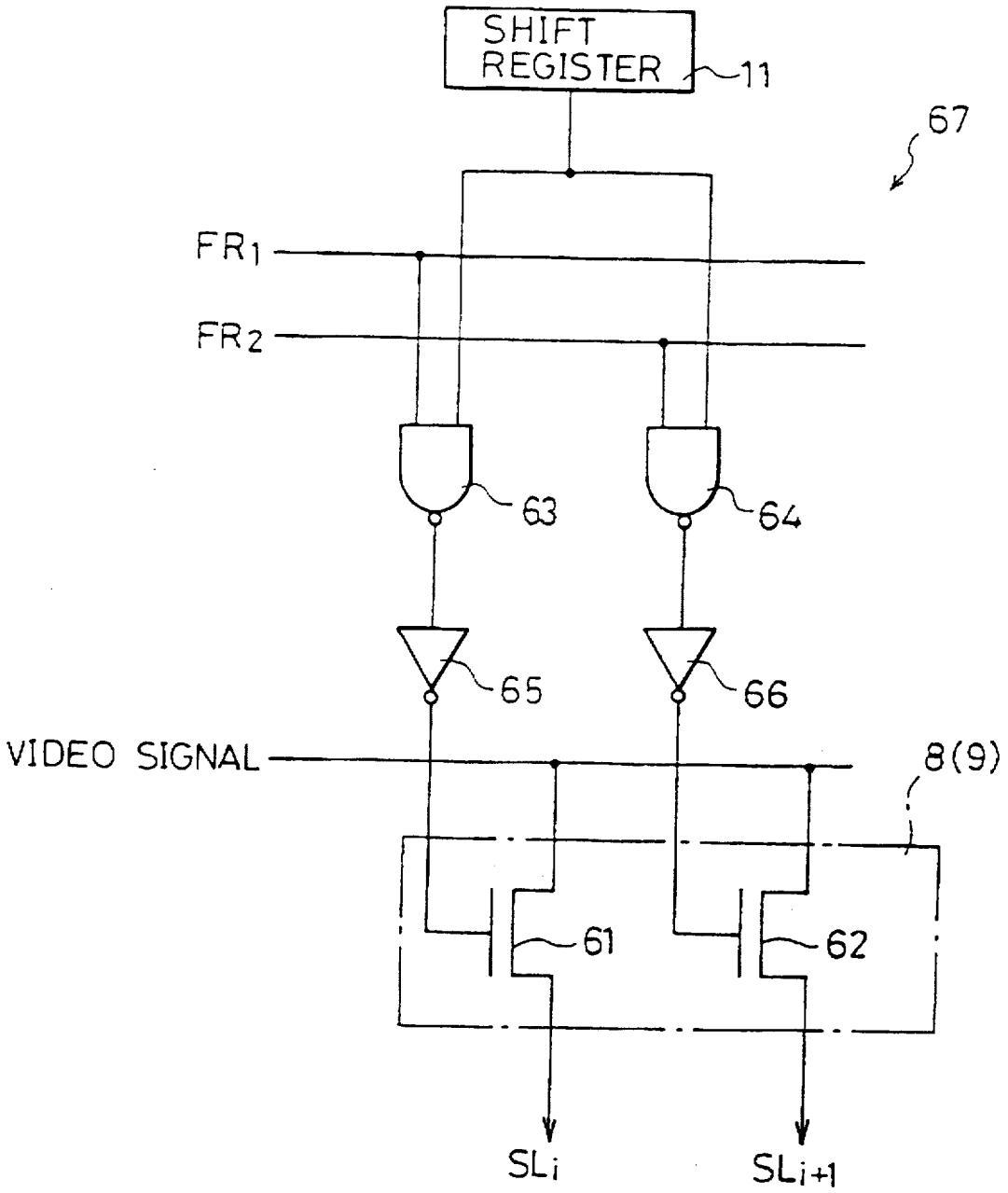
FIG. 32 is a circuit diagram showing an example applied in the panel sample-and-hold system, being a first selection circuit in the image display device according to Example 5 of the invention.
Figure 35:
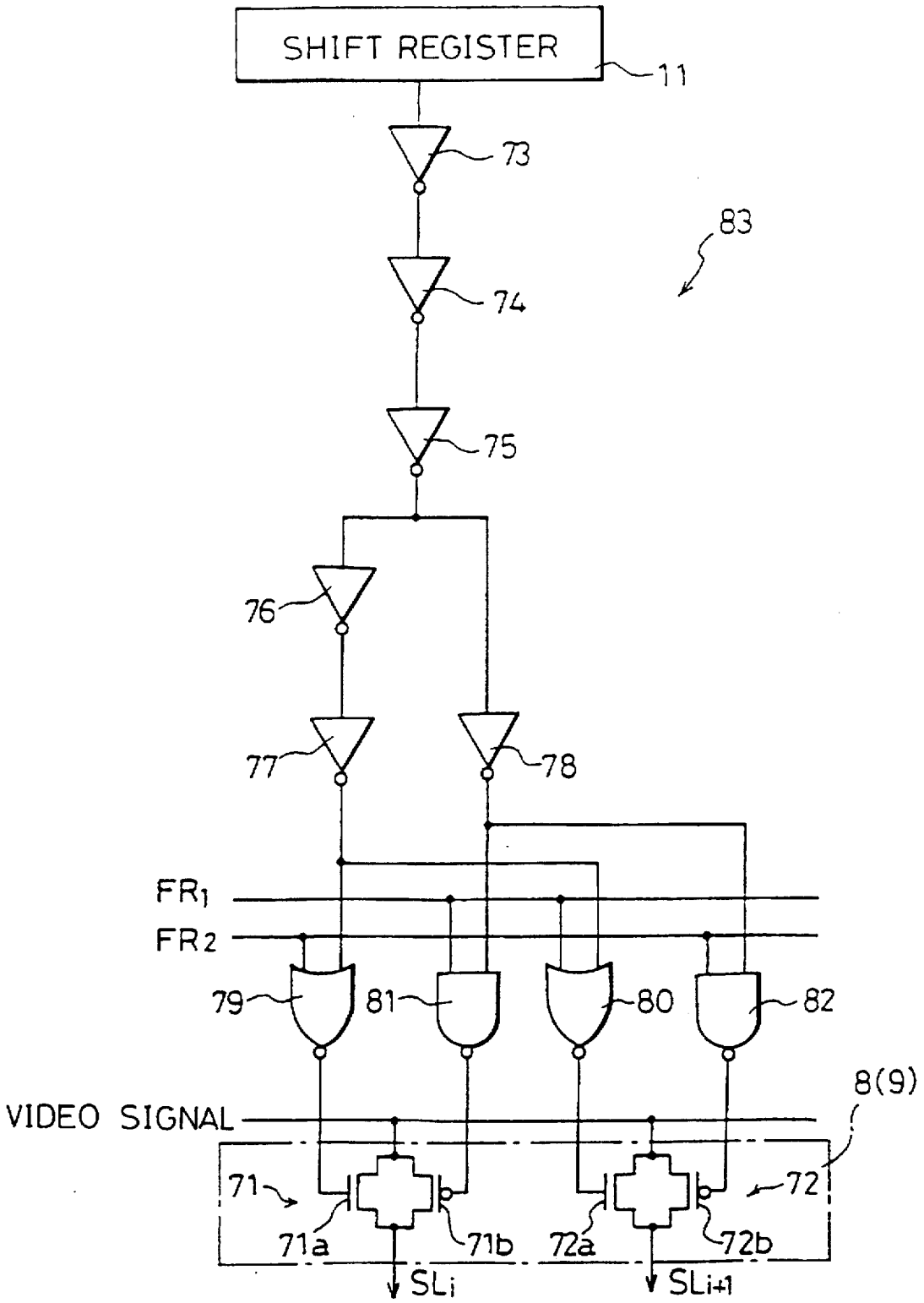
FIG. 35 is a circuit diagram showing the constitution of a second selection circuit in the image display device according to Example 5 of the invention.

In the image display device of the embodiment, the analog switches 8, 9 shown in FIG. 20 are composed as shown in FIG. 32 or FIG. 35. These analog switches are applied to the data signal line driving circuit of the panel sample-and-hold system, but they may be similarly applied to the driver sample-and-hold system and the digital driving system.

As shown in FIG. 32, a selection circuit 67 as exchange means comprises an analog switch 8 (9), a shift register 11, NAND gates 63, 64, and inverters 65, 66.

The analog switch 8 (9) is composed of n-channel transistors 61, 62 as switching elements. The NAND gates 63, 64 and inverters 65, 66 are provided in the data signal line driving circuits 3, 4, and are designed to control the operation of the analog switch 8 (9) on the basis of the shift pulse issued from the shift register 11.

In one input terminal of the NAND gates 63, 64, the shift pulse from the shift register 11 is inputted. In the other input terminal of the NAND gate 63, a field changeover signal FR1 is inputted, and in the other input terminal of the NAND gate 64, a field changeover signal FR2 is inputted. The input terminals of the inverters 65, 66 are connected to the output terminal of the NAND gates 63, 64. On the other hand, in the n-channel transistors 61,62, the output terminals of the inverters 65, 66 are connected to respective gates, and video signals are fed into the sources.

In this constitution, by calculating AND (or OR depending on the number of inverters) of the shift pulse from the shift register 11 and the field changeover signals FR1, FR2 in the gate circuit, only one of the two n-channel transistors 61, 62 is made to conduct. By making such conduction alternately, the video signal is taken in from the n-channel transistors 61, 62, and applied alternately to the data signal lines SLi, SLi+1.

Figure 33:
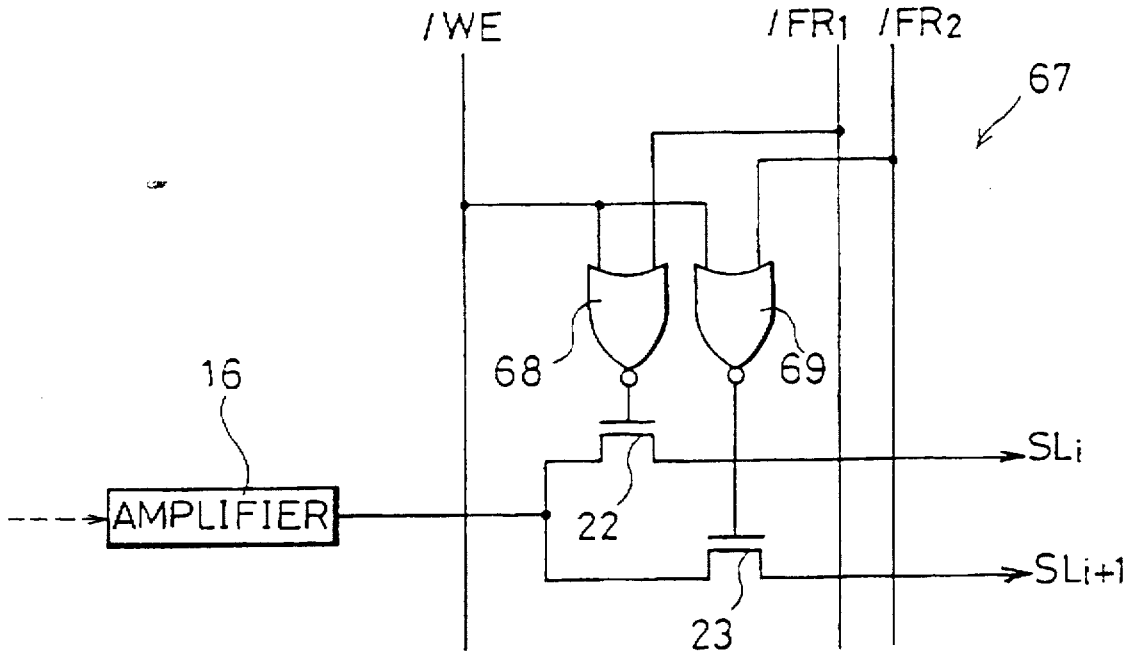
FIG. 33 is a circuit diagram showing an example applied in the driver sample-and-hold system, being the first selection circuit.
Figure 34:
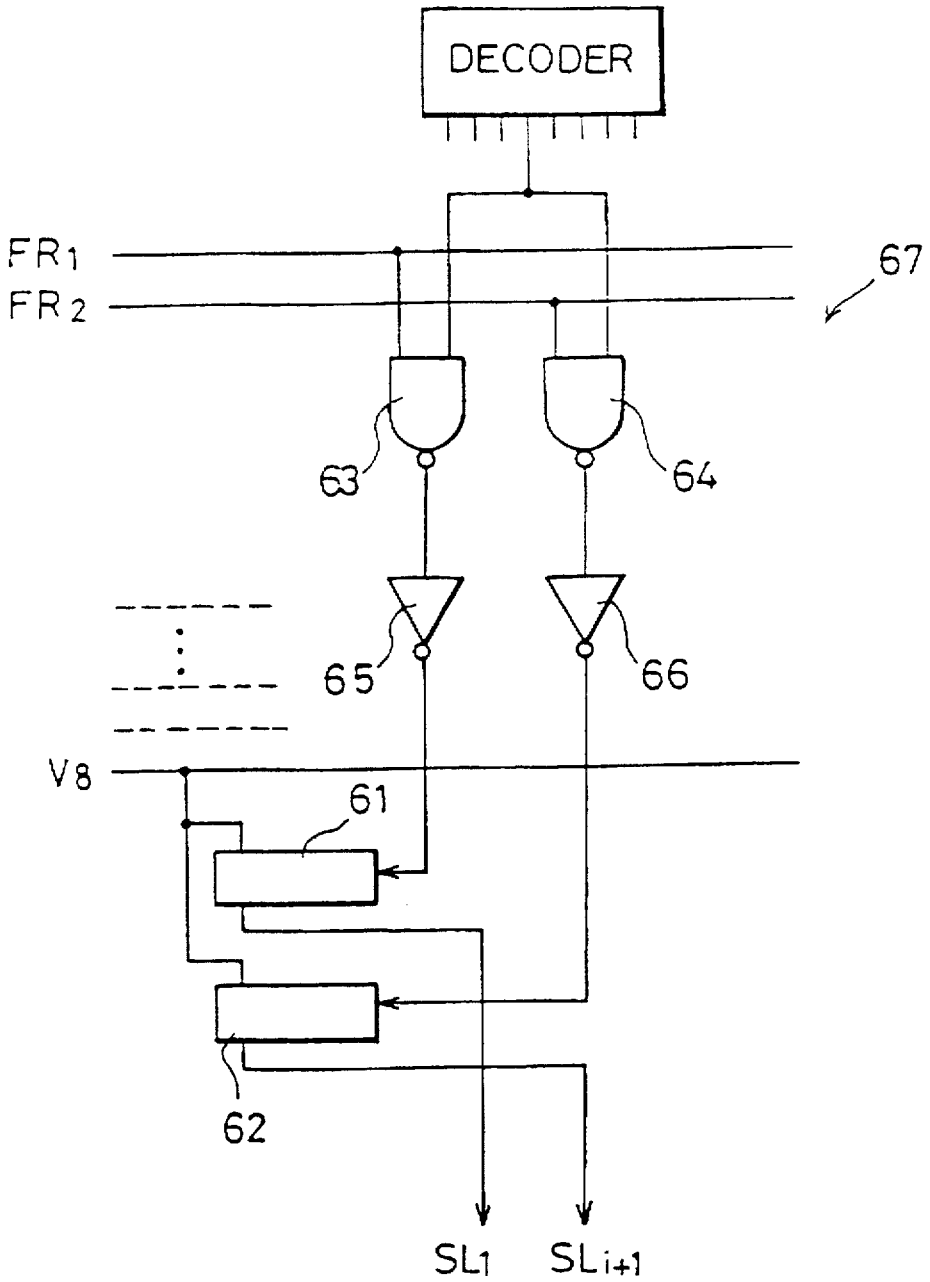
FIG. 34 is a circuit diagram showing an example applied in the digital driving system, being the first selection circuit.

The selection circuit 67 is composed as a circuit of the panel sample-and-hold system, but when applied in the driver sample-and-hold system, as shown in FIG. 33, n-channel transistors 22, 23 are provided in the later stage of the amplifier 16. These n-channel transistors 22, 23 are controlled to be ON or OFF by NOR gates 68, 69 by feeding write period setting signal /WE of negative logic and field changeover signals /FR1, /FR2 of negative logic. When the selection circuit 67 is applied in the digital driving system, as shown in FIG. 34, one output of a decoder 19 is divided into two, and each is fed into NAND gates 63, 64. The analog switches 61, 62 are connected to each power supply line for feeding power supply voltage V1 to V8 so as to serve also as analog switch 8.

As shown in FIG. 35, a selection circuit 83 as exchange means forms a panel sample-and-hold system circuit, and comprises an analog switch 8 (9), a shift register 11, inverters 73 to 78, NOR gates 79, 80 and NAND gates 81, 82. The Inverters 73 to 78, NOR gates 79, 80, and NAND gates 81, 82 are provided in the data signal line driving circuits 3, 4.

The CMOS transistor 71 as a switching element consists of an n-channel transistor 71*a* and a p-channel transistor 71*b* which are connected parallel to each other. The CMOS transistor 72 as a switching element consists of an n-channel transistor 72*a* and a p-channel transistor 72*b* which are connected parallel to each other.

The inverters 73 to 75 are connected In series, and the inverters 76, 77 and the inverter 78 are provided in paths branched off from the output terminal of the inverter 75, respectively. The output terminal of the inverter 77 is connected to one input terminal of the NOR gates 79, 80, and the output terminal of the inverter 78 is connected to one input terminal of the NAND gates 81, 82. The field changeover signal FR1 is fed to the other input terminal of the NOR gate 80 and NAND gate 81, and the changeover signal FR2 is fed to the other input terminal of the NOR gate 79 and NAND gate 82.

In the CMOS transistor 71, the output terminal of the NOR gate 79 is connected to the gate of the n-channel transistor 71*a*, and the output terminal of the NAND gate 81 is connected to the gate of the p-channel transistor 71*b*. On the other hand, in the CMOS transistor 72, the output terminal of the NOR gate 80 is connected to the gate of the n-channel transistor 72*a*, and the output terminal of the NAND gate 82 is connected to the gate of the p-channel transistor 72*b*.

In this constitution, the CMOS transistors 71, 72 are made to conduct alternately on the basis of the output signal of the inverter 77 and the output signal of the inverter 78, and field changeover signals FR1, FR2 to set the NOR gates 79, 80 and NAND gates 81, 82 in reverse polarity. The video signals taken in through the CMOS transistors 71, 72 are provided to data signal lines SLi, SLi+1 alternately in every field at different timing.

In the embodiment, by the operation of the analog switches 8, 9, the adjacent data signal lines SLi, SLi+1 are changed over in every field and connected to the data signal line driving circuits 3, 4 in the same way as in the embodiment In Example 1.

In the selection circuit 67, since the video signals are directly taken in through the n-channel transistors 61, 62, it is necessary to control both transistors 61, 62 individually, and an exclusive control circuit must be composed. However the following advantages are brought about by minimizing the number of switching elements. That is, the switching element that the video signal passes through until written into the data signal lines SLi, SLi+1 is only one n-channel transistor each, 61 and 62, and as compared with the selection circuits 26 in the embodiment in Example 2, the impedance when conducting both transistors 61, 62 can be reduced. The same is true in the case of the selection circuit 83.

Since this embodiment is basically driven in "frame+source line inversion," in the same manner as in the embodiment, in Example 4 data of respective polarities can be supplied to the data signal lines SLi, SLi+1, . . . by two data signal line driving circuits 3, 4 differing in the supply voltage level. Consequently, the output voltage range of the data signal line driving circuits 3, 4 is narrowed, and the driving voltage can be lowered, thereby saving the power consumption and lowering the breakdown voltage of elements.

Figure 36:
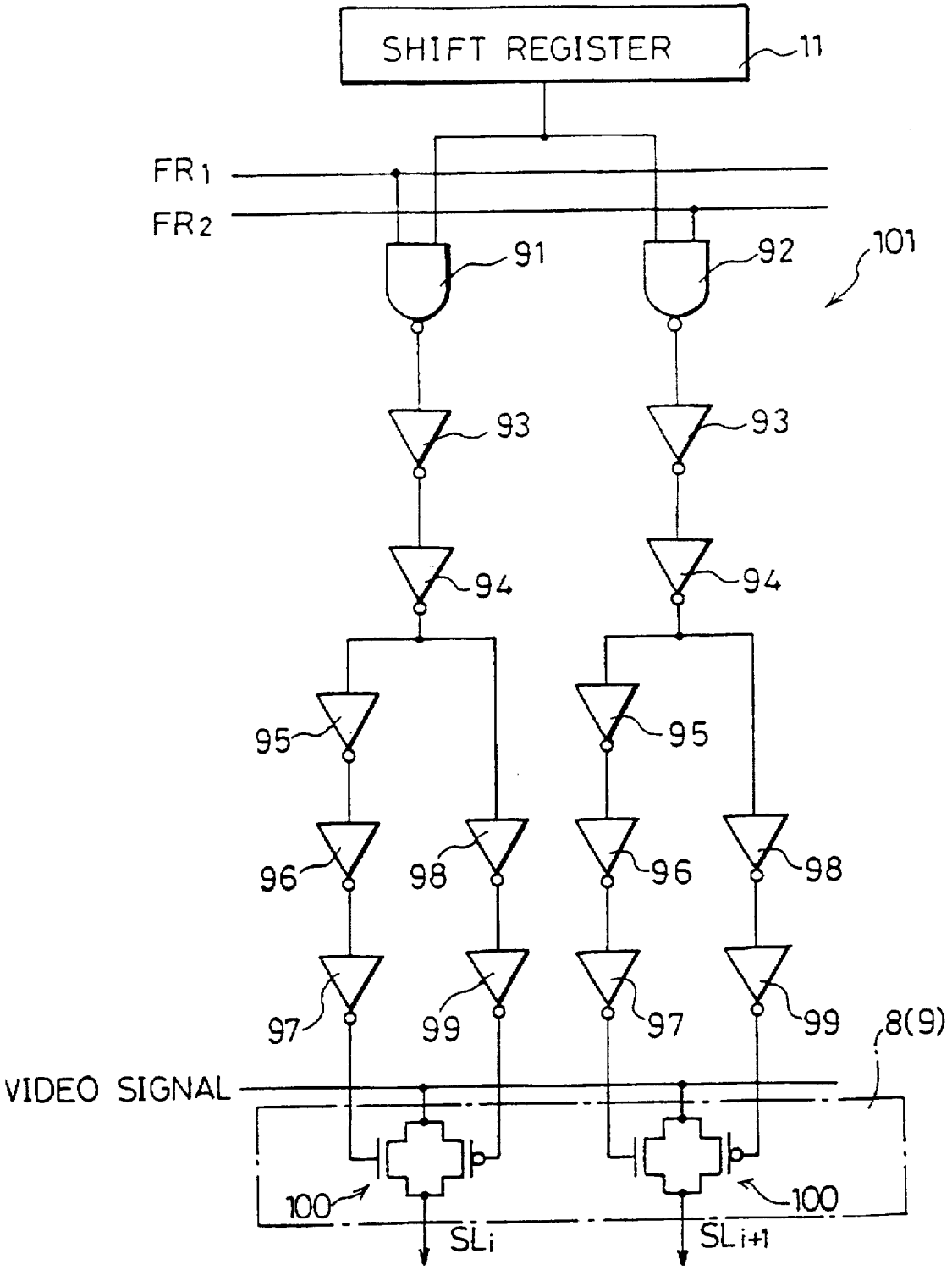
FIG. 36 is a circuit diagram showing the constitution of a third selection circuit in the image display device according to Example 5 of the invention.

In the selection circuit 83 shown in FIG. 35, NOR gates 79, 80 and NAND gates 81, 82 are disposed just before the analog switch 8 (9), and other exchange means may be composed by disposing NAND gates 91, 92 immediately after the shift register 11, such as a selection circuit 101 shown in FIG. 36.

In this constitution, shift pulses from the shift register 11 are fed into one input terminal of NAND gates 91, 92, while field changeover signals FR1, FR2 are fed into other input terminal of NAND gates 91, 92, respectively. In the later stage of the NAND gates 91, 92, inverters are branched 93 to by on the way, which are designed to control CMOS transistors 100, 100.

Figure 37:
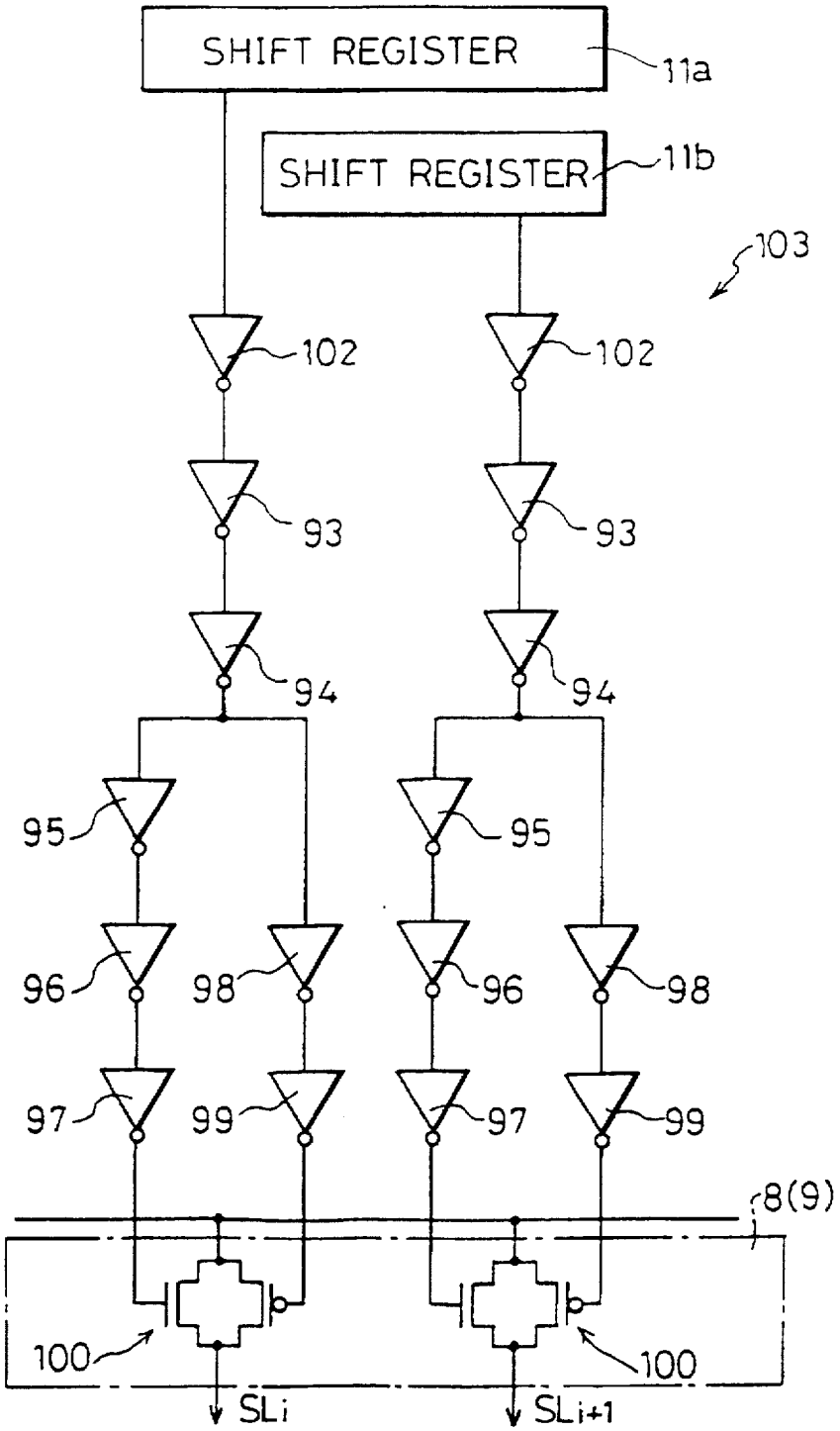
FIG. 37 is a circuit diagram showing the constitution of a fourth selection circuit in the image display device according to Example 5 of the invention.

Moreover, shift registers 11*a*, 11*b* in another system may be provided such as a selection circuit 103 (exchange means) shown in FIG. 37. In this constitution, when inverters 102, 102 are provided instead of the NAND gates 91, 92 and the timing signal or start pulse is prevented from being inputted to the shift register 11*a* of the data signal line SL side separated by the analog switch 8 (9), the field exchange signals FR1, FR2 are not needed.

The image display device of the embodiment also requires the display position adjusting circuit for matching the display position in every field.

EXAMPLE 6

A still further embodiment of the invention is described below by reference to FIG. 38. The constituent elements in the embodiment having the same functions as the constituent elements in the embodiment in Example 2 are identified with the same reference numerals, and their explanations are omitted.

Figure 38:
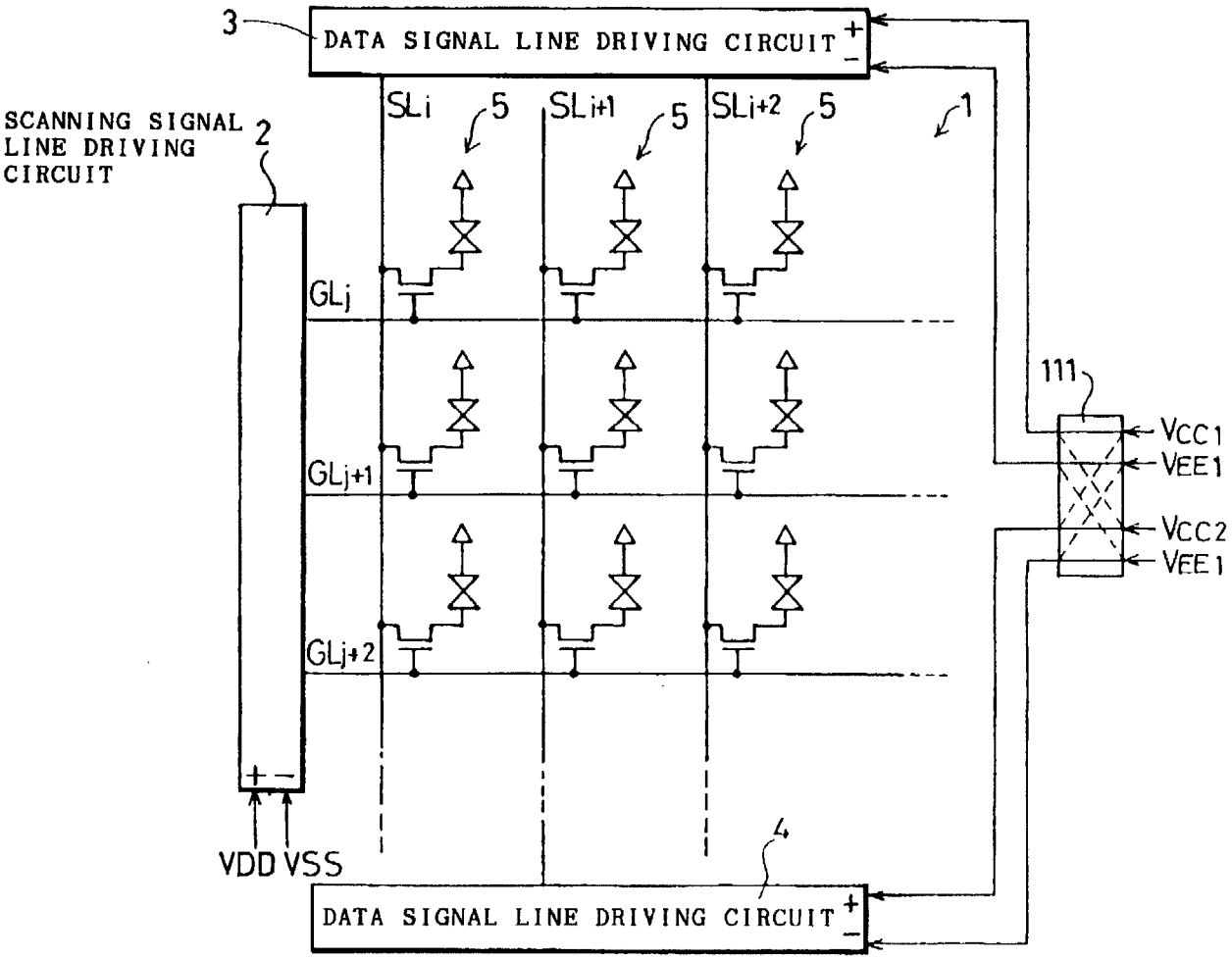
FIG. 38 is a block diagram showing the constitution of essential parts of the image display device according to Example 6 of the invention.

The image display device of the embodiment comprises, as shown in FIG. 38, a pixel array 1, a scanning signal line driving circuit 2, data signal line driving circuits 3, 4, and a power supply changeover circuit 111.

The data signal line driving circuits 3, 4 are designed to operate according to supply voltages VCC1, VEE1 and supply voltages VCC2, VEE2 applied through the power supply changeover circuit 111. The data signal line driving circuits 3, 4 are composed of thin film transistors (see FIG. 30) formed on an insulating substrate (glass substrate). The data signal line driving circuits 3, 4 may be any of the panel sample-and-hold system, driver sample-and-hold system, and digital driving system.

The power supply changeover circuit 111 is designed to alternately change over and send out the supply voltages VCC1, VEE1 and the supply voltages VCC2, VEE2, by the external signal (not shown in the figures) changed over in every field. In the power supply changeover circuit 111, the pixel array 1 and driving circuit are built in the image display module formed integrally on the same substrate. Hence, the number of signal lines and power supply lines fed into the module is reduced, and the interface is simplified and the system is smaller in size. Even if the power supply changeover circuit 111 is provided outside the module, the intrinsic functions of the image display device are not impaired.

When displaying in this constitution, for example, in a certain display field, a certain data signal line SLi is connected to the data signal line driving circuit 3, and data of positive polarity is written, and the adjoining data signal line SLi+1 is connected to the data signal line driving circuit 4, and data of negative polarity is written. In the next display field, the supply voltages of the data signal line driving circuits 3, 4 are changed over by the power supply changeover circuit 111, so that the levels of the timing signal and video signal are also changed over. As a result, data of reverse polarity of the previous field is written in the data signal lines SLi, SLi+1, respectively.

Since this embodiment is basically driven in "frame+source source line inversion," in the same way as in the embodiment, in Example 4 data of respective polarities can be supplied to the data signal lines SLi, SLi+1, . . . by the two data signal line driving circuits 3, 4 differing in the supply voltage level. As a result, the output voltage range of the data signal line driving circuits 3, 4 is narrowed, and the power consumption can be reduced, and the breakdown voltage of the elements can be lowered.

Since the data signal line driving circuits 3, 4 in the embodiment are composed of thin film transistors formed on an insulating substrate, there is no parastic capacity with substrate and the load is small. In the general IC, a parasitic capacitance intervenes between the substrate and wiring substrate, and when the ground potential is changed at the time of changeover of the supply voltage, a large current flows momentarily due to the parasitic capacitance, which becomes a large burden for the changeover action. Therefore, since there is no prasitic capacity with substrate, the supply voltage can be changed over quickly, and also the noise due to changeover of the supply voltage can be reduced.

Furthermore, in the embodiment, since the connection of data signal line SL is fixed, the display position adjusting circuit required in the embodiments disclosed in Examples 4 and 5 is not necessary.

EXAMPLE 7

A further embodiment of the invention is described below by reference to FIGS. 39 and 40. The constituent elements in the embodiment having the same functions as the constituent elements in the embodiments in Examples 4 and 5 are identified with the same reference. numerals, and their explanations are omitted.

Figure 39:
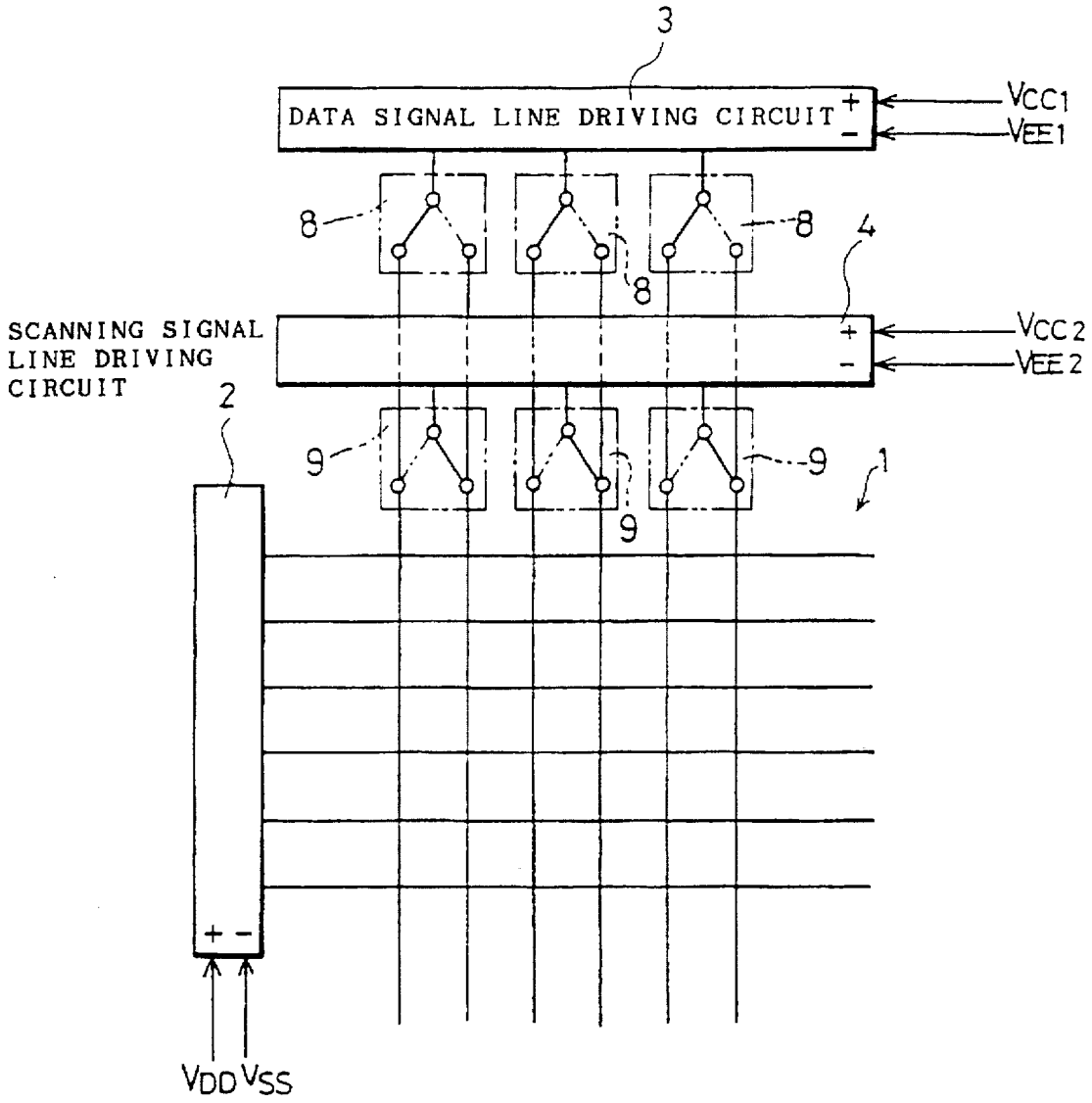
FIG. 39 is a block diagram showing the constitution of essential parts of the image display device according to Example 7 of the invention.

The image display device of the embodiment comprises, as shown in FIG. 39, a pixel array 1, a scanning signal line driving circuit 2, and data signal line driving circuits 3, 4, and the constitution is basically the same as that of the image display device in the embodiment in Example 4. In this image display device, however, the constitution of the embodiment differs from that in Example 4 in that the data signal line driving circuit 4 is provided on the same side as the data signal line driving circuit 3 with respect to the pixel array 1. Besides, the analog switch 9 is also disposed accordingly on the same side of the data signal line driving circuit 3.

Figure 40:
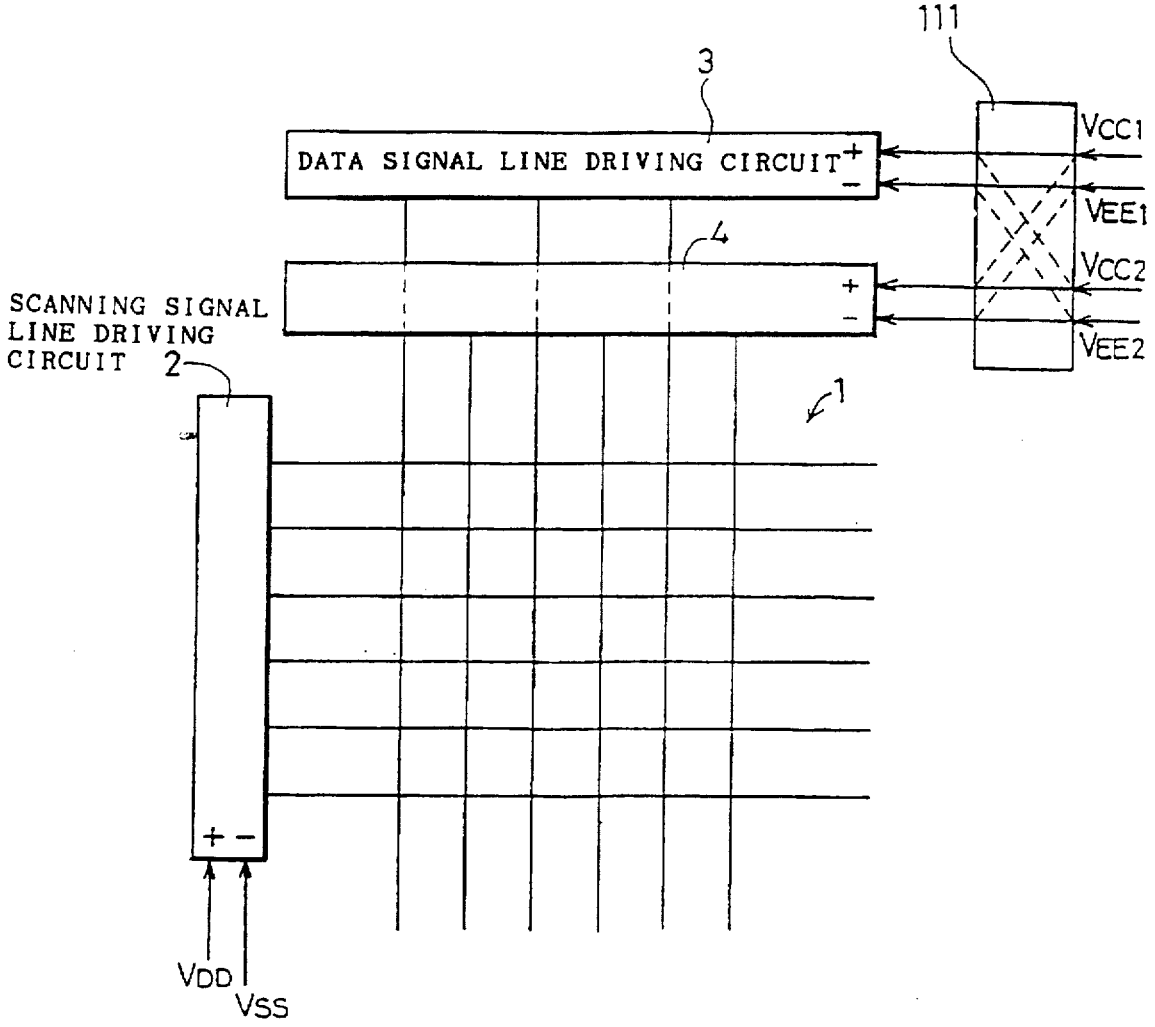
FIG. 40 is a block diagram showing the constitution of essential parts of another image display device according to Example 7 of the invention.

On the other hand, the other image display device of the embodiment comprises, as shown in FIG. 40, a pixel array 1, a scanning signal line driving circuit 2, data signal line driving circuits 3, 4, and a power supply changeover circuit 111, and basically it is the same as the constitution of the image display device in the embodiment in Example 6. However, this image display device differs from the constitution of the embodiment in Example 6 in that the data signal line driving circuit 4 is provided on the same side as the data signal line driving circuit 3 with respect to the pixel array 1.

In both image display devices, the data signal line driving circuits 3, 4 operating at different supply voltages may be disposed adjacently, or incorporated and arranged. In such a case, the arrangement may be easily realized when the data signal line driving circuits 3, 4 are composed of thin film transistors without a substrate or well.

By thus disposing the two data signal line driving circuits 3, 4 on the same side of the pixel array 1, distributions of signal lines from the circuit (not shown in the figures) as the signal supply source to the data signal line driving circuits 3, 4 may be nearly equal, and deviation in transmission of signals to the both driving signals 3, 4 may be eliminated. To compensate for the signal delay when forming a large screen for the image display device or shortage of driving force of the data signal line driving circuits 3, 4, it is necessary to feed data signals from both sides of the data signal lines SLi, SLi+1. Further and when another two data line driving circuits 3, 4 are provided on the other side of the pixel array 1, it is also possible in this case to drive by means of the data signal line driving circuits 3, 4.

Examples of the technique for saving power consumption and the technique for lowering the driving voltage have been presented so far, but their constitutions are rather fundamental, and those embodiments disclosed in Examples 4–7 may be further modified or combined. The foregoing embodiments relate to the active matrix liquid crystal display device, but this is not limiting, and it can be applied to other display devices of the active matrix driving system. Examples of other display devices include, among others, plasma display, LED display, and EL display.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An image display device comprising:

a plurality of pixels disposed in a matrix form;

a plurality of scanning signal lines, each scanning signal line connected to one row of the pixels;

a plurality of data signal lines, each data signal line connected to one column of the pixels;

a scanning signal line driving circuit for driving each scanning signal line with a scanning signal;

a plurality of data signal line driving circuits, each individually powered by a power source of a different voltage magnitude, for applying input video signals of a first polarity to a first group of the data signal lines and applying video signals of a second polarity, different from the first polarity, to a second group of data signal lines, and inverting the polarity of the video signals applied to the first and second groups of the data signal lines in every predetermined data display period; and means for switching a connection combination of the plurality of data signal line driving circuits between the first group and the second group of the data signal lines every predetermined data display period by switching connection of terminals of the plurality of data signal line driving circuits between data signal lines belonging to one of the first and second groups and data signal lines belonging to another of the first and second groups every predetermined data display period.

2. The image display device of claim 1, wherein the means for switching includes two systems of switching elements, each of the switching elements in each system being commonly connected to one output stage of one of the data signal line driving circuits, and connected to a pair of data signal lines, and each of the two systems of switching elements being conducted alternately in every predetermined data display period to different ones of each data signal line pair.

3. The image display device of claim 1, wherein the means for switching includes a first switching element connected to one output stage of the data signal line driving circuits for receiving an input video signal, and a second switching element for applying the received video signal to the data signal lines.

4. The image display device of claim 1, wherein part or all of the data signal line driving circuits and means for switching are formed on one of a monocrystalline silicon thin film and a polycrystalline silicon thin film formed on an insulating substrate.

5. The image display device of claim 2 or 3, wherein the switching elements or the first switching element and second switching element are gates of a CMOS structure including a parallel connected n-channel transistor and p-channel transistor.

6. An image display device comprising:

a plurality of pixels disposed in a matrix form;

a plurality of scanning signal lines, each scanning signal line connected to one row of the pixels;

a plurality of data signal lines, each data signal line connected to one column of the pixels;

a scanning signal line driving circuit for driving each scanning signal line with a scanning signal;

a plurality of data signal line driving circuits for applying input video signals of a first polarity to a first group of the data signal lines and applying video signals of a second polarity to a second group of the data signal lines, and inverting the polarity of the video signals applied to the first and second groups of the data signal lines in every predetermined data display period; and connecting means for connecting each of the plurality of data signal line driving circuits to power sources of different voltage magnitudes and polarities, the connecting means connecting each of the plurality of data signal line driving circuits to power sources of different magnitudes and polarities every predetermined data display period, wherein, part or all of the data signal line driving circuits are formed on one of a monocrystalline silicon thin film and a polycrystalline silicon thin film formed on an insulating substrate.

7. The image display device of claim 6, wherein the connecting means is formned on the insulating substrate.

8. The image display device of claim 1 or 6, wherein the data signal line driving circuits are driven at such a supply voltage as to each apply only the video signal of one polarity to a data signal line.

9. The image display device of claim 1 or 6, wherein the data signal line driving circuits include, sampling means for sampling the video signals and for transferring the sampled video signals to the data signal lines.

10. The image display device of claim 1 or 6, wherein the data signal line driving circuits include, sampling means for sampling the video signals, holding means for temporarily holding the video signals sampled by the sampling means, and amplifying means for amplifying the video signals held by the holding means and for transferring the amplified video signal to the data signal lines.

11. The image display device of claim 1 or 6, wherein the data signal line driving circuits include, sampling means for sampling digital signals representing video information,and selecting means for selecting one of a plurality of discrete voltages based upon the digital signals sampled by the sampling means and for transferring the selected discrete voltages to the data signal lines.

12. The image display device of claim 1 or 6, wherein the data signal line driving circuits are disposed on the same side of the pixel matrix.

13. The image display device of claim 1 or 6, wherein each pixel possesses a liquid crystal element.

14. A display driving system for driving an image display device including a plurality of scanning lines arranged in parallel in a first direction, a plurality of data lines arranged in parallel in a second direction perpendicular to the first direction so as to intersect the plurality of scanning lines, and a matrix of picture elements arranged at the data and scanning line intersections, the display driving system, comprising:

scan line driving means for supplying scan line drive signals to the plurality of scanning lines;

first data line driving means for applying input data signals and signals of a first magnitude and first polarity to the data lines;

second data line driving means for applying input data signals and signals of a second magnitude and second polarity, different from each of the first magnitude and first polarity respectively, to the data lines; and switching means for switching a connection combination of the first and second data line drive means between a first group of the data lines and a second group of the data lines, different from the first group, every predetermined display period by switching connection of terminals of the first and second data line drive means between the data signal lines belonging to one of the first and second groups and data signal lines belonging to another one of the first and second groups every predetermined display period.

15. The display driving system of claim 14, wherein the first group of data lines include odd-numbered data lines and the second group includes even-numbered data lines.

16. The display driving system of claim 14, wherein the switching means includes a first switching circuit connected between the first data line driving means and a first end of the data lines and a second switching circuit connected between the second data line drive means and a second end of the data lines, opposite the first end.

17. The display driving system of claim 16, wherein each of the first and second switching circuits include a plurality of switches, each for connecting one of the first and second data line driving means to one of a pair of data lines.

18. The display driving system of claim 14, wherein the switching means switches connection between the first and second data line driving means and the first and second group of data lines every field of the input data signals.

19. The display driving system of claim 17, wherein the switching means switches connection between the first and second data line driving means and the first and second group of data lines every field of the input data signals.

20. The image display device of claim 1, wherein the means for switching switches the plurality of data signal line driving circuits every field of input video signals.

21. The image display device of claim 1, wherein the first group includes odd-numbered data signal lines and the second group includes even-numbered data signal lines.

22. The image display device of claim 6, wherein the first group includes odd-numbered data signal lines and the second group includes even-numbered data signal lines.

23. The image display device of claim 6, wherein the connecting means connects each of the plurality of data signal line power sources of different magnitudes to each of the plurality of data signal line driving circuits every field of input video signals.

* * * * *